US011592187B2

(12) United States Patent
Babu et al.

(10) Patent No.: US 11,592,187 B2
(45) Date of Patent: Feb. 28, 2023

(54) AUTOMATIC SAFETY DEVICE AND METHOD FOR A STOVE

(71) Applicant: Inirv Labs, Inc., Durham, NC (US)

(72) Inventors: Ranjith Babu, Durham, NC (US); Akshita Iyer, Durham, NC (US); Patrick Thomas Bailey, Charlotte, NC (US); Raeshon McNeil, Charlotte, NC (US); Jeremy Losaw, Charlotte, NC (US)

(73) Assignee: INIRV LABS, INC., Durham, NC (US)

( * ) Notice: Subject to any disclaimer, the term of this patent is extended or adjusted under 35 U.S.C. 154(b) by 3 days.

(21) Appl. No.: 16/273,492

(22) Filed: Feb. 12, 2019

(65) Prior Publication Data

US 2019/0178502 A1 Jun. 13, 2019

Related U.S. Application Data

(62) Division of application No. 15/639,736, filed on Jun. 30, 2017, now Pat. No. 10,228,147.

(60) Provisional application No. 62/447,181, filed on Jan. 17, 2017, provisional application No. 62/404,522, filed on Oct. 5, 2016, provisional application No. 62/379,671, filed on Aug. 25, 2016, provisional application No. 62/356,864, filed on Jun. 30, 2016.

(51) Int. Cl.

| | |
|---|---|
| ***F24C 7/08*** | (2006.01) |
| ***F24C 15/10*** | (2006.01) |
| ***H05B 1/02*** | (2006.01) |
| ***F24C 3/12*** | (2006.01) |

(52) U.S. Cl.
CPC ..... *F24C 7/088* (2013.01); *F24C 7/082* (2013.01); *F24C 15/103* (2013.01); *H05B 1/0266* (2013.01)

(58) Field of Classification Search
CPC ..... F24C 15/103; F24C 7/082; F24C 7/088; H05B 1/0266
See application file for complete search history.

(56) References Cited

U.S. PATENT DOCUMENTS

| | | | |
|---|---|---|---|
| 2,761,051 | A | 8/1956 | Dodson |
| 3,808,577 | A | 4/1974 | Mathauser |
| 4,070,670 | A | 1/1978 | Chen |
| 4,659,909 | A | 4/1987 | Knutson |

(Continued)

FOREIGN PATENT DOCUMENTS

| | | | |
|---|---|---|---|
| CN | 200982460 | U | 11/2007 |
| CN | 104062936 | A | 9/2014 |

(Continued)

OTHER PUBLICATIONS

Extended European Search Report in European Application No. 17819477.5, dated Jun. 17, 2020, 9 pages.

(Continued)

*Primary Examiner* — Jorge A Pereiro
*Assistant Examiner* — Logan P Jones
(74) *Attorney, Agent, or Firm* — Alston & Bird LLP

(57) ABSTRACT

Device and method are described for operational control of a knob on a stove or range. In some examples, a safety device, a sensor relay device, and method are described for automatically positioning an operational shaft of a burner to an Off position such that the power supplied to the burner is terminated upon the occurrence of a safety event.

20 Claims, 41 Drawing Sheets

(56) References Cited

U.S. PATENT DOCUMENTS

| | | | | |
|---|---|---|---|---|
| 4,814,748 | A * | 3/1989 | Todd | G08B 17/10 340/628 |
| 5,094,259 | A | 3/1992 | Hsu | |
| 5,628,242 | A | 5/1997 | Higley | |
| 5,670,074 | A | 9/1997 | Kass et al. | |
| 5,945,017 | A * | 8/1999 | Cheng | F23D 14/76 219/446.1 |
| 6,164,958 | A | 12/2000 | Huang et al. | |
| 6,294,994 | B1 * | 9/2001 | Hoellerich | F24C 7/08 219/490 |
| 7,117,893 | B1 | 10/2006 | Krupa | |
| 7,327,246 | B2 | 2/2008 | Schoor | |
| 7,816,818 | B2 | 10/2010 | Sellecchia | |
| 9,030,319 | B1 | 5/2015 | Haynes | |
| 2002/0113062 | A1 | 8/2002 | Cranford | |
| 2003/0154970 | A1 * | 8/2003 | Huang | F24C 3/124 126/39 R |
| 2005/0098170 | A1 | 5/2005 | Raynor | |
| 2005/0109333 | A1 | 5/2005 | Thomas | |
| 2006/0164253 | A1 * | 7/2006 | Harvey | G08B 17/10 340/506 |
| 2006/0207988 | A1 * | 9/2006 | Larson | F24C 15/106 219/501 |
| 2009/0017404 | A1 | 1/2009 | White et al. | |
| 2009/0065081 | A1 | 3/2009 | Luebbers | |
| 2009/0189747 | A1 | 7/2009 | Baier et al. | |
| 2009/0302026 | A1 | 12/2009 | Shaw | |
| 2011/0057806 | A1 * | 3/2011 | Gonzales | G08B 17/10 340/628 |
| 2012/0261599 | A1 | 10/2012 | Legaspi | |
| 2012/0325197 | A1 * | 12/2012 | Legaspi | F23N 5/242 126/42 |
| 2013/0260320 | A1 * | 10/2013 | Townsend | F24C 3/12 431/2 |
| 2014/0015678 | A1 * | 1/2014 | Zribi | G08B 29/26 340/589 |
| 2014/0030663 | A1 | 1/2014 | Pickering et al. | |
| 2014/0234496 | A1 | 8/2014 | Siegel et al. | |
| 2014/0261007 | A1 * | 9/2014 | Golomb | F23N 5/242 431/14 |
| 2015/0312964 | A1 * | 10/2015 | Sorenson | A47J 37/0676 219/443.1 |
| 2016/0000251 | A1 * | 1/2016 | Mosley | F24C 3/126 99/337 |
| 2016/0051078 | A1 * | 2/2016 | Jenkins | F24C 3/12 99/331 |
| 2016/0227350 | A1 | 8/2016 | Zhang et al. | |
| 2016/0245531 | A1 * | 8/2016 | Ronk | F27D 21/0014 |
| 2017/0219215 | A1 * | 8/2017 | Hui | F24C 7/083 |
| 2017/0238751 | A1 * | 8/2017 | Vengroff | F24C 7/087 |
| 2017/0307206 | A1 | 10/2017 | Yantis | |

FOREIGN PATENT DOCUMENTS

| | | | |
|---|---|---|---|
| GB | 16862 | | 7/1908 |
| GB | 190814005 | A * | 11/1908 |
| JP | 02-17522 | A | 7/1990 |
| JP | 02178522 | A * | 7/1990 |
| JP | 2011 048686 | A | 3/2011 |
| KR | 2004-0039933 | A | 5/2004 |
| KR | 2011-0009394 | A | 1/2011 |
| KR | 10-1478963 | B1 | 1/2016 |
| WO | WO 2009/154367 | A2 | 12/2009 |
| WO | WO 2016/028921 | A1 | 2/2016 |

OTHER PUBLICATIONS

International Search Report and Written Opinion from International Application No. PCT/IB2017/053992, dated Oct. 24, 2017, 30 pages.

Kickstarter—Meld: A Perfect Meal Every Time; [online] [retrieved Aug. 28, 2017]. Retrieved from the Internet: <URL: https://www.kickstarter.com/projects/meld/meld-a-perfect-meal-every-time/description, 18 pages.

Meet the New iGuardStove—Automatic Stove Shut Off Device [online] [retrieved Feb. 10, 2016], Retrieved from the Internet: <URL: http://www.guardfire.com/oldsite/new-iguardstove-page/>, 11 pages.

Miele, "Operating and installation instructions gas cooktop", Feb. 22, 2014.

Printeraction, "Basic gear mechanisms", Aug. 14, 2015, Instructables.

* cited by examiner

SECTION A-A
SCALE 1:2

AUTOMATIC SAFETY DEVICE AND METHOD FOR A STOVE

CROSS-REFERENCE TO RELATED APPLICATIONS

This application is a divisional application of U.S. Non-Provisional Patent Application Ser. No. 15/639,736, filed Jun. 30, 2017, which claims priority to U.S. Provisional Application No. 62/356,864, filed Jun. 30, 2016, U.S. Provisional Application No. 62/379,671, filed Aug. 25, 2016, U.S. Provisional Application No. 62/404,522, filed Oct. 5, 2016, and U.S. Provisional Application No. 62/447,181, filed Jan. 17, 2017, the entire contents of which are incorporated in their entireties herein by reference.

FIELD OF THE INVENTION

An automated safety device is described for operational control of a knob on a stove or range and, more particularly, a safety device and method is described for automatically positioning an operational shaft, such as for a burner, to an Off position for terminating power to the burner upon the occurrence of a safety event.

BACKGROUND OF THE INVENTION

A large number of residential and commercial fires originate in the kitchen during cooking. The stove top burner is a common source for ignition of these fires, for example, as overheated cooking oils or greases can easily ignite. The risks of a fire igniting are significantly higher during unattended use of a stove or range oven. One way to reduce damage of a fire caused by a stovetop burner is to shut off the power to the burner when the fire starts. However, if no one is present, the stove or burner cannot be manually shut off.

SUMMARY OF THE INVENTION

For the foregoing reasons, there is a need for a safety device for automatically rotating an operational shaft of a burner to an Off position upon the occurrence of a safety event for shutting off power to the burner. Various sensors and detectors may be provided for detecting abnormal, emergency, or hazardous operating conditions, which may comprise a safety event. In particular, the system may be regulated by at least a motion detector, which senses the presence or absence of a user and, in the latter case, actuates the safety device to turn the operational shaft of the burner to the Off position. In some example embodiments, the device is configured to be incorporated by manufacturers directly into a new burner control apparatus without changing its appearance or operating procedures. In other examples, the device can be retrofitted to existing or already manufactured burner controls.

In one example, a device for operational control of a burner is provided. The device comprising: a fixed base member, a motor member configured to be attached to an operational shaft of the burner, and a controller configured to control rotation of the motor member to cause rotation of the operational shaft of the burner in response to a signal caused by a sensor.

In some examples, the motor member comprises: a gear train configured to engage the fixed base member, and a motor connected to the gear train. The controller is configured to control rotation of the motor to turn the gear train and cause rotation of the operational shaft of the burner in response to a signal caused by the sensor.

In some examples, the motor member comprises a straight drive motor connected directly to the operational shaft of the burner. In some examples, the straight drive motor comprises a gimbal motor.

In some example embodiments, the device further comprises a rechargeable power source comprising a rechargeable battery, and a recharging mechanism configured to recharge the rechargeable battery. In some examples, the recharging mechanism comprises a wireless charging receiver. The recharging mechanism may also comprise a solar panel.

In some example embodiments, the device further comprises a shaker motor configured to provide haptic or tactile feedback. The shaker motor may be configured to activate if the device is touched by a user.

In some example embodiments, the device further comprises a housing member to form a knob.

In some examples, the motor member is configured to be removably attached to the operational shaft of the burner. In some examples, the burner and the operational shaft of the burner were not originally manufactured to include the removably attached motor member and fixed base member.

In some examples, the motor member is integrated with the operational shaft of the burner. The burner and the operational shaft of the burner may be manufactured to include the integrated motor member and fixed base member.

In some example embodiments, the burner is part of a plurality of burners comprising one of a stove, a range, and an oven.

In some example embodiments, the device provides operational control of one of a plurality of burners, wherein each burner of the plurality of burners is associated with a device for operational control of the burner. In some example embodiments, the burner is a single burner.

In some example embodiments, the device further comprises a knob adapter member attached to a top of the device, wherein the adapter member is configured to attach a top knob to the device. In some examples, the knob adapter member further comprises a first magnet attached to the top of the device and configured to magnetically attach the top of the device to one or more of a second magnet or a ferromagnetic material attached to the bottom of the top knob, such that the top knob is configured to be magnetically attached to the top of the device.

In some examples, the knob adapter member further comprises a first ferromagnetic material attached to the top of the device and configured to magnetically attach the top of the device to a magnet attached to the bottom of the top knob, such that the top knob is configured to be magnetically attached to the top of the device. In some examples, the knob adapter member further comprises a first magnet attached to the top of the device and a second magnet attached to a bottom of the top knob, such that the top knob is configured to be magnetically attached to the top of the device.

In some example embodiments, the knob adapter member is configured to prevent rotation of an attached top knob. In some examples, the knob adapter member comprises teeth configured to interlock with corresponding teeth of the attached top knob to prevent rotation of the attached top knob.

In some examples, the knob adapter member is structured to mimic an attachment part of the operational shaft, such that the top knob can be attached to the top of the device. The top knob may also comprise an original knob for operational control of the burner.

In some examples, the controller is configured to cause the motor member to turn the operational shaft of the burner to an Off position. In some examples, the controller is configured to receive the signal and turn the burner to the Off position in response to the signal. In some examples, the signal is a hazard detected signal.

In some example embodiments, the hazard detected signal can be transmitted to the device by a sensor/relay device comprising the sensor, wherein the hazard detected signal is transmitted in response to an occurrence of a safety event, and wherein the occurrence of the safety event comprises one or more of: elapsed no motion time; smoke detection; flammable gas detection; fire detection; remote location detection; and carbon monoxide detection.

In some example embodiments, the signal is an off signal. In some examples, the off signal is received by the device from a sensor/relay device. In some examples, the off signal is received by the device in response to a user off action.

In some example embodiments, the controller receives a timer expiration signal from a timer when an expiration time of the timer elapses, wherein the controller is configured to cause the motor member to turn the operational shaft of the burner to the Off position when the controller receives the timer expiration signal.

In some example embodiments the controller comprises a timer with an expiration time, wherein the controller is configured to start the timer and cause the motor member to turn the operational shaft of the burner to the Off position when the timer expires. In some examples, the controller is configured to restart the timer in response to a restart signal. In some examples, the restart signal is received from a sensor/relay device, wherein the restart signal indicates human motion was detected. In some examples, the restart signal is received from a sensor/relay device, wherein the restart signal indicates a user selection to restart the timer.

In some example embodiments, the sensor comprises a motion sensor, wherein the restart signal is received from the motion sensor of the device, wherein the restart signal indicates human motion was detected.

In some example embodiments, the device further comprises a touch button, wherein the restart signal is received from the touch button of the device, wherein the restart signal indicates that a user touched the touch button of the device. In some examples, the sensor comprises a motion sensor, and wherein the restart signal is transmitted from a motion sensor of the device. In some examples, the expiration time is one of five, ten, fifteen, twenty, twenty-five, thirty, thirty-five, forty, forty-five, fifty, fifty-five, or sixty minutes.

In some example embodiments, the device further comprises a top light positioned to emit light from a top portion of the device. In some examples, the top light comprises an array of light emitting diodes (LEDs). In some examples, the top light is configured to emit light corresponding to a position of the device, wherein the position of the device corresponds to a position of the operational shaft of the burner. In some examples, the top light is configured to emit light in a plurality of segments. In some examples, the top light is configured to emit light in four quadrants, wherein a first quadrant emits light corresponding to a selection of a first user selection; wherein a second quadrant emits light corresponding to a selection of a second user selection, a third quadrant emits light corresponding to a selection of a third user selection, and wherein a fourth quadrant emits light corresponding to a selection of a fourth user selection.

In some examples, the first user selection, the second user selection, the third user selection, and the fourth user selection comprise a user selection of an expiration time for a timer.

In some example embodiments, the device with top lights further comprises a bottom light positioned to emit light from a bottom portion of the device. In some examples, the bottom light comprises an array of light emitting diodes (LEDs).

In some example embodiments, the device further comprises a bottom light positioned to emit light from a bottom portion of the device. In some examples, the bottom light comprises an array of light emitting diodes (LEDs). In some examples, the bottom light is configured to emit light corresponding to an operational status of the device, wherein the operational status comprises at least one of: a device off status; a device on status; a burner on status; a timer expiration status; a hazard detected status; and a device error.

In some examples, the controller is configured to modulate the power supplied to the burner by causing the motor member to turn the operational shaft of the burner to one of a plurality of On positions.

In some examples, the controller is configured to modulate the power supplied to the burner in response to receiving a control signal from a user device.

In some examples, the controller is configured to modulate the power supplied to the burner in response to receiving a control signal from a cooking device.

In some examples, the plurality of On positions includes at least a low position, a medium low position, a medium position, a medium high position, and a high position.

In some examples, the fixed base member is configured to be affixedly mounted, surrounding the operational shaft of the burner, to a surface of a stove, range, or oven of the burner.

In some example embodiments a system for operational control of a burner is provided. In some examples the system comprises a safety device module comprising: a fixed base member; a motor member configured to be attached to an operational shaft of the burner and comprising a motor; and a controller configured to control rotation of the motor to cause rotation of the operational shaft of the burner. The system also comprises a sensor/relay module comprising: one or more sensors configured to generate one or more monitoring signals; a processor, wherein the processor receives the one or more monitoring signals and generates one or more control signals; and a communication unit configured to transmit the one or more control signals to the controller, wherein the controller is configured to interpret the control signals to control rotation of the motor to cause rotation of the operational shaft of the burner.

In some examples, the motor member of the safety device module further comprises a gear train configured to engage the base member, wherein the motor is connected to the gear train, and wherein rotation of the motor causes rotation of the gear train to cause rotation of the operational shaft of the burner.

In some examples, the motor member is configured to be removably attached to the operational shaft of the burner. In some examples, the burner and the operational shaft of the burner were not originally manufactured to include the removably attached motor member and fixed base member. In some examples, the motor member is integrated with the operational shaft of the burner. In some examples, the burner and the operational shaft of the burner are manufactured to include the integrated motor member and fixed base member.

In some examples, the burner is part of a plurality of burners comprising one of a stove, a range, and an oven. In some examples, the safety device module provides operational control of one of a plurality of burners, wherein each burner of the plurality of burners is associated with a safety device module for operational control of the burner.

In some examples, the burner is a single burner.

In some example embodiments, the system further comprises, a knob adapter member attached to a top of the safety device module, wherein the adapter member is configured to attach a top knob to the safety device module. In some examples, the knob adapter member is structured to mimic an attachment part of the operational shaft, such that the top knob can be attached to the top of the safety device module. In some examples, the top knob comprises an original knob for operational control of the burner. In some examples, the controller is configured to cause the motor to turn the operational shaft of the burner to an Off position.

In some examples, the controller is configured to receive one or more control signals from the communication unit and turn the burner to the Off position in response to the control signal.

In some examples, the processor of the sensor/relay module is further configured to determine from the monitoring signals that a safety event has occurred and generate a hazard detected control signal.

In some examples, the hazard detected control signal is transmitted by the communication unit to the controller, and wherein determining from the monitoring signals that a safety event has occurred comprises determining, by the processor, from the monitoring signals that one or more of: elapsed no motion time; smoke detection; flammable gas detection; fire detection; remote location detection; and carbon monoxide detection has occurred.

In some examples, the control signal is an off signal.

In some examples, the controller receives a timer expiration signal from a timer when an expiration time of the timer elapses, wherein the controller is configured to cause the motor to turn the operational shaft of the burner to the Off position when the controller receives the timer expiration signal.

In some examples, the controller comprises a timer with an expiration time, wherein the controller is configured to start the timer and cause the motor to turn the operational shaft of the burner to the Off position when the timer expires.

In some examples, the controller is configured to restart the timer in response to a restart signal. In some examples, the restart signal is received from the sensor/relay module, wherein the restart signal indicates human motion was detected. In some examples, the restart signal is received from the sensor/relay module, wherein the restart signal indicates a user selection to restart the timer.

In some example embodiments, the safety device module further comprises a motion sensor, wherein the restart signal is received from the motion sensor of the safety device module, wherein the restart signal indicates human motion was detected.

In some examples, the safety device module further comprises a touch button, wherein the restart signal is received from the touch button of the safety device module, and wherein the restart signal indicates that a user touched the touch button of the safety device module.

In some examples, the one or more sensors of the sensor/relay module comprises a motion sensor, and wherein the restart signal comprises a control signal generated by the processor and received at the controller from the communication unit.

In some examples, the safety device module further comprises: a top light positioned to emit light from a top portion of the safety device module. In some examples, the top light comprises an array of light emitting diodes (LEDs). In some examples, the top light is configured to emit light corresponding to a position of the safety device module, wherein the position of the safety device module corresponds to a position of the operational shaft of the burner. In some examples, the top light is configured to emit light in a plurality of segments. In some examples, the top light is configured to emit light in four quadrants, wherein a first quadrant emits light corresponding to a selection of a first user selection; wherein a second quadrant emits light corresponding to a selection of a second user selection, a third quadrant emits light corresponding to a selection of a third user selection, and wherein a fourth quadrant emits light corresponding to a selection of a fourth user selection. In some example embodiments, the first user selection, the second user selection, the third user selection, and the fourth user selection comprise a user selection of an expiration time for a timer.

In some examples, the safety device module further comprises: a bottom light positioned to emit light from a bottom portion of the safety device module. In some examples, the bottom light is configured to emit light corresponding to an operational status of the system, wherein the operational status comprises one of: a system off status; a system on status; a burner on status; a timer expiration status; a hazard detected status; a safety device error; a sensor/relay module error; and a system error.

In some examples, the system further includes a user interface module comprising: user interface circuitry configured to receive a user selection and generate one or more user control signals based on the received user selection; and a user module communication unit configured to transmit the one or more user control signals to the sensor/relay module, wherein the communication unit of the sensor/relay module is further configured to receive the user control signals and transmit the user control signals to the controller, wherein the controller is further configured to modulate the power supplied to the burner by causing the motor to turn the operational shaft of the burner to one of a plurality of On positions in response to the one or more user control signals.

In some examples, the system further includes a cooking module comprising: one or more cooking sensors configured to generate one or more cooking signals; a processor, wherein the processor receives the one or more cooking signals and generates one or more cooking control signals; and a cooking communication unit configured to transmit the one or more control signals to the sensor/relay module, wherein the communication unit of the sensor/relay module is configured to receive the cooking control signals and transmit the cooking control signals to the controller, wherein the controller is further configured to modulate the power supplied to the burner by causing the motor to turn the operational shaft of the burner to a plurality of On positions in response to the one or more cooking control signals.

In some examples, the plurality of On positions include a low position, a medium low position, a medium position, a medium high position, and a high position.

In some examples, the one or more sensors comprises one or more of a motion detector, a smoke detector, a carbon monoxide detector, a humidity sensor, a gas sensor, a fire detector, a flame detector, a camera, and a microphone.

In some examples, the safety device module further comprising: a rechargeable power source comprising a rechargeable battery; and a recharging mechanism configured to recharge the rechargeable battery.

In some examples, the recharging mechanism comprises a wireless charging receiver. In some examples, the recharging mechanism comprises a solar panel. In some examples, the sensor/relay module further comprising: a rechargeable power source comprising a rechargeable battery; and a recharging mechanism configured to recharge the rechargeable battery.

In some examples, the recharging mechanism comprises a wireless charging receiver. In some examples, the recharging mechanism comprises a solar panel.

In another example embodiment, a method for operational control of a burner is provided. The method comprising: receiving a monitoring signal from a sensor; determining whether a parameter of the monitoring signal exceeds a predetermined threshold; and based on the determination that the parameter exceeds the predetermined threshold, sending a control signal to a controller; wherein the controller controls a motor that is connected to an operational shaft of a burner and is configured to cause the motor to turn the operational shaft of the burner in response to the control signal based upon the monitoring signal from the sensor.

In some examples, the control signal is sent to a plurality of controllers, wherein each of the plurality of controllers controls a motor that is connected to an operational shaft of a burner of a plurality of burners. In some examples, the control signal causes the motor to turn the operational shaft of the burner to an Off position.

In some examples, the sensor comprises one of a motion detector, a smoke detector, a carbon monoxide detector, a humidity sensor, a gas sensor, a fire detector, a flame detector, a camera, and a microphone.

In some examples, the method further comprises starting a timer with an expiration time; determining that the timer has expired; and based on the determination that the timer has expired, sending a control signal to the controller.

In some examples, the method further comprises restarting the timer upon determination that human motion is detected.

In some examples, the method further comprises: receiving a user selection from a user interface; determining a user control signal from the user selection; and sending the user control signal to the controller.

In another example embodiment, a non-transitory computer-readable storage medium for operational control of a burner is provided. The non-transitory computer-readable storage medium storing program code instructions that, when executed, cause a computing device to: receive a monitoring signal from a sensor; determine whether a parameter of the monitoring signal exceeds a predetermined thresh-old; and based on the determination that the parameter exceeds the predetermined threshold, send a control signal to a controller; wherein the controller controls a motor that is connected to an operational shaft of a burner and is configured to cause the motor to turn the operational shaft of the burner in response to the control signal based upon the monitoring signal from the sensor.

In some examples, the control signal is sent to a plurality of controllers, wherein each of the plurality of controllers controls a motor that is connected to an operational shaft of a burner of a plurality of burners.

In some examples, the control signal causes the motor to turn the operational shaft of the burner to an Off position.

In some examples, the non-transitory computer-readable storage medium stores further program code instructions that, when executed, cause the computing device to further: start a timer with an expiration time; determine that the timer has expired; and based on the determination that the timer has expired, send a control signal to the controller.

In some examples, the non-transitory computer-readable storage medium stores further program code instructions that, when executed, cause the computing device to further restart the timer upon determination that human motion is detected.

In some examples, the non-transitory computer-readable storage medium stores further program code instructions that, when executed, cause the computing device to further: receive a user selection from a user interface; determine a user control signal from the user selection; and send the user control signal to the controller.

In some examples, the non-transitory computer-readable storage medium stores further program code instructions that, when executed, cause the computing device to further: receive a cooking signal from a cooking module; determine a cooking control signal from cooking signal; and send the cooking control signal to the controller.

BRIEF DESCRIPTION OF THE DRAWINGS

For a more complete understanding of the automatic safety device and method, reference is now made to the embodiments shown in the accompanying drawings and described below. In the drawings.

DETAILED DESCRIPTION OF THE INVENTION

Figure 1:
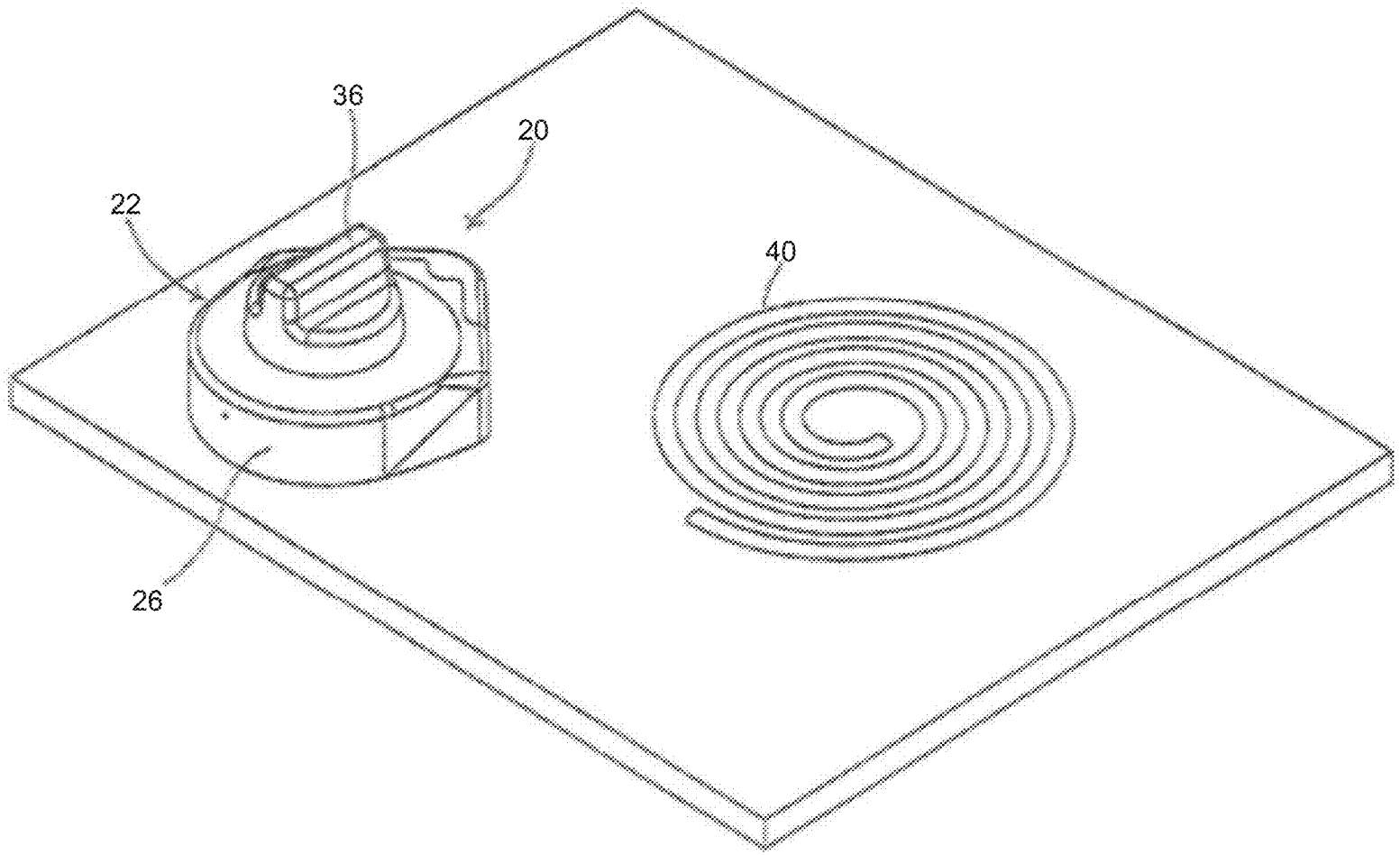
FIG. 1 is a schematic perspective view of one embodiment of an automatic safety device for operational control of a burner of an electric stove.
Figure 2A:
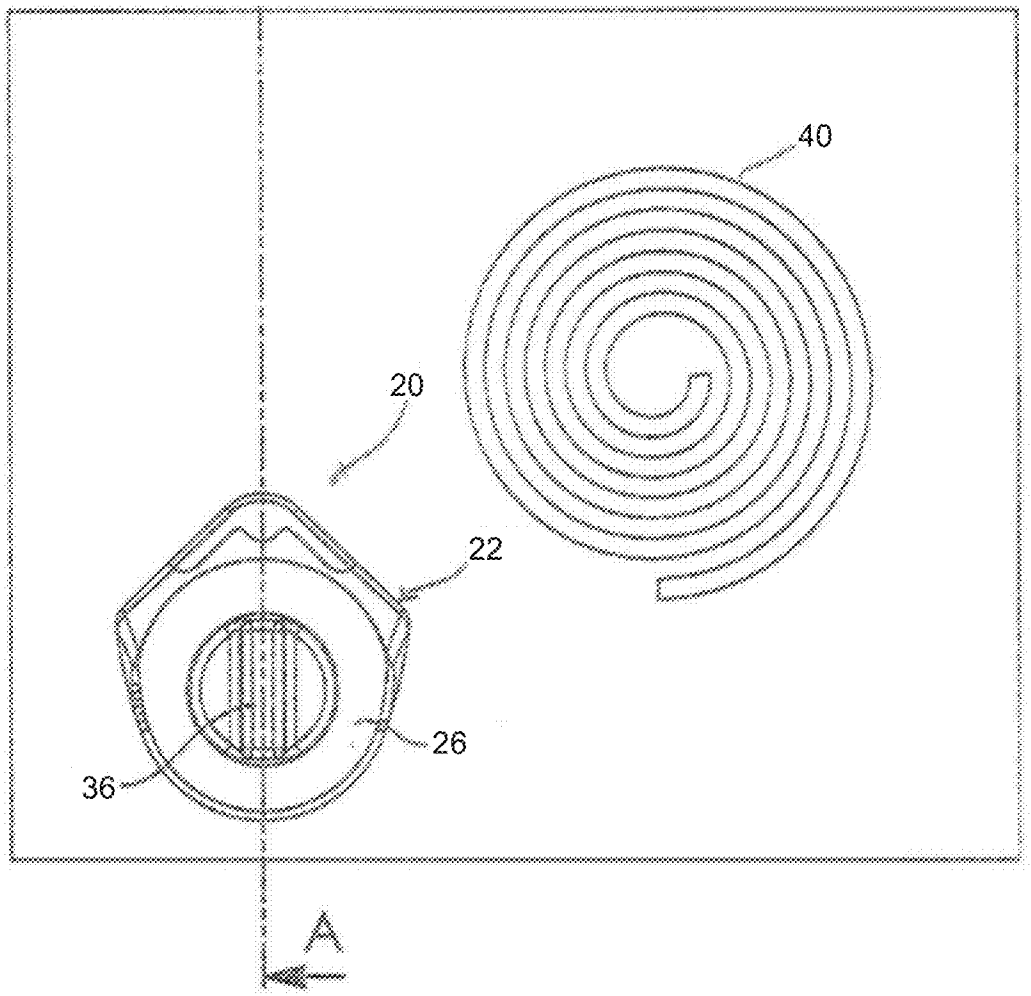
FIG. 2A is a top plan view of the safety device and burner as shown in FIG. 1.
Figure 3A:
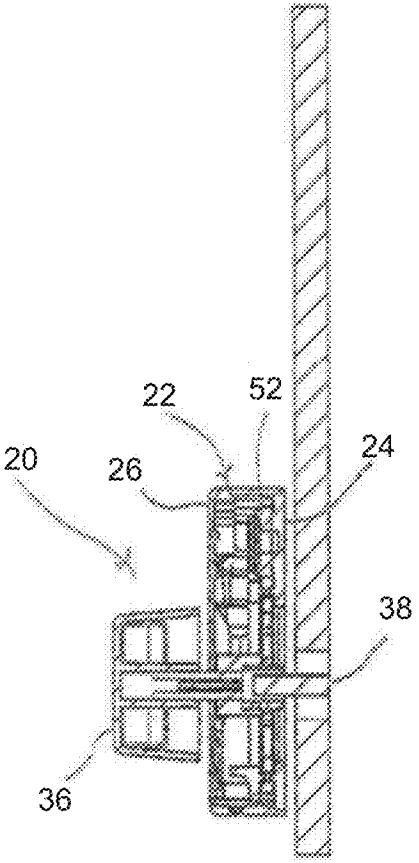
FIG. 3A is a longitudinal cross-section view of the safety device taken along line A-A of FIG. 2A.
Figure 2B:
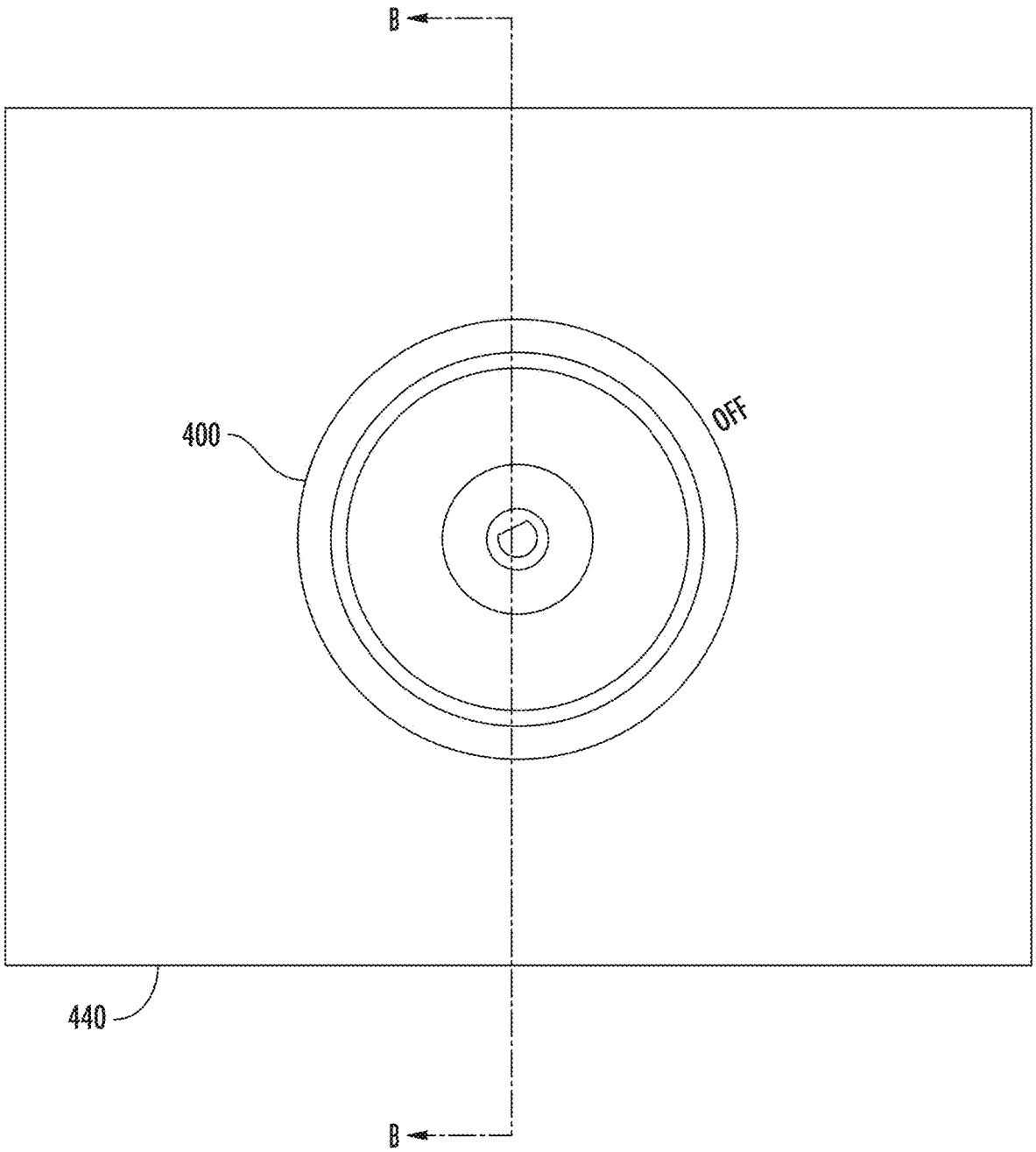
FIG. 2B is a top plan view of another embodiment of a safety device.
Figure 3B:
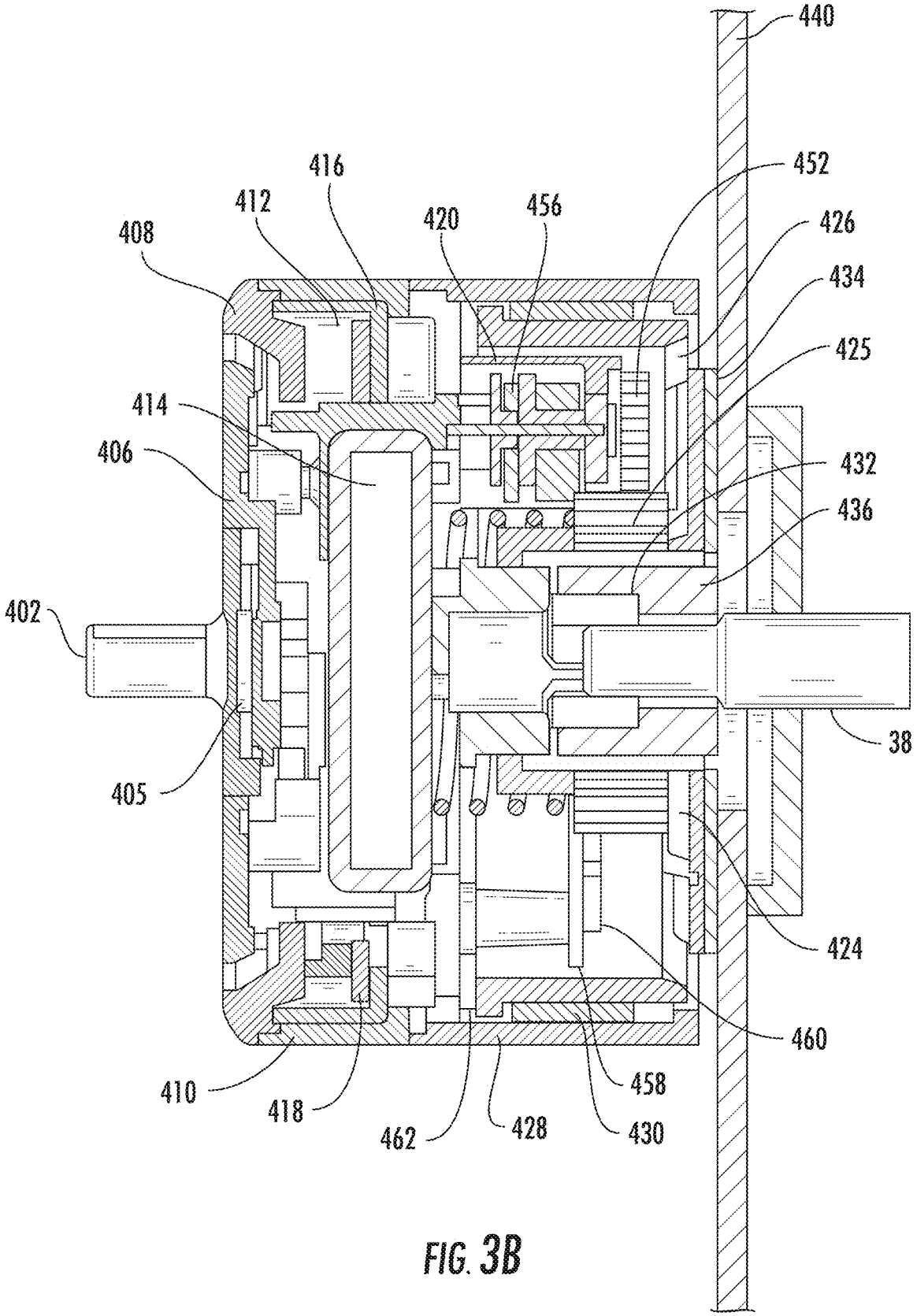
FIG. 3B is a longitudinal cross-section view of the safety device taken along line B-B of FIG. 2B.

In the following description, certain terminology is used to describe certain features of one or more embodiments of the invention. The term "appliance" refers to any type of electrical and/or mechanical device having a control knob unit which accomplishes some household function, such as cooking, cleaning and entertaining. An appliance includes, but not limited to, a stove, oven, fryer, barbeque, clothes dryer, washing machine, air conditioner, television and radio.

The term "event" or "safety event" refers to any type of emergency or developing emergency including, but not limited to, the detection of a hazard such as detection of smoke, fire, heat, carbon monoxide and gas.

The terms "energy source" and "energy" refer to any source of powering an appliance or other device including, but not limited to gas and electricity.

The terms "control knob", "control knob unit" and "knob" refer to any type of rotating dial or device for adjusting control settings on an appliance or other device.

The term "operational shaft" refers to a mechanism which is used to control the amount of power, such as gas or electricity, supplied to an appliance or other device, such as a burner of a stove.

The term "control settings" may refer to the flow of electricity or gas to an appliance, a timer, etc.

The terms "detector" and "sensor" refer to a device for detecting the presence of hazardous environmental conditions, including, but not limited to, smoke, gas, carbon monoxide gas, flammable gases (e.g. natural gas and propane), fire, flames, and heat, as well as non-environmental hazardous conditions, such as motion.

The use of the term "processor," "controller," or "processing circuitry" may be understood to include a single core processor, a multi-core processor, multiple processors internal to any of the modules/devices described herein, and/or remote or "cloud" processors. A controller should be understood to include a controller or microcontroller and contains one or more processors along with memory and programmable input/output components. The controllers described herein should be understood to utilize the processors and memory of the controllers to execute the software functions described herein.

Although the components of the devices and modules are described in part using functional terminology, it should be understood that implementation of the corresponding functions requires the use of particular hardware. It should also be understood that certain of these components may include similar or common hardware. For example, two sets of circuitry on a device/module may both leverage use of the same processor, network interface, storage medium, or the like to perform their associated functions, such that individual/duplicative hardware is not required for each set of circuitry. Furthermore, the use of the term "circuitry" as used herein with respect to components of the devices/modules therefore includes particular hardware configured to perform the functions associated with the particular circuitry described herein.

The term "circuitry" may also include software that configures operation of the hardware of the modules/devices. In some embodiments, circuitry may include processing circuitry, storage media, network interfaces, input/output devices, and the like.

As described above and as will be appreciated based on this disclosure, example devices employed by various example embodiments described herein may be configured as methods, mobile devices, backend network devices, and the like. Accordingly, embodiments may comprise various means including entirely of hardware or combinations of software and hardware. Furthermore, embodiments may take the form of a computer program product stored on at least one non-transitory computer-readable storage medium having computer-readable program instructions (e.g., computer software) embodied in the storage medium. Any suitable computer-readable storage medium may be utilized including non-transitory hard disks, CD-ROMs, flash memory, optical storage devices, or magnetic storage devices.

It is understood that, although a safety device will be described in detail herein with reference to exemplary embodiments of a stove top knob, a safety device may be applied to, and find utility in, other appliances and power tools. Operational control knobs attached to operational shafts are used in a wide variety of applications involving appliances and power tools such as, for example, washing machines, dryers, and the like. Further, although the safety device will be described in detail herein as embodied in a stove knob safety device where rotating motion of the knob is automatic, it is not intended to be so limited. The safety device may be used in rotary power tools, such as power drills, screw drivers, and the like, and in other appliances such as, for example, mixers and blenders. The safety device may be used in the operation of gas or electric grills, toaster ovens, gas and/or electric space heaters, and gas or electric fireplaces. The safety device may also be configured to interrupt the power supply of any electronic device that may be plugged into a wall outlet or any gas device connected to a gas source. Thus, the present safety device has general applicability to any device controlled by a rotating knob wherein improvements in safety are desired.

It is understood that a conventional stove includes an oven and a range top as a single unit. The range top has a plurality of heating elements, or burners, that are used to provide energy, typically heat, to cook food in cookware, such as pots or pans located externally to the stove. The stove may also refer to stand alone units where the oven is separated from the range top, for example, a double oven or a cooktop range. It is understood that the safety device may operate with a separate oven or separate cooktop as well as a stove. For simplicity of this disclosure, the description generally refers to a stove as the cooking unit. It is understood that the safety device will work equally well with stand-alone cooking units.

It is understood that each of the embodiments of the control knob and safety devices described herein may also incorporate one or more aspects or elements of the other embodiments of control knobs and safety devices described herein.

A first embodiment of a stove knob safety device for operational control of a stove top burner is shown in FIGS. 1, 2A, 3A, and 4A-4C and generally designated 20. The stove top may comprise a plurality of burners. Each of the plurality of burners may also be controlled by a safety device 20. Additionally, the safety device 20 may also be configured for operational control of a single burner, not a part of stove top, such as a hot plate or other device. The safety device 20 comprises a housing 22 including a base member 24 and an outer member 26, a bracket 28 disposed in the housing 22 for supporting a gear train, an electric motor 30, and a two-piece adaptor 33 and 34 for a control knob 36 engaged with an operational shaft 38 of the burner 40 via the adaptor. The housing 22 further accommodates a switch, a power source and a controller. The controller is programmed to actuate the motor 30 to rotate the control knob 36 to the Off position upon occurrence of an event. As described below, the safety device 20 is configured to selectively automatically shut off the flow of power, such as electricity or gas, to the burner 40 under certain predetermined safety conditions. The safety device 20 may also be regulated by a motion sensor that monitors the presence of a user near the stove to determine whether or not to activate the powered shut-off mechanism. As described herein, the system may track the time duration of absences of a user via the motion sensor. If no movement is detected within a predetermined period, the safety device 20 may be automatically activated to turn the control knob 36 to the Off position. This arrangement allows full control and operation of the burner 40 if the user is present.

The housing 22 of the stove knob safety device 20 includes the base member 24 and the outer member 26 coupled to the base member. The base member 24 (FIG. 5) defines a circular opening 42. A bottom surface (not shown) of the base member 24 may include an adhesive layer such that the base member 24 may be affixedly mounted to the surface of the stove surrounding the operational shaft 38 of the burner 40. In this arrangement, the operational shaft 38 extends outwardly from the stove surface and beyond the plane of the base member 24. The outer member 26 of the housing 22 also defines circular opening 44 which is smaller than the opening 42 in the base member 24. The outer member 26 is configured to be coupled to the base member 24 in a friction-fit relationship. When coupled, the opening 44 in the outer member 26 is coaxial with the opening 42 in the base member 24 for receiving the operational shaft 38 of the burner 40. This opening through the housing 22 allows the operational shaft 38 to rotate freely.

Figure 6:
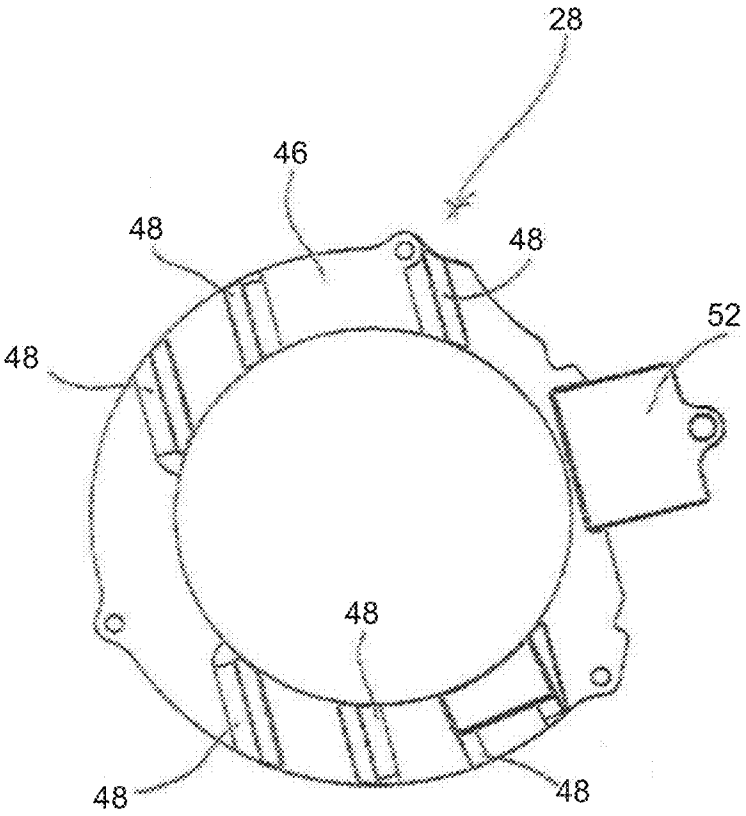
FIG. 6 is a top plan view of a bracket of a housing for use with the safety device shown in FIG. 1.
Figure 7:
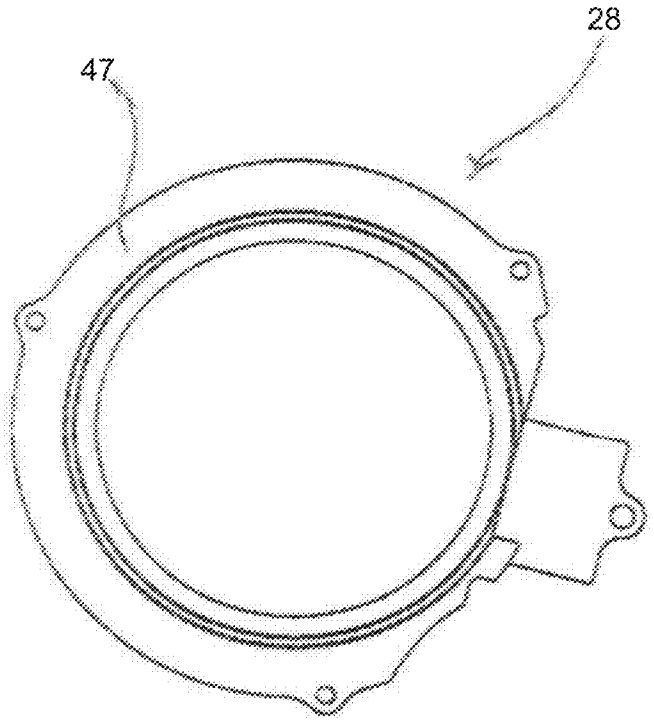
FIG. 7 is a bottom plan view of the bracket as shown in FIG. 6.

The bracket 28 is disposed in the housing 22 between the base member 24 and the outer member 26. An outer surface 46 (FIG. 6) of the bracket 28 includes three pairs of opposed outwardly projecting ears 48. The bracket 28 also includes an integral mount 50 for the motor 30.

The gear train comprises a small gear 52 interengaging a larger concentricity gear 54. Both gears 52, 54 are rotatably disposed on the outer surface 56 (FIG. 5) of the base member 24 in substantially the same plane. The concentricity gear 54 has flexible spokes 55 for maintaining axial alignment of the components of the safety device 20 and the operational shaft 38. It is understood that the gear train or transmission in this embodiment comprises a generally conventional gear train and that other gear trains or transmissions may be used.

Figure 10B:
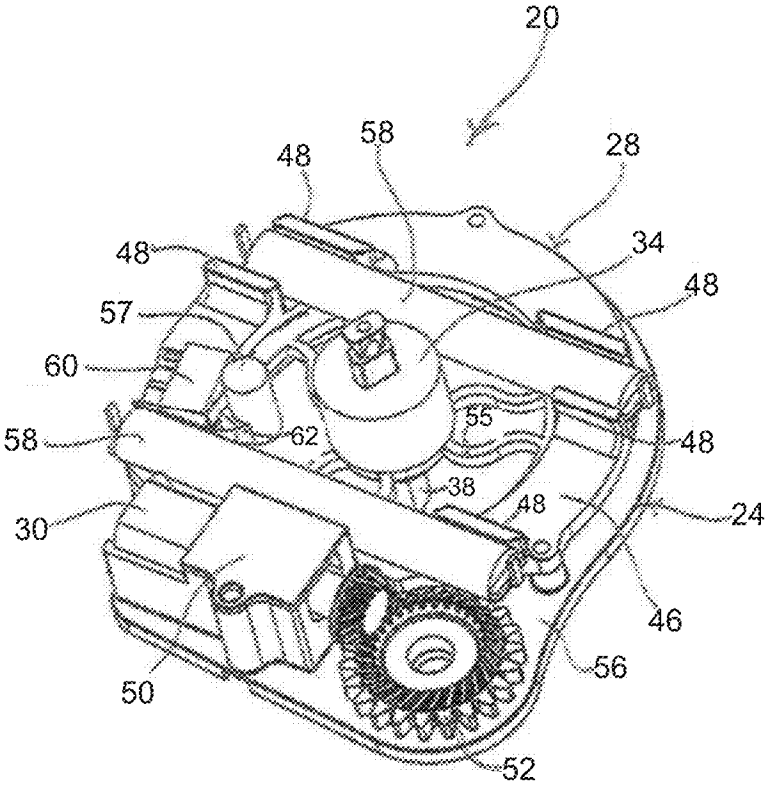
FIGS. 10A and 10B are views of the gear train and motor and adaptor as shown in FIGS. 9A-9C and FIGS. 9D-9G including the bracket as shown in FIG. 6 and batteries mounted to the bracket.
Figure 10A:
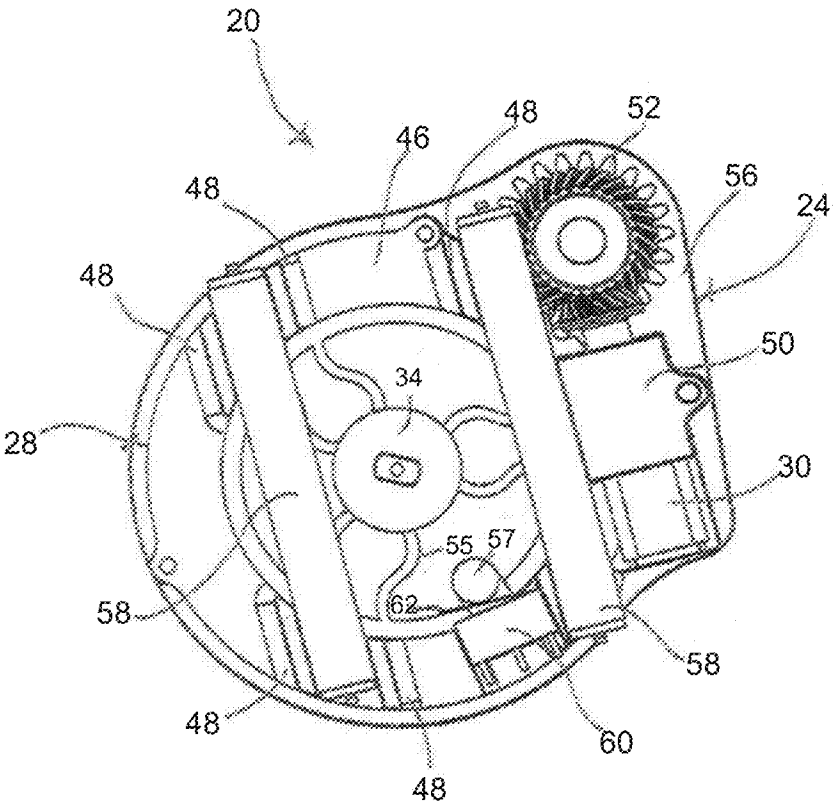

The electric motor 30 is secured in the mount 50 on the bracket 28. The drive shaft of the motor 30 is connected to the small gear 52 for rotating the gear train. In this arrangement, operation of the motor 30 rotates the gear train which in turn rotates the control knob 36 and the connected operational shaft 38 for the burner 40. In one embodiment, the electric motor is a DC motor powered by one or more batteries located within the housing 22. As shown in FIGS. 10A and 10B, the batteries 58 may be mounted to the bracket 28 between pairs of outwardly extending ears 48, for a first battery of the one or more batteries, and between a pair of ears 48 and the motor mount 50 for another battery of the one or more batteries. It is understood that the safety device 20 could be powered by ordinary house voltage or other power instead of batteries.

A second embodiment of a safety device for operational control of a stove top burner is shown in FIGS. 2B, 3B, and 4D-4F and generally designated 400. As shown, safety device 400 may comprise a complete knob for operating an operational shaft of a burner such that safety device 400 may be embodied as an after-market device which is configured to replace an original knob of a stove or may be integrated into a stove top as original knob equipment during manufacture of the stove. Safety device 400 may be turned manually by a user to turn an operational shaft of a burner to an On position such that power is supplied to the burner. As shown, the plurality of members of safety device 400 including the outer or housing members, may form a knob.

In addition to the features described herein, safety device 400 may include any or all of the features of safety device 20 or safety device 100 described herein. In some examples, safety device 400 may function as a replacement knob or a knob for controlling the operational shaft of a burner. Safety device 400 is connected to an operational shaft 38 of a burner and comprises a housing including a housing member 410, fixed base member 424, and outer members 406, 428, a motor member 420 (FIG. 4E) including a gear train 452, an electric motor 454 mounted to a bracket 456, and a controller 462 configured for operational control of a burner. In some examples, the controller 462, may comprise a combined microcontroller and Bluetooth communication module. The gear train 452 is configured to engage gear grooves 425 on the fixed base member 424, such that when the electric motor 454 is activated by the controller 462, the motor body and the safety device 400 rotate about the fixed base member 424, thus also rotating the operational shaft 38. In some examples, a last gear in the gear train (e.g. the gear connected to the fixed base member 424) may comprise a gear with one or a plurality of gear teeth removed which creates a rotation zone. In some examples, the rotation zone (removed teeth from the last gear) allows a user to turn safety device 400 without engaging the motor. As a result, when the user turns safety device 400 during normal use, the motor is disengaged and the device moves freely. When the motor is activated by one or more methods described herein, it rotates the gear train through the rotation zone and the engages with fixed base member 424. In another example, the electric motor 454 may comprise a straight drive motor (e.g. a gimbal motor) without a gear train.

The safety device 400 also includes a two-piece adaptor including chuck adapter 436 and device coupler 432 to connect the safety device (and motor member 420) with an operational shaft 38 of a burner, such as burner 40, via the two-piece adaptor. The chuck adapter 436 and device coupler 432 may be configured such that the safety device is removably attached to the operational shaft 38. In some examples, device coupler 432 is configured to attach motor member 420 to the operational shaft 38 by fitting into the chuck adapter 436.

In one example embodiment, the safety device 400 comprises at least the fixed based member 424, the motor member 420 attached to the operational shaft 38, gear train 452 disposed on the motor member 420, and electric motor 454, such that the motor 454 disposed on the motor member and connected to the gear train 454, and wherein the motor is controlled by a controller 462.

In some embodiments, the chuck adapter 436 may comprise a chuck adapter as shown in FIGS. 9D-9G. The chuck adapter may include an adapter portion 902 including gripping jaws 908 and gasket 904. The chuck may have one or more gripping jaws 908 that are arranged in a radially symmetrical pattern. The one or more gripping jaws 908 can be used to tighten the chuck adapter to an operational shaft. Tightening member 906 is configured so as to tighten the gripping jaws 908 around an operational shaft as tightening member 906 is turned. Such as chuck adapter allows for the safety device 400 to be removably attached to the operational shaft 38 of a burner without modifying the operational shaft 38. For example, if the safety device 400 needs to be removed for repair or replacement, the device 400 may simply be pulled off the stove top (including the removal of the connecting pad 434) and the chuck adapter 436 loosened and removed from the operational shaft 38 of a burner. This also provides a universal adapter for standard stove tops with control knobs that were not originally manufactured to include a safety device. In some alternate examples, a stove top may be manufactured such that the operational shaft of the stove top is configured to be attached to a safety device, possibly with a device coupler 432 and/or chuck adapter 436 to a connect to a motor member 420.

Referring back to FIGS. 3B, 4D, 4E, and 4F, the safety device 400 also includes a knob adapter 402 configured to attach a top knob to the top of device 400. The knob adapter 402 may be configured to mimic an attachment part an operational shaft of the burner so that an original or standard knob for operational control of the burner may be attached to the top of the safety device 400 and serve as a top knob. In some examples, the knob adapter 402 is configured to prevent rotation of the top knob. For example, the knob adapter may comprise teeth configured to interlock with corresponding teeth in the top knob to prevent rotation of the attached top knob. The knob adapter may also comprise a first magnet which is configured to magnetically attach to a second magnet on the bottom of a standard or original knob for operational control of the burner. In some examples, only one of the first magnet or second magnet may comprise a magnet with magnetic poles. For example, the first magnet may be a magnet and the second magnet may comprise a steel plate. For example, a user may remove an original knob from an operational shaft of a burner, install safety device 400, and attached the original knob as a top knob on top of the safety device 400.

Alternatively, the safety device 400 may include a lid cap 404 in lieu of the knob adapter 402. In some examples, outer member 406 serves as a top piece or a lid for safety device 400, the lid providing access to a battery 414.

The safety device 400 also includes a top light window 408 which may be positioned such that it is attached to the housing member 410 and allows lights from LEDs 416 situated on light board 418 to emit light through the top light window 408 (the top portion of the safety device 400). The safety device 400 also includes a bottom light window 426 which may be positioned such that it is attached to motor member 420 and allows lights from LEDs 460 situated on light board 458 to emit light through the bottom light window 426 (the bottom portion of the safety device 400). In some examples, LEDs 416 and 460 may comprise RGB light emitting diodes.

The safety device 400 also includes touch sensor 412. In some examples, the touch sensor 412 may be a capacitive touch sensor configured to receive input by detecting capacitance, such as from a human finger. The safety device 400 also includes a bearing 430 disposed between the fixed base member 424 and the outer member 428. In some examples the bearing 430 comprises a DryLin bearing. The outer member 428 may be composed of Acrylonitrile butadiene styrene (ABS). The safety device 400 also includes a connecting pad 434 to attach the fixed base member 424 to the stove top 440. In some examples, the connecting pad 434 may be a tape pad such that the fixed base member 424 is not permanently fixed to the stove top 440. In another example, connecting pad 434 may comprise a magnet which may attach fixed base member 424 to a metallic surface, such as a metallic stove top.

In some example embodiments, the LEDs 416 are configured to emit light corresponding to a position of the device, wherein the position of the device corresponds to a position of the operational shaft of the burner. In some examples, the LEDs 416 are configured to emit light in four quadrants, wherein a first quadrant emits light corresponding to a selection of a first user selection; wherein a second quadrant emits light corresponding to a selection of a second user selection, a third quadrant emits light corresponding to a selection of a third user selection, and wherein a fourth quadrant emits light corresponding to a selection of a fourth user selection. The user selection may be made by the user at the touch sensor (button) 412 or the user device 1306. In some examples, the first user selection, the second user selection, the third user selection, and the fourth user selection comprise a user selection of an expiration time for a timer.

In some further example embodiments, LEDs 460 may be configured to emit light corresponding to an operational status of the device, wherein the operational status comprises one of: a device off status, a device on status, a burner on status, a timer expiration status, a device error, and a hazard detected status.

The device 400 also includes touch sensor 412. In some examples, the touch sensor 412 may be a capacitive touch sensor configured to receive input by detecting capacitance, such as from a human finger. The device 400 also includes a bearing 430 disposed between the fixed base member 424 and the outer member 428. In some examples the bearing 430 comprises a DryLin bearing. The outer member 428 may also be composed of Acrylonitrile butadiene styrene (ABS) material. The device 400 also includes a connecting pad 434 to attach the fixed base member 424 to the stove top 440. In some examples, the connecting pad 434 may be a tape pad such that the fixed is member is not permanently fixed to the stove top 440. In another example, connecting pad 434 may comprise a magnet which may attach fixed base member 424 to a metallic surface such as a metallic stove top.

The safety device 400 also includes a spring 422 configured to provide support to the motor member 420 and other components of the device 400. The safety device 400 also includes the battery 414 configured to provide power to the electric motor 454 and LEDS 416 and 460. In some examples, the battery 414 may comprise a rechargeable battery. In some examples, battery 414 may be connected to a recharging mechanism. In some examples, outer pieces 406 and 428 may comprise one or more solar panels configured to serve as a recharging mechanism to battery 414. In some examples, the solar panel may receive ambient or room level light and recharge battery 414. This allows for battery 414 and safety device 400 to function for prolonged periods of time without requiring manual recharging. In another example, the recharging mechanism may comprise a wireless recharging mechanism, such as inductive charging (e.g. the Qi standard). In some examples, the safety device 400 may also comprise a shaker motor to provide haptic or tactile feedback for example when the capacitive touch button is engaged. For example, if a user touches touch sensor 412 the shaker motor may provide tactile feedback by shaking enough to indicate to a user that the safety device 400 has registered the touch. For example, the touch sensor 412 may receive a touch from a user and send a signal to controller 462 that receives the signal from the touch sensor 412 and sends a control signal to the shaker motor to provide the tactile feedback. In a similar manner the safety device 400 may also comprise a speaker for providing auditory feedback, such as in the same way as, and/or at the same time the device provides tactile feedback. For example, the speaker may emit a sound while the shaker motor shakes.

In some examples, the touch sensor 412 may comprise multiple segments or a dividing mesh such that the touch sensor 412 comprises multiple touch areas that may function as multiple buttons. For example, the touch sensor 412 may be divided into four areas such that the user may interact with four buttons. The buttons of the touch sensor 412 may be utilized for differentiated input, such as an input for a timer including resetting/restarting the timer or selecting a timer period or expiration time for the timer. For example, a user may select from a selection of five minute increments such as five, ten, fifteen, or twenty minute increment for the expiration time. The buttons of the touch sensor 412 may also be utilized in entering or leaving a child lock mode of the device. For example, a user may enter in a series of touches on the buttons to enter into (engage) a child lock mode and may also enter the same or a different series of touches to leave (disengage) a child lock mode.

The controller 462 may be also programmable to actuate the electric motor 454 to rotate the safety device 400 and, thus, the operational shaft 38 to the Off position upon the receipt of a signal such as a hazard detected signal indicating the occurrence of a safety event. In some examples, the Off position is determined as the position where the operational shaft may not be turned further in a clockwise or counterclockwise position. This may be indicated as when the motor 464 stalls or cannot turn the operational shaft any further such as indicated by a voltage spike from the motor and measure by controller 462.

In some example embodiments, safety device 400 may also include a gyroscope and accelerometer which are used in combination with controller 462 to provide a position sensing function which indicates the position of the safety device 400. In some examples, the Off position may be recorded or set during an initial set-up or calibration of the device (such as the process using user device 1306 described herein). In some examples, safety device 400 also comprises a switch 474 (FIG. 4H) configured to detect when the device has pushed down, such as when a user pushes down on the device to turn the operational shaft to an On position (e.g. turning on a burner). In some examples, the switch will transmit a signal to the controller 462 which wakes the safety device 400 from a standby mode, in some examples this includes activating the position sensing function. In some examples, the position sensing function may also include utilizing a Hall Effect sensor.

Furthermore, in the same manner as the safety device 20, the safety device 400 may also be configured to selectively automatically shut off the flow of electricity or gas to a burner, such as burner 40, under certain predetermined safety conditions. The safety device 400 may also be regulated by a motion sensor, which may be positioned on the device or remote from the device, such as in a sensor/relay device which monitors the presence of a user near the stove to determine whether or not to activate the powered shut-off mechanism. The system may track the time duration of absences of a user via the motion sensor. If no movement is detected within a predetermined period, the safety device 400 may be automatically activated to turn the operational shaft 38 to the Off position. In the event that the motion sensor of the safety device 400 fails or communication with a sensor/relay device also fails, the timer may be reset by a user input, such as a user touching the touch sensor 412 and/or overriding automatic shut-off due to absence of a user. This provides a failsafe mode for the safety device 400 in an instance where the safety device 400 has lost communication abilities with a sensor/relay device, such as a remote motion sensor. This arrangement also allows full control of the operational shaft 38 of a burner, such as the burner 40. For example, the safety device 400 may be configured to move the operational shaft 38 of the burner 40 to multiple On positions.

Figure 4A:
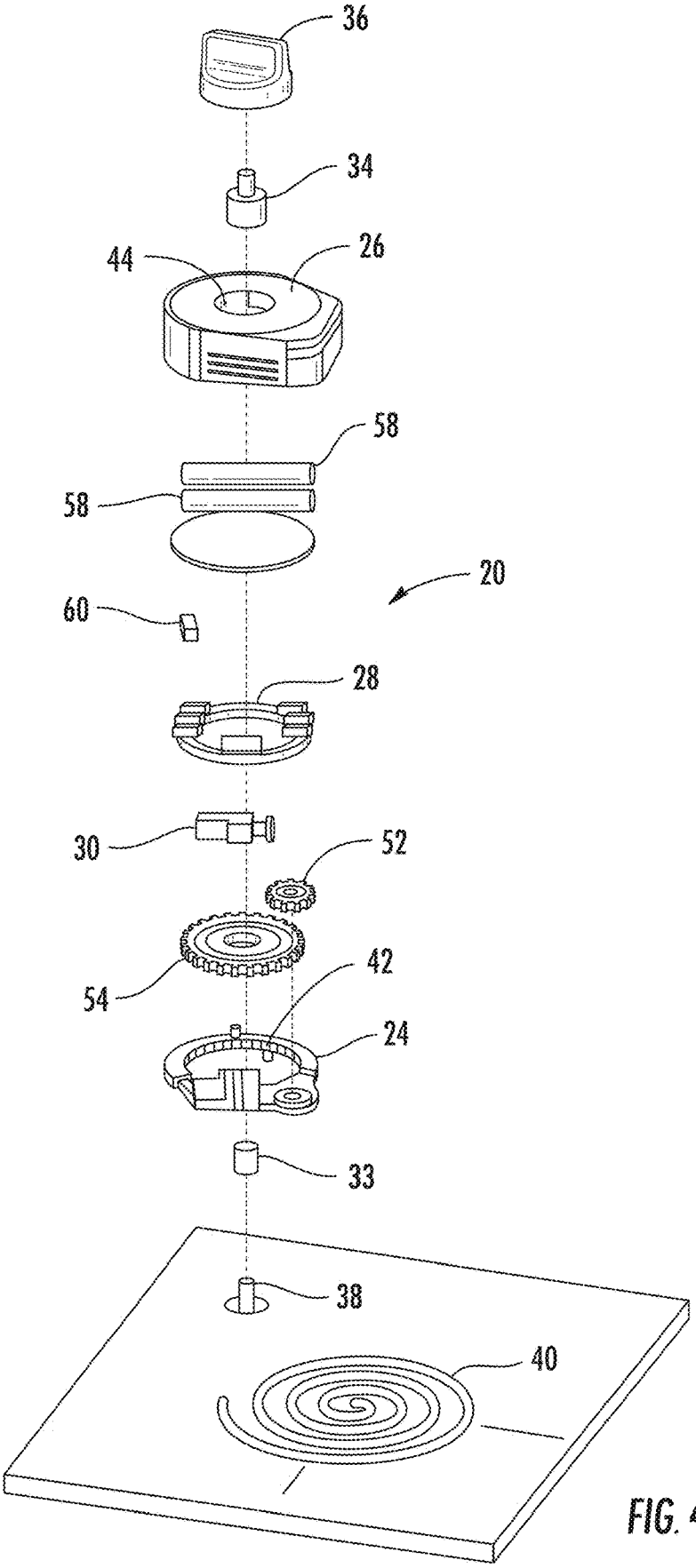
FIGS. 4A-4C are exploded top perspective views of the safety device and burner as shown in FIG. 1.
Figure 4B:
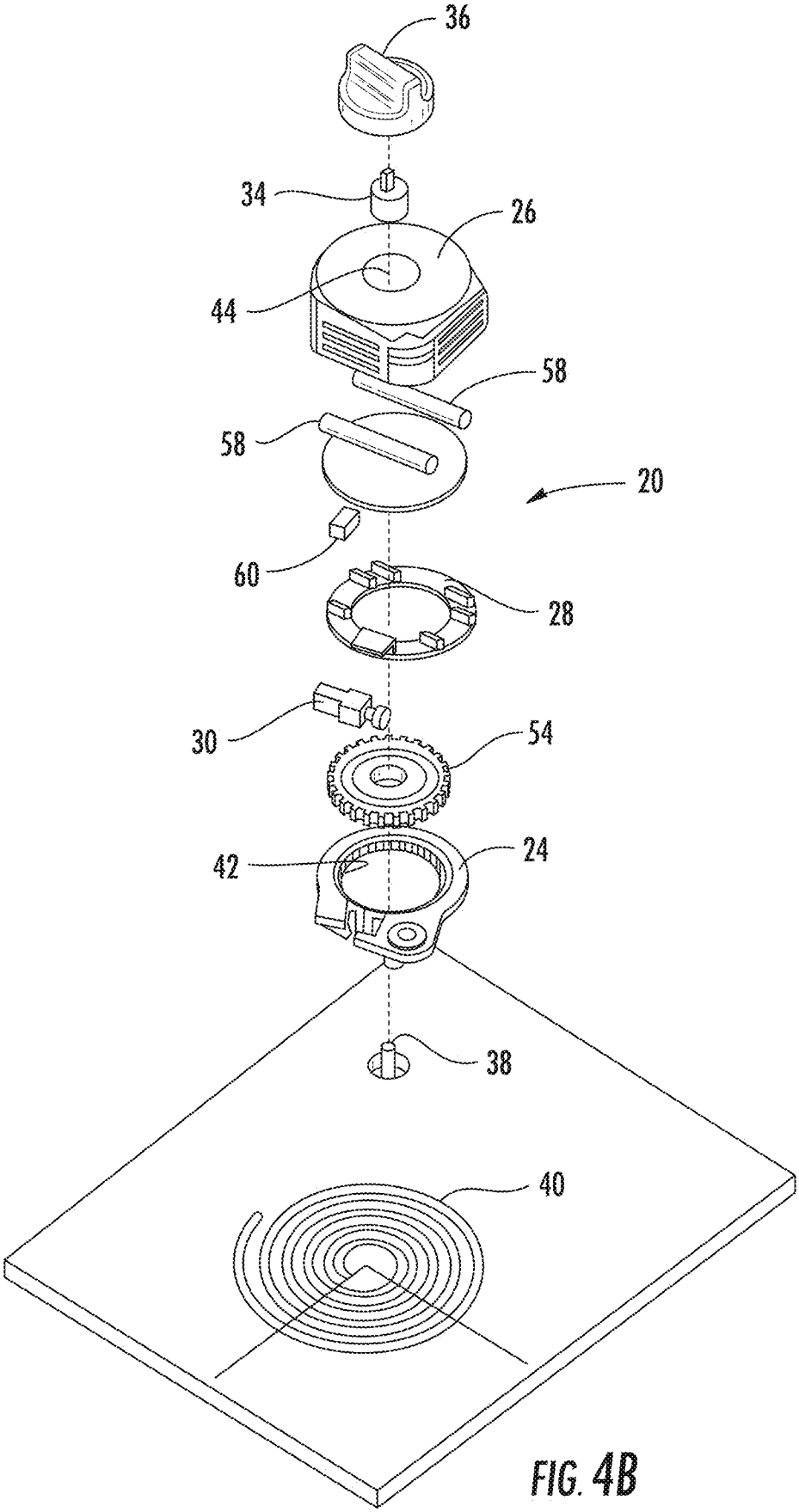
Figure 4C:
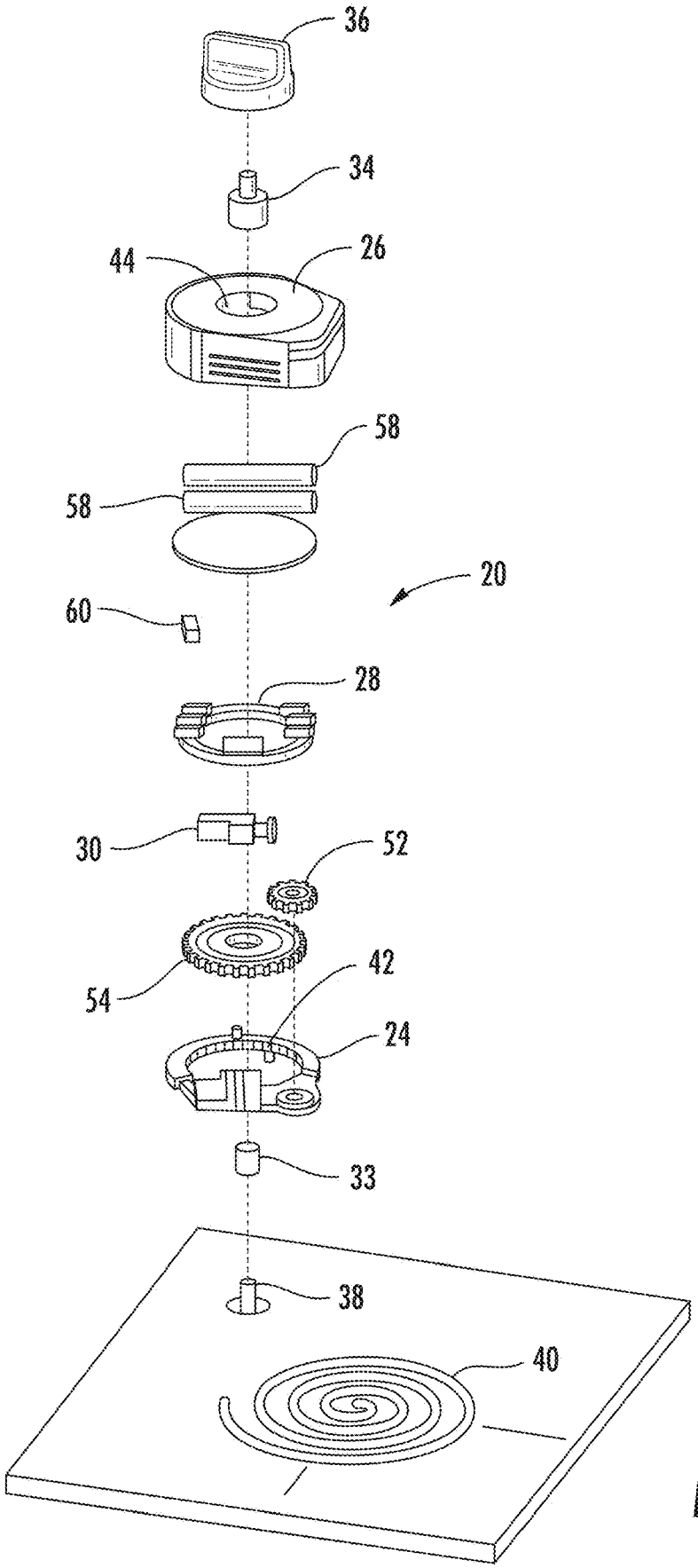
Figure 4D:
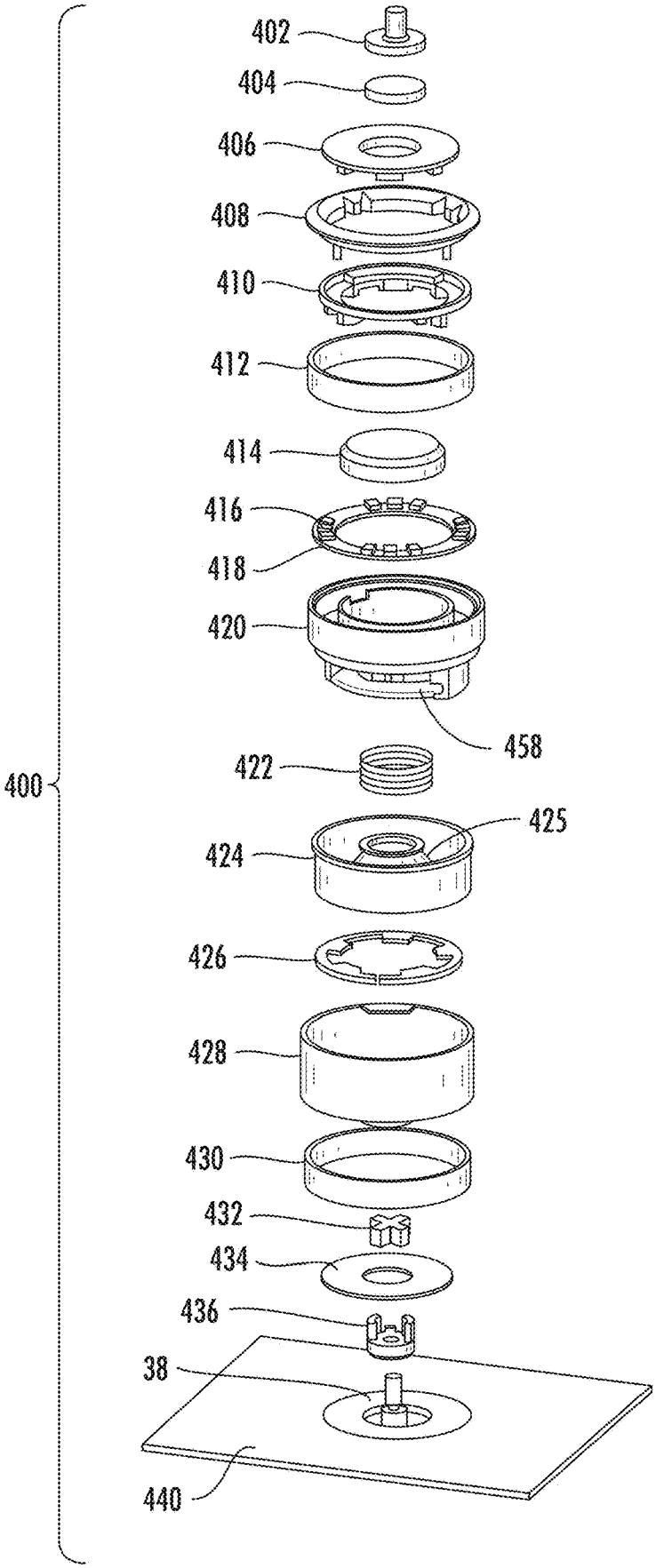
FIG. 4D is an exploded side perspective view of elements of the safety device as shown in FIG. 2B.
Figure 4E:
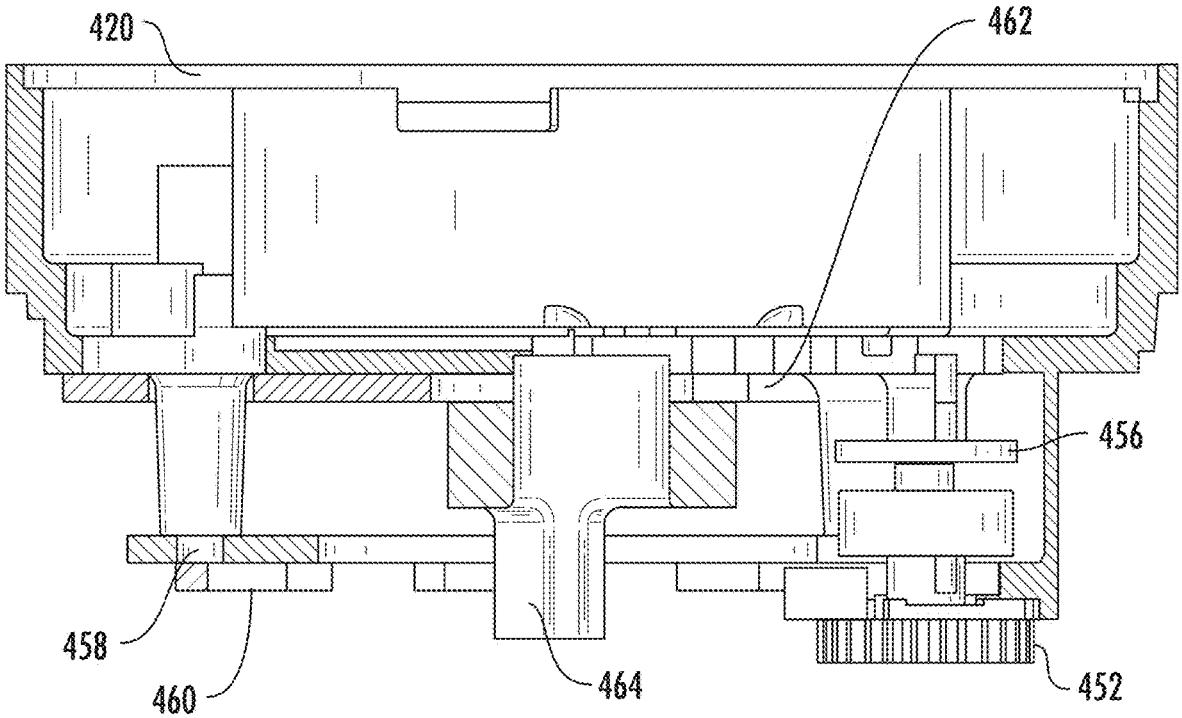
FIG. 4E is a perspective view of one element of the safety device as shown in FIG. 4D.
Figure 4F:
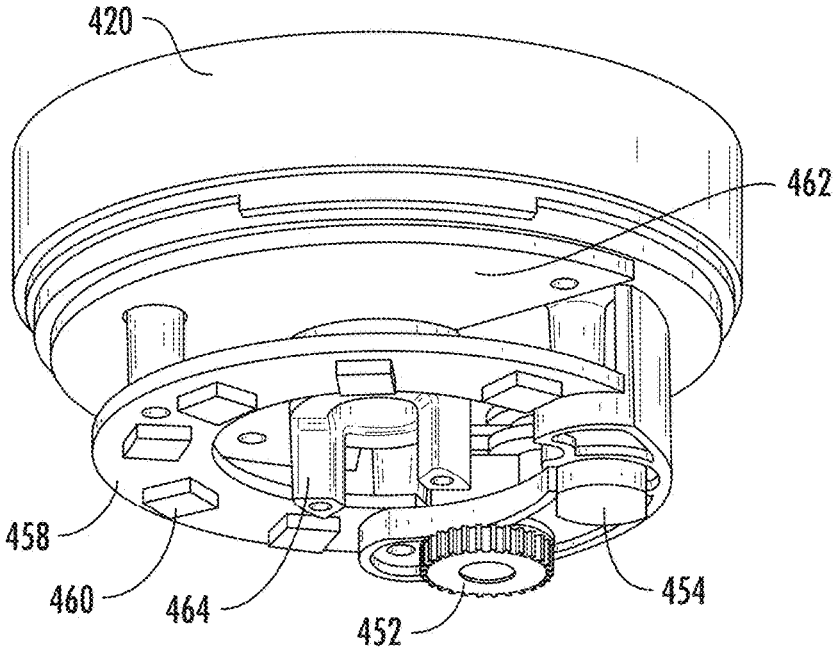
FIG. 4F is a perspective view of the element of the safety device as shown in FIG. 4E.
Figure 4G:
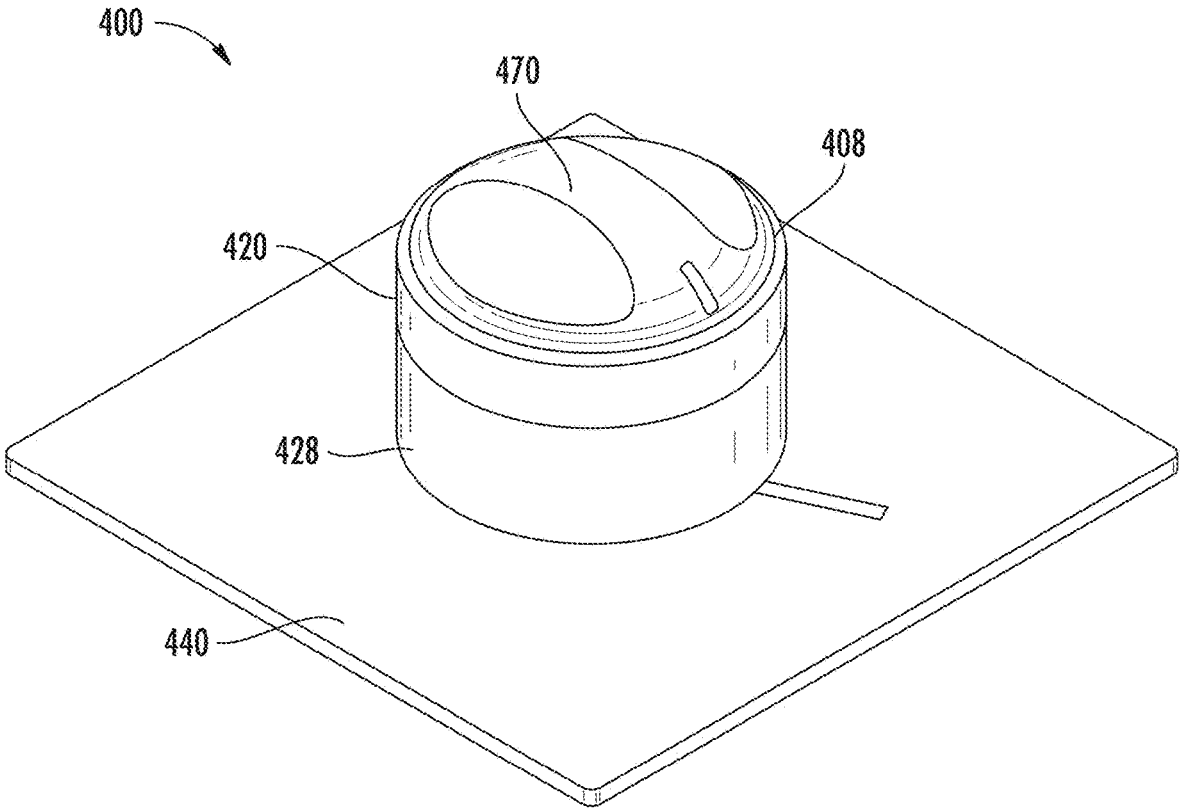
FIG. 4G is an additional embodiment of the safety device as shown in FIG. 2B.
Figure 4H:
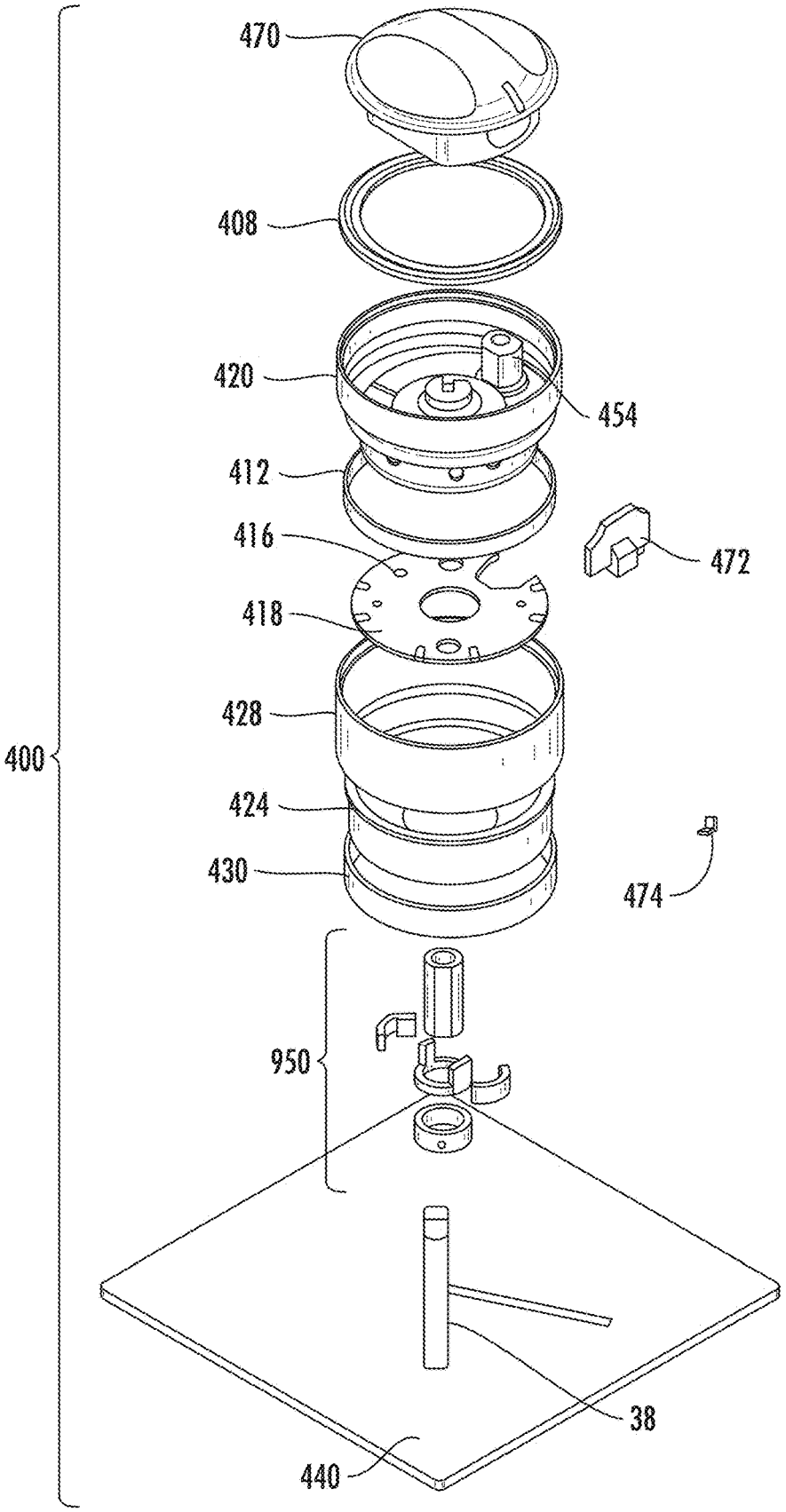
FIG. 4H is an exploded side perspective view of elements of the additional embodiment of the safety device as shown in FIG. 4H.

Turning now to FIGS. 4G and 4H, which show an additional embodiment of safety device 400. As shown, this embodiment includes a knob insert 470. Knob insert 470 may be removed from safety device 400 without removing safety device 400 from the operational shaft 38. In some examples knob insert 470 may comprise battery 414 and a charger connection 472 such that knob insert 470 may be removed from safety device 400 and connected to a power source through charger connection 472 to recharge battery 414. In some examples, knob insert 470 may be connected to a wireless or inductive power source such as a Qi standard power source.

As shown in FIG. 4G, safety device 400 may also be connected to operational shaft 38 by adapter 950. The adapter 950 may include an adapter sleeve 952 configured to encase operational shaft 38. Adapter 950 may also comprise top coupler 956 and bottom coupler 958 which may comprise one piece or may be connected to each other by a connecting pad, such as VHB tape (not shown). Set screw 960 is configured to attach bottom coupler 958 to operational shaft 38 and or adapter sleeve 952. Adapter 950 may also comprise device coupler 954 which is configured to attach motor member 420 to the adapter 950. Adapter 950 allows for the safety device 400 to be removably attached to the operational shaft 38 of a burner without modifying the operational shaft 38. For example, if the safety device 400 needs to be removed for repair or replacement, the device 400 may simply be pulled off the stove top (including the removal of the connecting pad 434) and the adapter 950 loosened and removed from the operational shaft 38 of a burner. This also provides a universal adapter for standard stove tops with control knobs that were not originally manufactured to include a safety device. In some alternate examples, a stove top may be manufactured such that the operational shaft of the stove top is configured to be attached to a safety device, possibly with an adapter 950 to a connect to a motor.

Referring back to safety device 20 and to FIGS. 8A-8C, the switch 60 is mounted to the base member 24. In one embodiment, the switch 60 is a limit switch. The limit switch 60 comprises a switch actuating blade 62 mechanically associated with the limit switch 60 in such a way that when the switch actuating blade 62 is pressed against the limit switch 60 the contacts in the switch are open. The concentricity gear 54 carries a post 57 for engaging the blade 62 and pressing the blade against the switch 60.

Figure 8B:
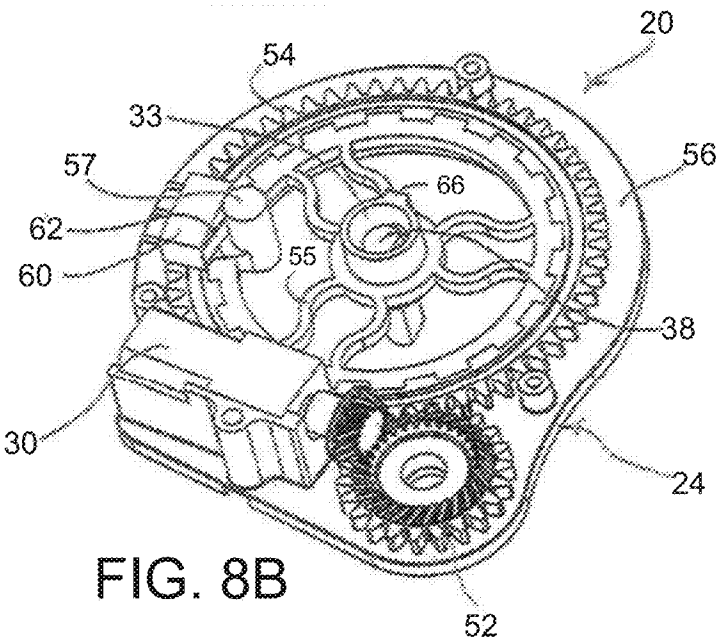
FIGS. 8A-8C are views of a gear train and motor for use with the safety device shown in FIG. 1.
Figure 8A:
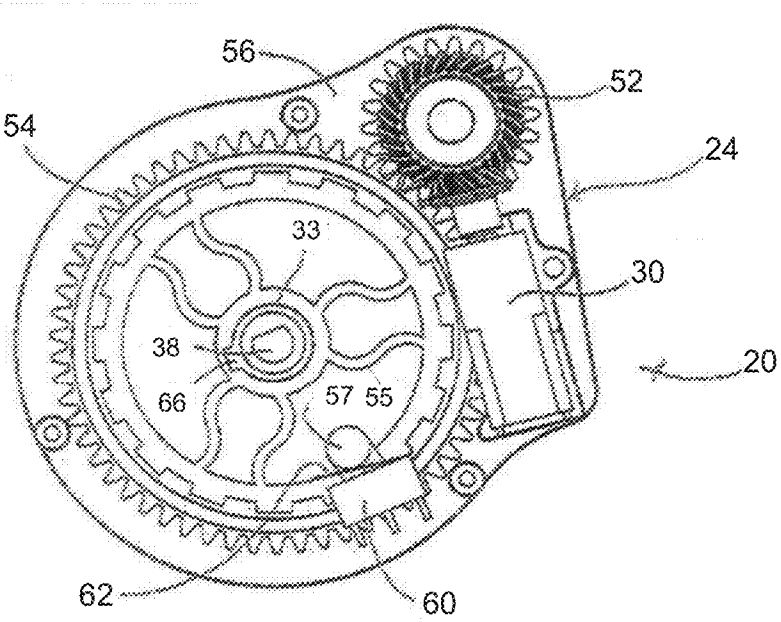
Figure 8C:
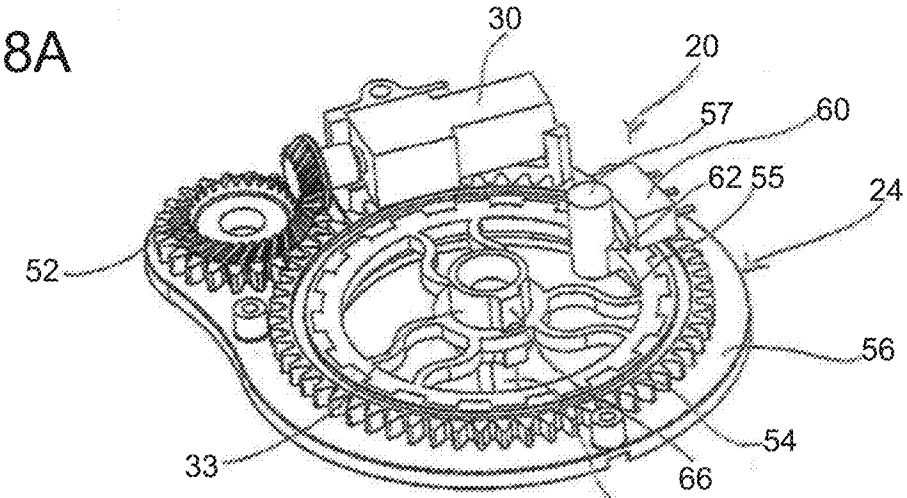
Figure 9B:
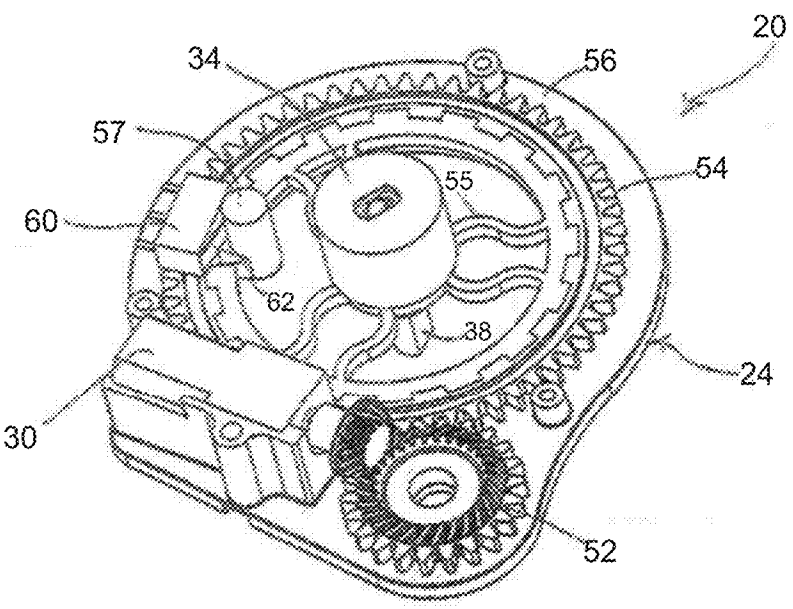
FIGS. 9A-9C are views of the gear train and motor as shown in FIGS. 8A-8C including an adaptor for use with the safety device shown in FIG. 1.
Figure 9A:
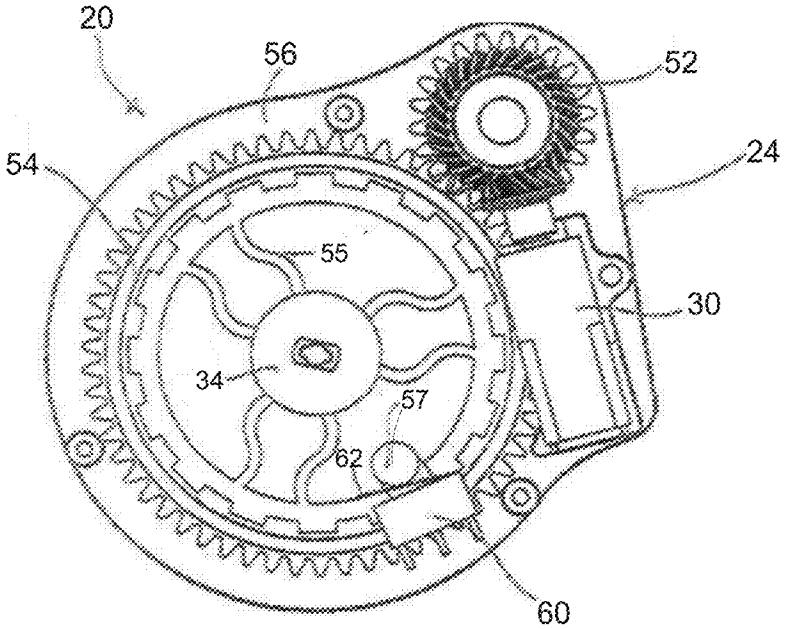
Figure 9C:
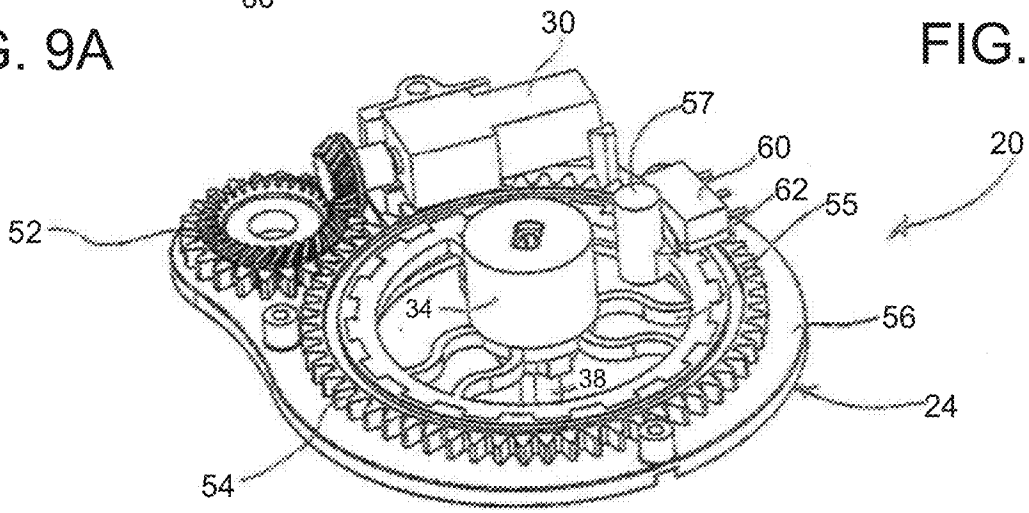
Figure 9D:
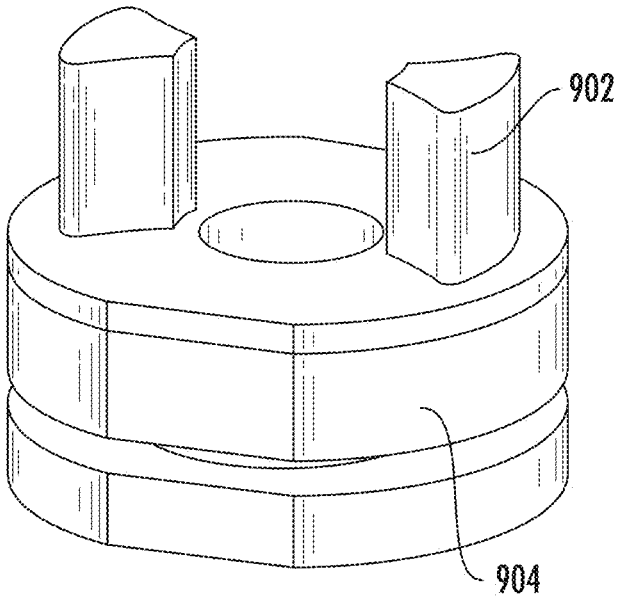
FIGS. 9D-9G are views of one embodiment of a shaft adaptor for use with the safety device shown in FIGS. 9A-9C, FIGS. 3B, and 4D.
Figure 9E:
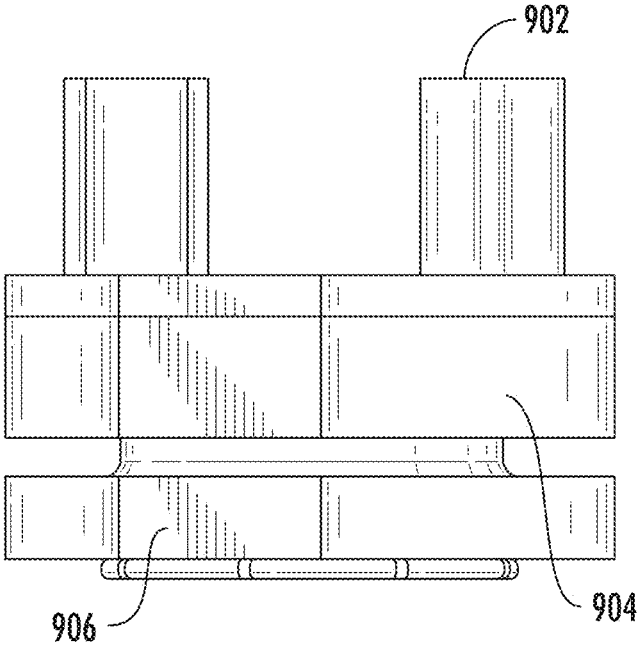
Figure 9F:
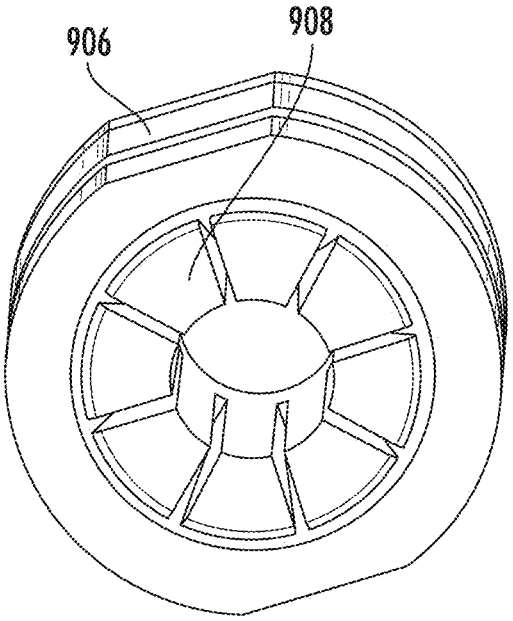
Figure 9G:
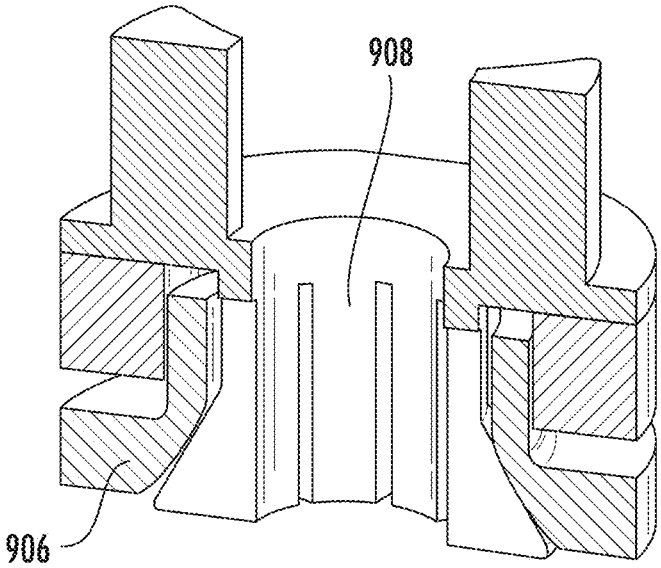
Figure 9H:
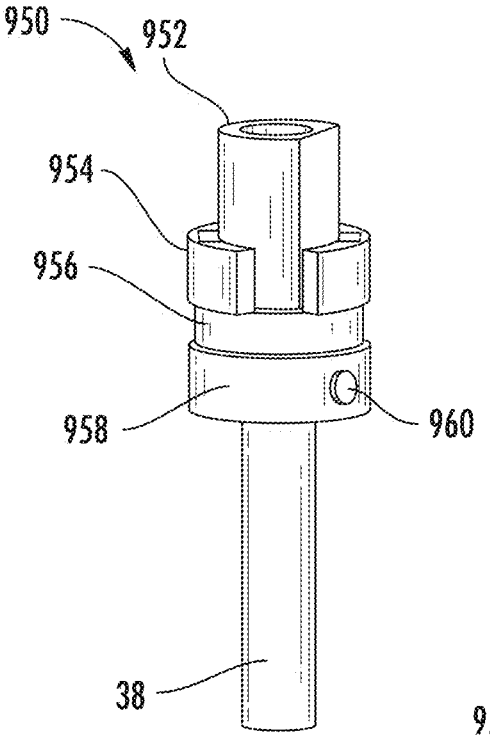
FIGS. 9H-9I are views of one embodiment of a shaft adaptor for use with the safety device shown in FIGS. 9A-9C, FIGS. 3B, 4D, and 4G.
Figure 9I:
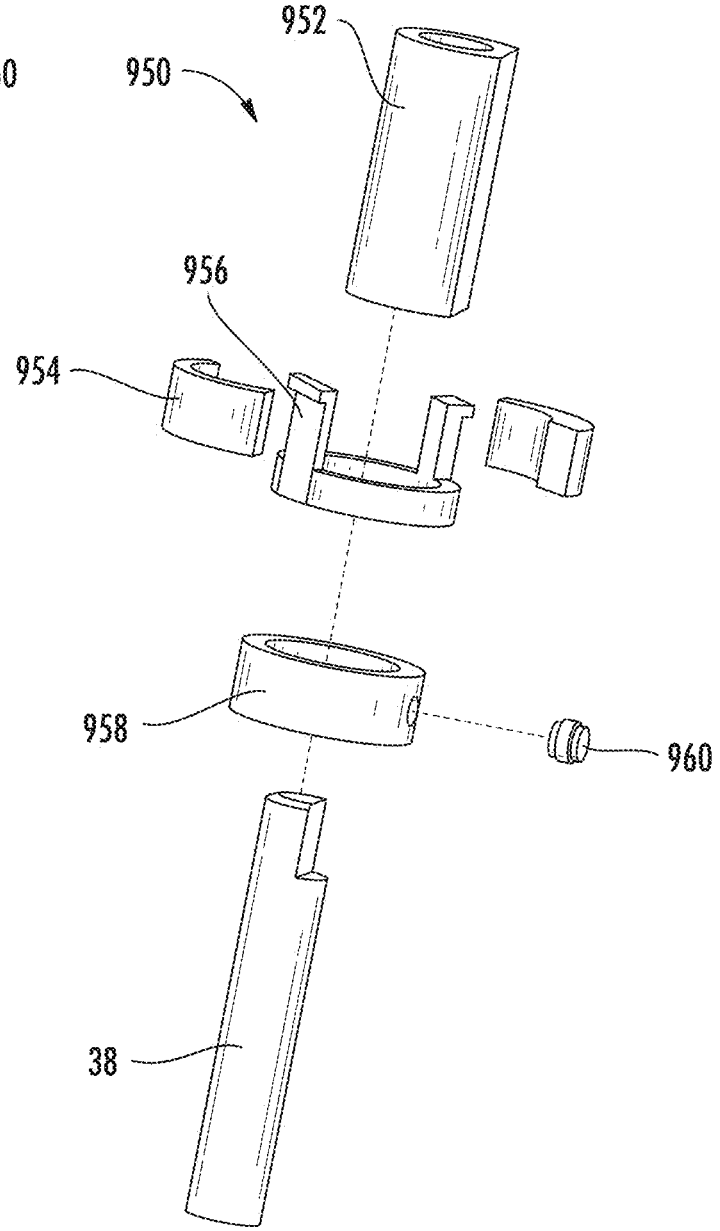

The two-piece adaptor 33 and 34 comprises an inner set-screw portion 33 and an outer universal adaptor portion 34. The inner set-screw portion 33 defines a bore 64 for receiving the operational shaft 38 for the burner 40. A set-screw extends through a threaded hole in the set-screw portion 33 and into the bore 64. The set-screw engages the operational shaft 38 for securing the inner set-screw portion 33 of the two-piece adaptor to the operational shaft 38. The outer surface of the set-screw adaptor has a longitudinal key 66. As shown in FIGS. 8A-8C, the concentricity gear 54 defines a central axial hole for receiving the inner set-screw portion 33 of the two-piece adaptor. The hole in the concentricity gear 54 includes a contiguous portion for receiving the key 66 such that the concentricity gear 54 rotates with the two-piece adaptor.

The outer universal adaptor portion 34 is a hollow tubular member configured to be secured at an outer end of the control knob 36. The universal adaptor portion 34 enables the safety device 20 to be used universally compatible with control knobs of many designs and configurations. The universal adaptor portion 34 defines a bore with a contiguous longitudinal slot. The shape of the bore and the slot corresponds to the periphery of the inner set-screw portion 33 such that the key 66 is received in the slot in the universal adaptor portion 34. Thus, the adaptor portions are keyed for rotation together along with the concentricity gear 54.

The control knob 36 is secured to, or engaged with, an operational shaft 38 of the burner 40 for controlling power supply used to operate the burner 40. The control knob 36 may be used to manually operate the burner 40. In other words, the control knob 36 is configured to move as a rotary dial in a manner substantially similar to a traditional stove knob for rotating the operational shaft 38 to activate the associated burner. As shown in FIG. 14, rotating the control knob 36 in a counterclockwise direction opens a power supply control switch providing power to the burner 40 while rotating the control knob 36 in a clockwise direction closes the power supply control switch preventing power to the burner 40.

Figure 11:
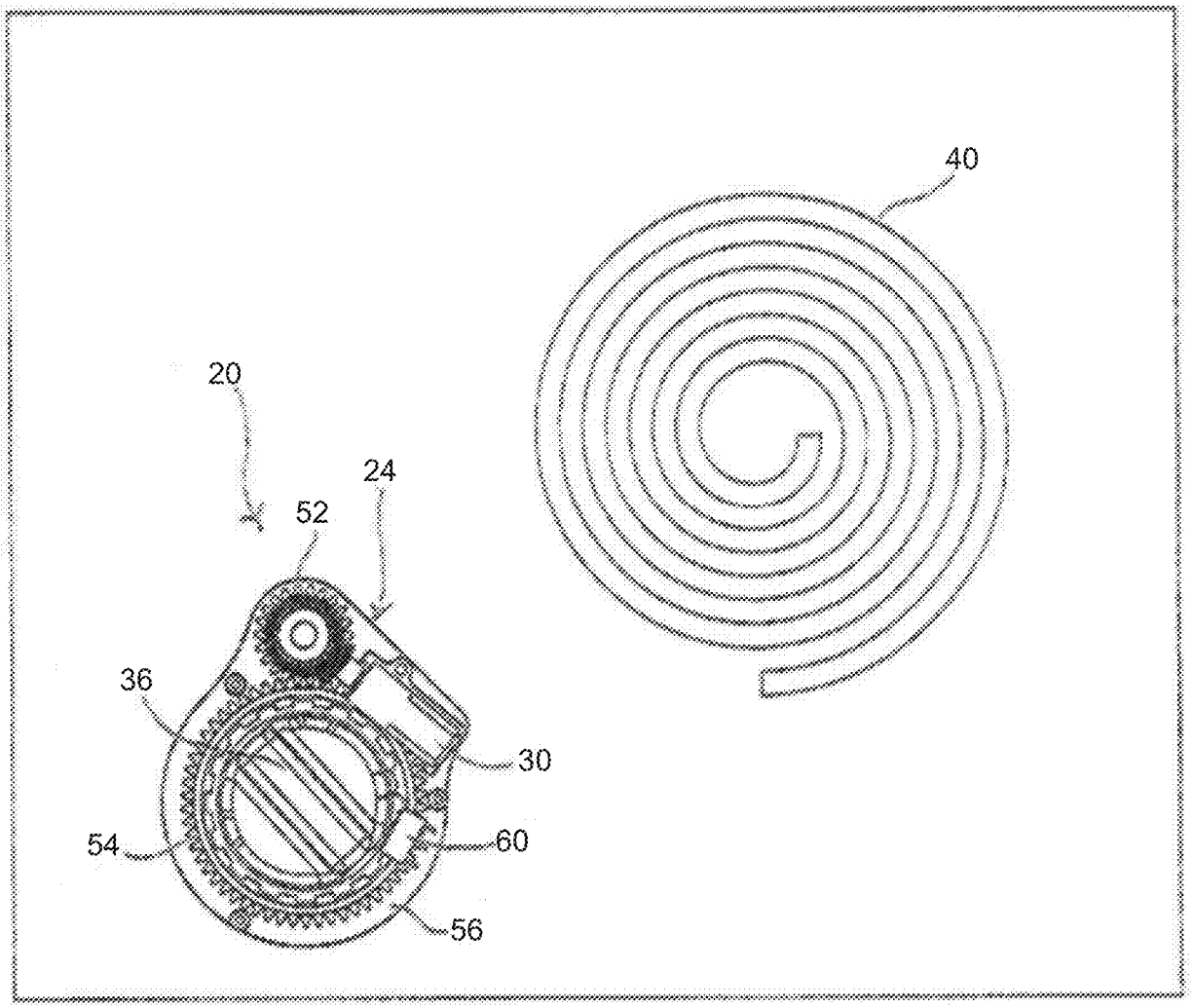
FIG. 11 is a top plan view of the safety device and burner as shown in FIG. 1 with the cover of the safety device removed and a knob turned for activating the burner.
Figure 12:
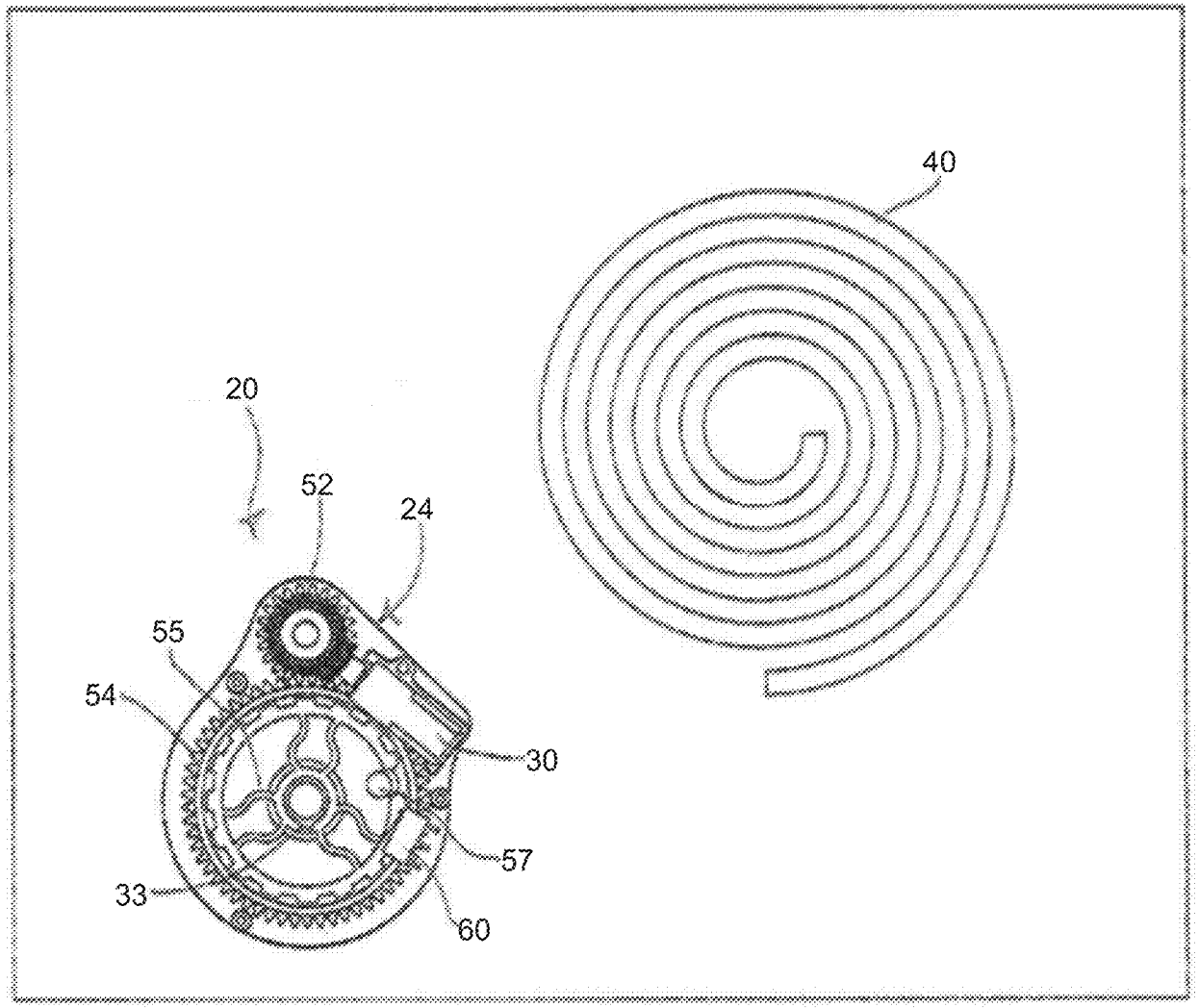
FIG. 12 is a top plan view of the safety device and burner as shown in FIG. 11 with the housing of the safety device removed showing the position of the gear train.

In use, the safety device 20 is configured to be received on an operational shaft 38 of a stove or other appliance. A user may retrofit an existing stove by removing an existing knob from a respective stove burner operational shaft and inserting the safety device 20 thereon. As described above, the base member 24 may be adhesively adhered to the surface of the stove surrounding the operational shaft 38. When cooking is desired, the control knob 36 of the safety device 20 is manually rotated in a traditional manner for controlling an output of power from the stove to activate the burner 40. As shown in FIG. 11, the control knob 36 has been rotated about 45 degrees in a counterclockwise direction. The control knob 36 also turns the concentric gear 54 such that the switch actuating post 57 on the concentricity gear 54 is spaced from the switch actuating blade 62 causing the limit switch 60 to close for allowing rotation of the motor 30 output shaft. Upon the occurrence of a safety event, the safety device 20 automatically rotates the control knob 36 to an Off position. More specifically, the motor 30 is started and turns the drive shaft of the motor 30. This in turn, through the gear train, rotates the control knob 36 and the operational shaft 38. The concentricity gear 54 rotates such that the switch actuating post 57 moves into engagement with the switch actuating blade 62 causing the limit switch 60, to open thereby breaking the circuit and stopping the motor 30.

Figure 13A:
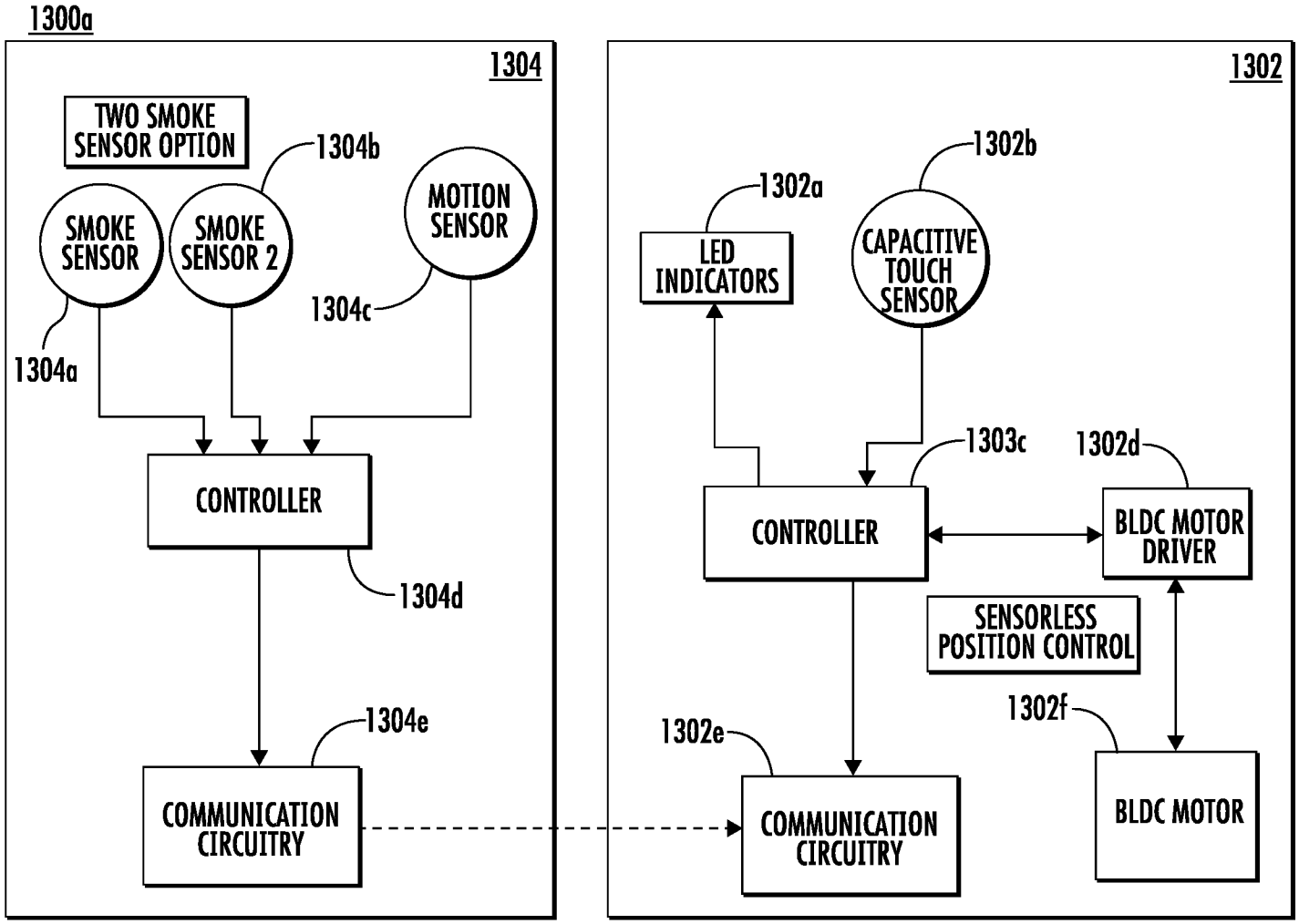
FIG. 13A is a schematic block diagram of circuitry used in association with a system for operating a safety device as shown in FIG. 1.

FIG. 13A is a schematic block circuit diagram, for operating embodiments of a safety device of the present invention, comprising a block diagram showing an example integrated system 1300*a* including a safety device module 1302, which may comprise one of the safety devices 20, 400, or 100. The system also includes a plurality of sensors, which may be located in sensor/relay device (module) 1304. An example sensor/relay module 1400 is described in further detail in relation to FIGS. 14A-14C. In some examples, the sensor/relay module 1304 is positioned above a stove top comprising the burners under control of the safety device modules such that it is advantageously placed for early detection of smoke or heat in the case of a fire (e.g. on a ceiling or range hood). Alternatively, the sensors may be positioned at or incorporated into a variety of places and remote from each other. For example, the sensors may be incorporated into a range hood assembly, which is typically installed above the stove. The sensors may also be mounted onto a wall, range, and/or ceiling near the stove. Further, the sensors may be concealed in the stove. The sensors may be electrically connected to the stove either by a wire or through a wireless interface. The sensors are configured to emit a signal upon an occurrence of an event, such as a fire, which may be an early indication of a developing emergency or safety event. As shown in FIG. 13A, the sensors may include a motion sensor 1304*c* as well as two smoke sensors 1304*a* and 1304*b*. In some examples, the smoke sensors may comprise a smoke detector which is able to utilize the multiple sensors to detect varying sizes of particles in the air. Sensors 1304*a*-1304*c* may also comprise a humidity sensor; a gas sensor, which is sensitive to one or more of the following gases: CO, $CO_2$, and flammable gases such as natural gas, propane, and/or butane; a temperature sensor; fire detectors; flame detectors; heat detectors; infra-red sensors; ultra-violet sensors; and any combination thereof In addition to sensors, a camera and/or microphones may also be used to monitor for detected hazards or safety events. For example, a camera in conjunction with a controller may utilize one or more lenses to detect smoke or flame emitting from a stove top. The camera may also be accessed by a user through a user device 1306 to provide the user a visual view of the stove top controlled by a safety device module. In some examples, the camera may be external to and in wireless communication with the sensor/relay device. For example, the camera may be placed on a backsplash or nearby the stove top instead of above it. In another example, a microphone may be configured to listen for the sound of a remote smoke detector sounding an alarm indicating a safety event is occurring. In some examples, the microphone may be configured to listen for voice communication, such as voice commands from a user to implement any of the functions and methods of the safety device module 1302 and sensor module 1304 described herein. Furthermore, while sensors 1304*a*-1304*c* are shown as only 3 sensors, sensor/relay module 1304 may include a plurality of sensors in any combination of the listed sensors described above.

Figure 13B:
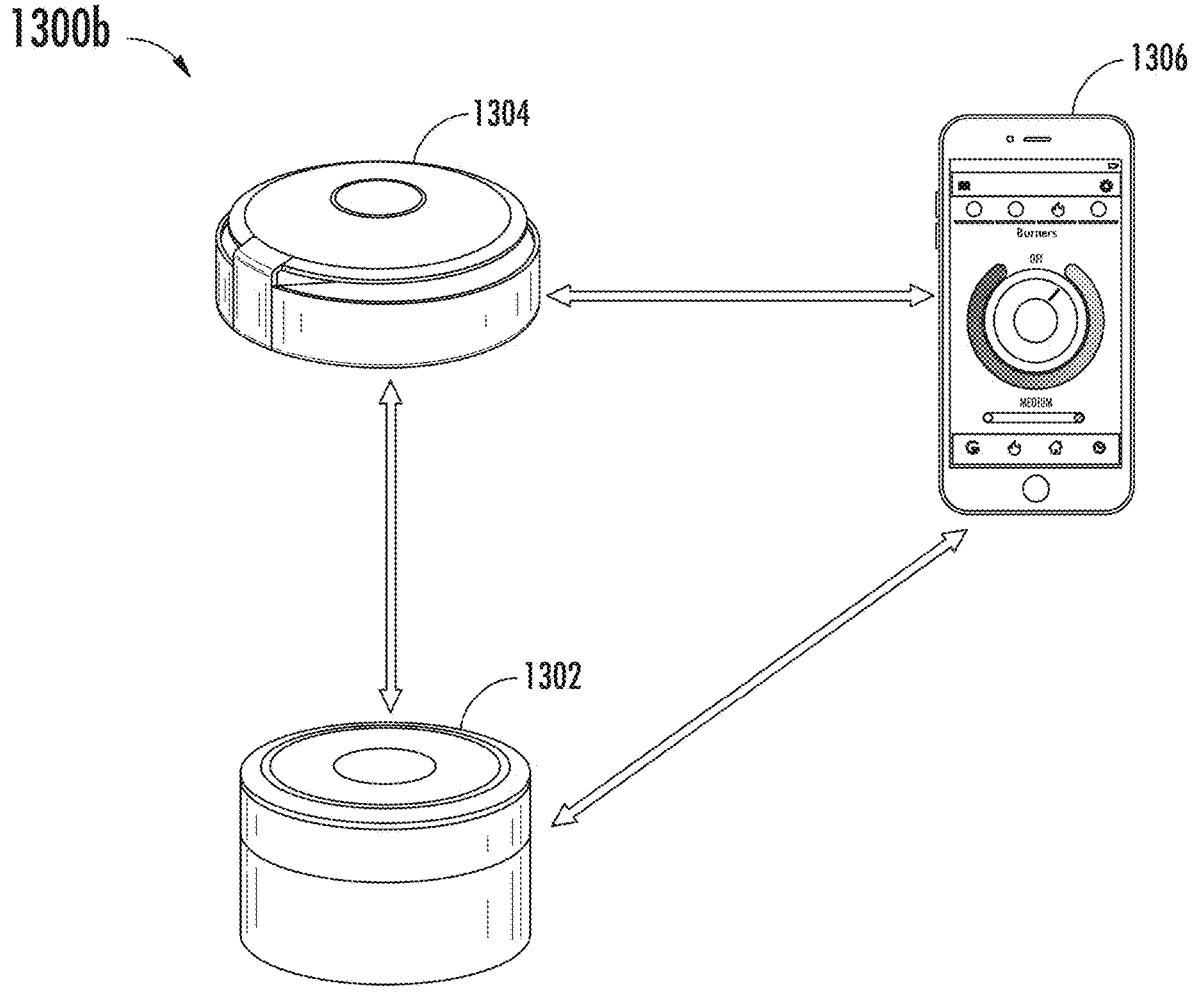
FIGS. 13B-13E are example system diagrams for a system for operating a safety device as shown in FIG. 1.

Signals may be sent to and from the sensors using wired or wireless signals, such as data signals or messages. As shown in FIG. 13A, the system may utilize communication circuitry 1304*e* and 1302*e* for communication between the modules. The communication circuitry 1304 and 1302 may utilize low energy Bluetooth, Wi-Fi, near-field communication (NFC), radio frequency (Rf), IR any combination of the communication protocols, or other existing or future developed communication protocols. Furthermore, it is contemplated that a safety device module may be configured to communicate with a human user through a user device 1306, utilizing communication circuitry 1306*d*, as shown in FIG. 13B and further described in relation to FIG. 13F. The user device 1306 may comprise a smartphone, tablet, remote computerized device, or any other computing device capable of interaction with a user. In some examples, the user device 1306 may also comprise an audio or speech based virtual assistant user interactive device running virtual assistant software such as Siri, Google Assistant, and/or Alexa. The user device 1306 may also be configured to work with multiple devices in a smart home or internet of things environment, such that the safety device module 1302 and sensor relay module 1304 may be in communication and integrated into a smart home environment.

In operation, the output of the sensors is continuously monitored. In one example, the one or more sensors, such as sensors 1304*a*-1304*c* generate one or more monitoring signals which are transmitted to a processor, such as sensor controller 1304*d*. In some examples, the processor receives the one or more monitoring signals and generates one or more control signals and causes the communication unit 1304*e* to transmit the one or more control signals to a controller, such as device controller 1302*c*, which in turn controls a motor, such as motor 1302*f*. In some examples, the control signals sent between the device controller 1302*c* and the motor 1302*f* are Pulse-width modulation (PWM) signals. The controller, such as device controller 1302*c* communicates with the sensor/relay module 1304 and sensor controller 1304*d*, which processes data received from the sensors to selectively transmit command data to a motor 1302*f*, which may comprise a motor in any of the safety devices described herein. The controller includes a processor having programming for operating the safety device module 1302 and functions substantially as described herein. In some examples, the device controller 1302*c* receives the sensor signals, determines appropriate command/control signals, and transmits the command/control signals either through a wired or wireless interconnection to the motor 1302*f*. A safety event is detected when a level of any of the sensors 1304*a*-1304*c* is detected that exceeds predetermined thresholds by either sensor controller 1304*d* or device controller 1302*c*, the controller, under the control of the system software contained within it, sends a control signal to the motor. The motor automatically drives the safety device module 1302 to turn off a burner by rotating the operational shaft of the burner.

Control of the safety device module 1302 may also be communicated by the user through user interface components as part of the safety device module. The interface components that may be a part of the safety device module 1302 as shown in FIG. 13A comprises a capacitive touch sensor 1302*b*. Furthermore, one or more LED indicator lights 1302*a* may also be provided that will inform the user, such as to the battery life. The user interface components may also include a display that will inform the user as to what actions the system is performing and what state it is in, as well as allowing for the user to select various operating modes. This may comprise a simple LED array with push-buttons, an alpha-numeric display, or a touch screen. Further, a touch sensor may be incorporated into the safety device module 1302, such as the capacitive touch sensor 1302*b*.

The system 1300*a* may further include a selectable timer. The timer may be automatically activated and in two-way communication with a controller 1304*c* and 1302*d*. In some examples, the timer will remind the user after a predetermined time that the burner is still activated. In some examples, a speaker may be situated on a printed circuit board and in electrical contact with a controller and the timer. After a predetermined time, the controller in communication with the timer actuates the speaker to emit a sound, such as a chime, for reminding a user to monitor the status of the cooking that was previously initiated. The motion sensor 1304*c* may also function with a timer. The motion sensor 1304*c* can have a variable placement location and peripheral view to detect the presence of a user in a predetermined proximity of the burner and can employ different types of sensing mechanism, such as infrared, ultrasound, optical, or weight-sensing switches. After a burner has been turned on, the motion sensor 1304*c* continuously monitors the presence of a user near the burner. If a user presence is detected, the timer of the safety device module 1302 is bypassed or restarted and power flows to the burner uninterrupted. The safety device module 1302 timer may turn the operational shaft of the burner to an Off position if no user is present and the time since the last user presence is less than a predetermined time. The predetermined time may be reset each time a user presence is detected. However, if no user presence is detected and the predetermined time has elapsed, the controller transmits a command signal to the motor 1302*f* to turn off the burner. In some examples, motion detector 1304*c* and sensor controller 1304*d* are configured to determine if motion detected is human motion. For example, motion sensor 1304*c* and controller 1304*d* may be configured to filter out motion caused by inanimate objects, such as shifting light, or things such as pets. For example, motion sensor 1304*c* and sensor controller 1304*d* may be configured to detect that sensed motion is from a dog or cat and thus non-human presence has been detected, which may be disregarded or ignored.

In another example, the timer of the safety device module 1302 may be bypassed or restarted by a user utilizing a touch button of the safety device module 1302 or by utilizing a user interface of user device 1306.

FIG. 13B depicts another example system diagram illustrating system 1300*b* including safety device module 1302, sensor/relay module 1304, and user device 1306. Safety device module 1302 may comprise any of the safety devices such as safety device 100, safety device 20 and/or safety device 400 as describe herein. Sensor/relay module 1304 may comprise sensor/relay device 1400. While illustrated as separate modules, sensor/relay module 1304 and safety device module 1302 may be combined into one device.

As illustrated, each of the safety device module 1302, sensor/relay module 1304, and user device 1306 may be in communication with each other such as through low energy Bluetooth, Wi-Fi, near-field communication (NFC), radio frequency (Rf), or infrared communication among others. The sensor/relay module 1304 may be configured to operate with a plurality of the safety device modules 1302 such as a plurality of safety device modules operating a plurality of burners on a stove top. Similarly, sensor/relay module 1304 may also be in communication with multiple user devices 1306. For example, multiple members of the same household may each use a user device 1306 to communicate with sensor/relay module 1304 and safety device module 1302. In some examples, user device 1306 may connect through a network connection such as an internet or Wi-Fi connection to sensor/relay module 1304 and the sensor/relay module 1304, may connect with safety device module 1302 through low energy Bluetooth, such that communication of system 1300*b* may use different communication protocols.

In some examples, the user device 1306 may also comprise a Global Positioning System (GPS), such that if the user device leaves a location of the safety device module 1302, the sensor/relay module 1304 and/or the safety device module 1302 may determine that a burner is in an On position representing a hazard detected or safety event. For example, is a user forgets to turn of the burner and leaves their home sensor/relay module 1304 may detect that the user device 1306 is remote from the home and generate a hazard detected signal. In some examples, a user may utilize the user device 1306 interface described herein to override the remote location detection hazard signal in the event that they are aware the burner is still on and would like to leave it on while not in the home.

In some examples, the safety device module 1302 may be embedded into a stove with digital controls such that turning an operation shaft of a burner is not required to turn off power to the burner. In this case, the control signal from the sensor/relay module may indicate to a controller of the safety device to cease providing power by sending a power off signal to a burner control module.

In some examples, a plurality of safety device modules 1302 may be preprogrammed to communicate with a specific sensor/relay module 1304, such that when the modules are powered on they automatically discover and communicate with each other. In other examples, each of a plurality of safety device modules 1302 may enter into a discoverable mode once powered such that a user utilizing user device 1306 and sensor/relay device 1304 may detect the discoverable safety device modules and pair or connect (add) them into the system 1300*b*. This allows for multiple safety device modules to be connected or replaced at different times.

As shown, the system 1300*b* may comprise additional safety features to operate safety device module 1302. For example, a child lock or burner use lock may be implemented in system 1300*b*. A child lock may be implemented to prevent an operational shaft of a burner from being turned to an On position. In some examples, the child lock may include a mechanical lock that prevents a safety device module from being turned from the Off position to an On position.

In one example of the child lock as implement in a safety device module utilizing the safety device 400, the safety device 400 may include an additional child lock member between fixed base member 424 and motor member 420 which may be locked by controller 462 when a child lock has been engaged. A mechanical lock may also be an external piece that may be manually position by a user between the safety device 400 and the stove top. The child lock member may be configured to prevent the engagement of the operational shaft 38 by the motor member 420 preventing the rotation of the safety device 400. In other examples, the controller 462 may include software to automatically turn the operational shaft 38 to an Off positon, preventing the burner 40 from being turned on continuously. For example, a child may manually turn the safety device 400 to an On position, but if the child lock is engaged, the safety device 400 will automatically rotate the operational shaft 38 back to the Off position. Other examples, of a child lock may include locking the electric motor 454 and/or gear train 452. Child lock functions may be engaged using a user interface at the user device 1306 or utilizing user interface components, such as a capacitive touch sensor, at safety device module 1302.

Figure 13C:
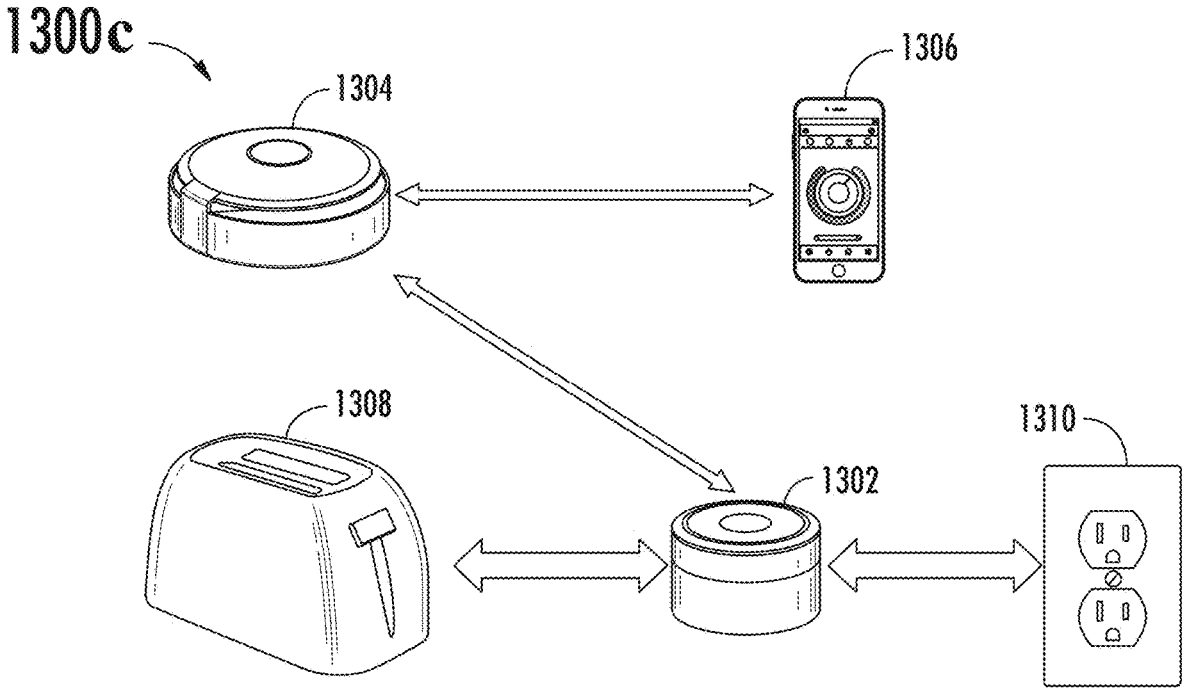

In some example embodiments, the safety device module 1302 may be configured to operate between an appliance 1308 and a power source 1310 as illustrated by example system 1300*c* in FIG. 13C. The safety device module 1302 may be configured to cut off the power supplied to the appliance 1308, such as a toaster, microwave, or other kitchen cooking device, from the power source 1310, upon receiving a control signal from sensor/relay module 1304 or user device 1306. Power source 1310 may be a standard wall outlet, a battery, or other power source. For example, upon detection of a safety event which may induce a control or hazard detected signal from the sensor/relay module 1304, the safety device module 1302 may be configured to cut off the power supplied to the appliance 1308. In another example, a user may select on a user interface at the user device 1306 to cut off power to the appliance 1308 by selecting an Off position on a user interface on the user device 1306, which will transmit an off control signal to the safety device module 1302, either directly from the user device 1306 or through sensor/relay module 1304.

Figure 13D:
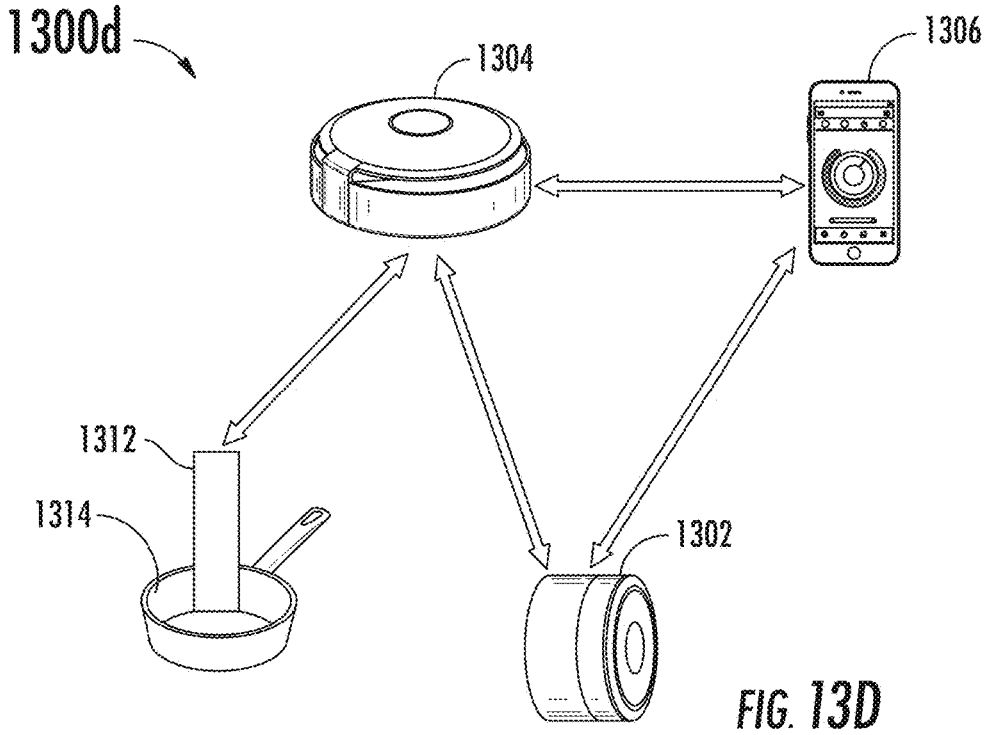

Referring to FIG. 13D; as shown in example system 1300*d*, the safety device module may be configured to provide incremental adjustments to the amount of power supplied to a burner to aid in cooking. For example, a user utilizing user device 1306, may desire to change the temperature of the burner being used in the cooking of a meal. The user may select a burner temperature on a user interface of user device 1306, the user device 1306 may then generate a control signal which instructs the controller of safety device module 1302 to change the position of the operation shaft of the burner, such as to a one of a plurality of different On positions corresponding to different power outputs of the burner, thus modulating the power supplied to the burner. In some examples, the user device may send the control signal directly to the safety device module 1302, or a signal may be sent through sensor/relay module 1304. In some examples, a plurality of On positions may include a low position, a medium low position, a medium position, a medium high position, and a high position, and each of the positions may correspond to a position of the operation shaft of the burner and a level of heat provided by the burner. In some examples, the user device may comprise recipe software which generates control signals to modulate the power supplied to a burner according to a recipe. For example, a user may start a recipe which requires a certain power level for a first time period and a second power level for a second time period. The recipe software on the user device may then automatically generate a control signal to change from a first On position to a second On position at the end of the first time period. For example, recipe software on the user device may be configured to change the power supplied to the burner from a medium high position to a medium position after five minutes of cooking.

In another example embodiment of system 1300*d*, a cooking device such as cooking device 1312 may be configured to directly monitor cooking properties, such as temperature, of food or a cooking environment 1314 during the process of cooking food utilizing a burner under operational control of safety device module 1302. The cooking environment 1314 may include a pot, a pan, or any other types of cookware that may use a burner during the cooking process. For example, sous vide is a style of cooking which requires accurate and regulated temperatures of water/steam for long periods of time to properly cook food in this style. Thus, cooking device 1312 may include a thermometer for monitoring the temperature of water/steam in the cooking environment 1314 and may generate a control signal that is used to modulate the power supplied to a burner providing heat to the cooking environment such that a constant regulated temperature is supplied. The control signal may be supplied directly to the safety device module 1302 to modulate the power supplied to the burner or may be sent through sensor/relay module 1304 to safety device module 1302. In another example, cooking device 1312 may include other sensors such as a camera to monitor visual cooking properties, such as color or perceived doneness, of food in the cooking environment 1314, or of the cooking environment 1314, such as the melting of butter or boiling of water. In each of these examples, the cooking device 1312 may include a processor and communication modules in communication with sensor/relay module 1304 and/or safety device module 1302 to control the power supplied to a burner and thus the amount of heat in the cooking environment 1314.

Figure 13E:
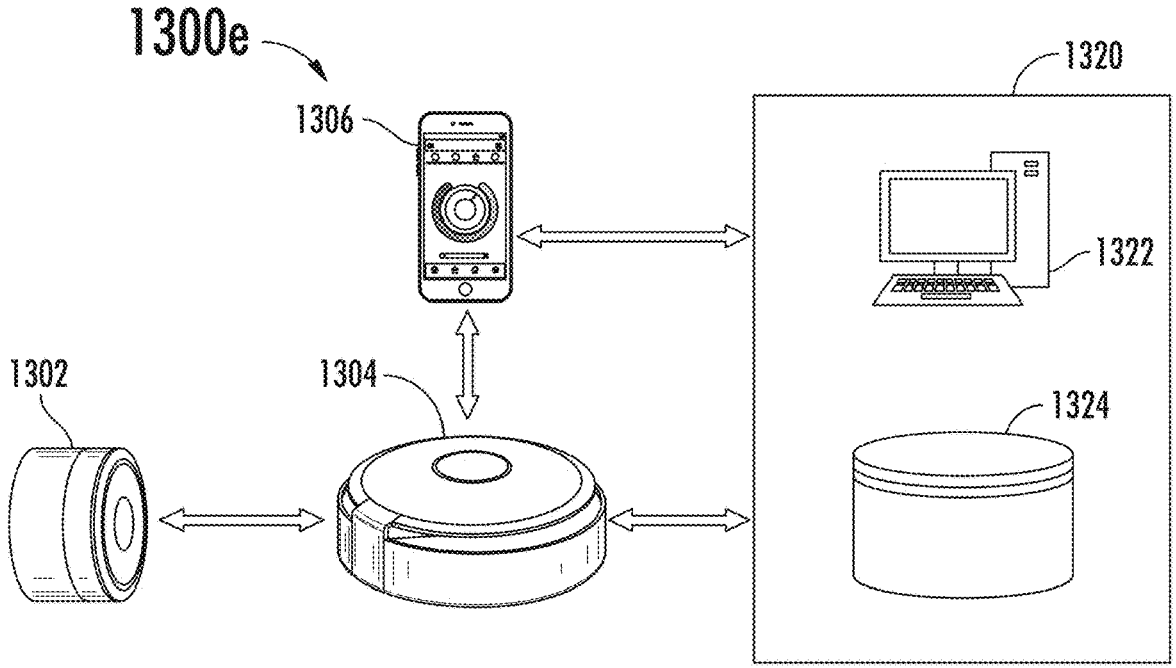

FIG. 13E illustrates an additional example system 1300*e* including an external server 1320 in communication with the user device 1306 and/or the sensor/relay module 1304. The external server 1320 may comprise a computing device 1322 and/or a database 1324 in addition to other types of data storage mediums. Each of the modules 1302, 1304, and user device 1306 may be configured to transmit usage and monitoring data to external server 1320. Usage and monitoring data may include any data generated by the user device 1306 or the modules 1302 and 1304. For example, monitoring data may include any of the signals generated by the sensors in the sensor/relay module 1304 including motion data (including length of time with no motion), camera data, safety event data, control signal data, sensor data (including smoke and/or gas levels) and data representing any of the other signals sent or received by the sensor/relay module 1304. Operational data from the safety device module 1302 may also be sent to the external server 1320 through sensor/relay module 1304 and/or user device 1306. Operational data may include any data representing the operation of safety device module 1302 including time the device is turned on, duration of the device use, number of instances where the device is turned to an Off position due to a safety event and which safety event caused each instance, number of times a safety event alarm is cancelled, or any device modulation by control signals from user device 1306 or cooking device 1312. Other operational data from safety device module 1302 may also be sent to external server 1320 including battery life and system status information including any system errors. Likewise, user device 1306 may also be configured to transmit operational data to external server 1320. Operational data from user device 1306 may include time a user interacts with the user interface to control the safety device module 1302 or any of the actions or components the user selects while interacting with the user interface of the user device 1306.

Figure 13F:
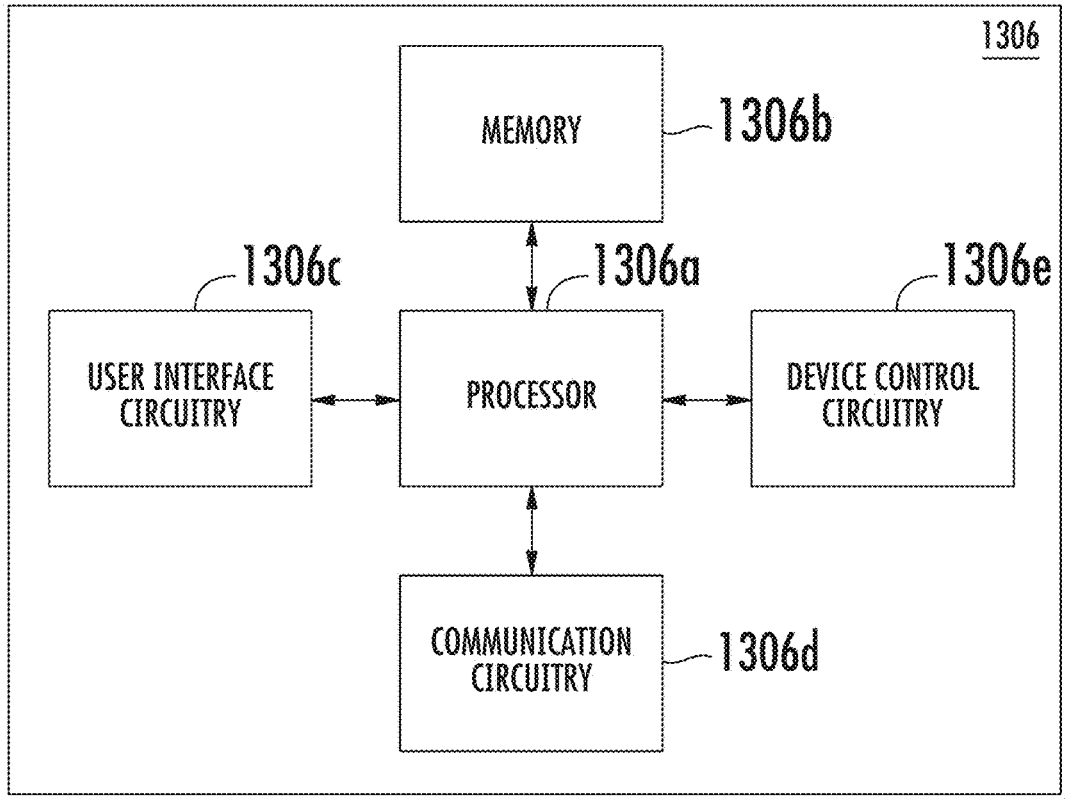
FIG. 13F is a schematic block diagram of circuitry used in association with a user computing device for operating a safety device as shown in FIG. 1.

FIG. 13F illustrates an example user device apparatus of user device 1306. As illustrated the user device 1306 may include a processor 1306*a*, memory 1306*b*, device control circuitry 1306*e*, communications circuitry 1306*d*, and user interface circuity 1306*c*. The user device 1306 may be configured to execute the operations of the user device described herein.

Figure 14B:
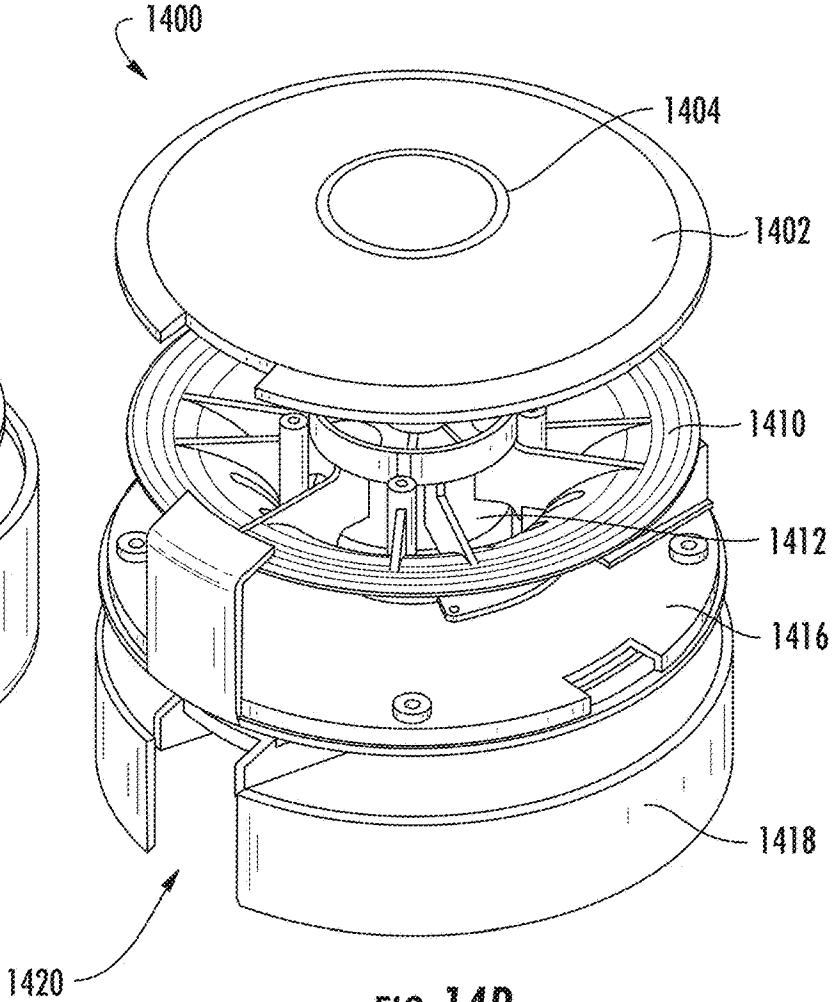
FIG. 14B is an exploded perspective view of elements of the sensor/relay device as shown in FIG. 14A.
Figure 14A:
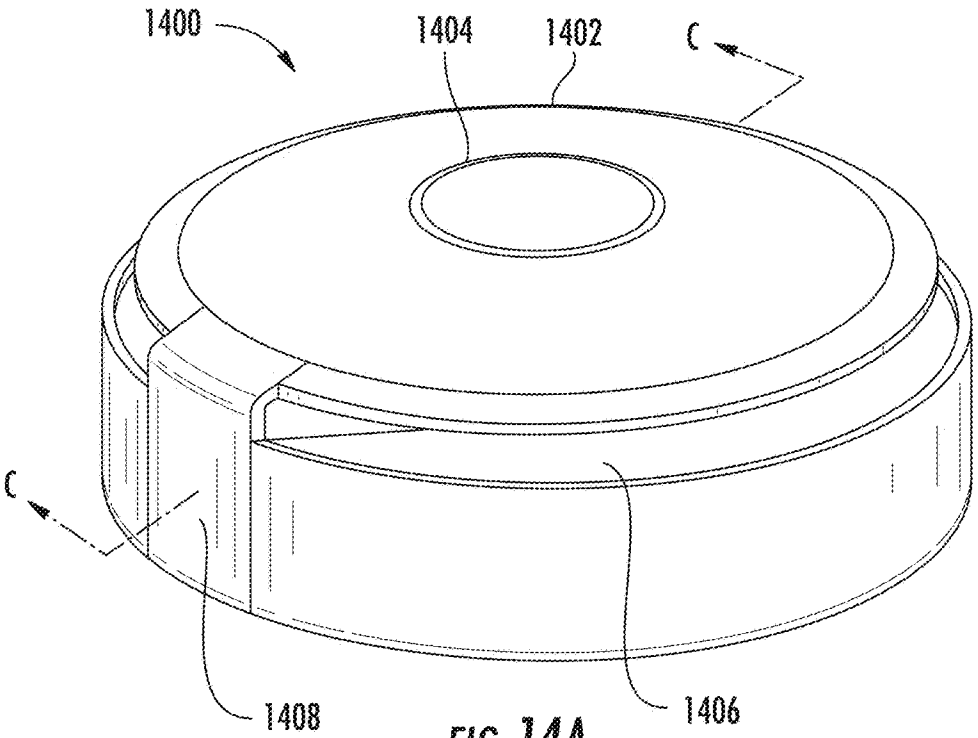
FIG. 14A is a schematic perspective view of a sensor/relay device.
Figure 14C:
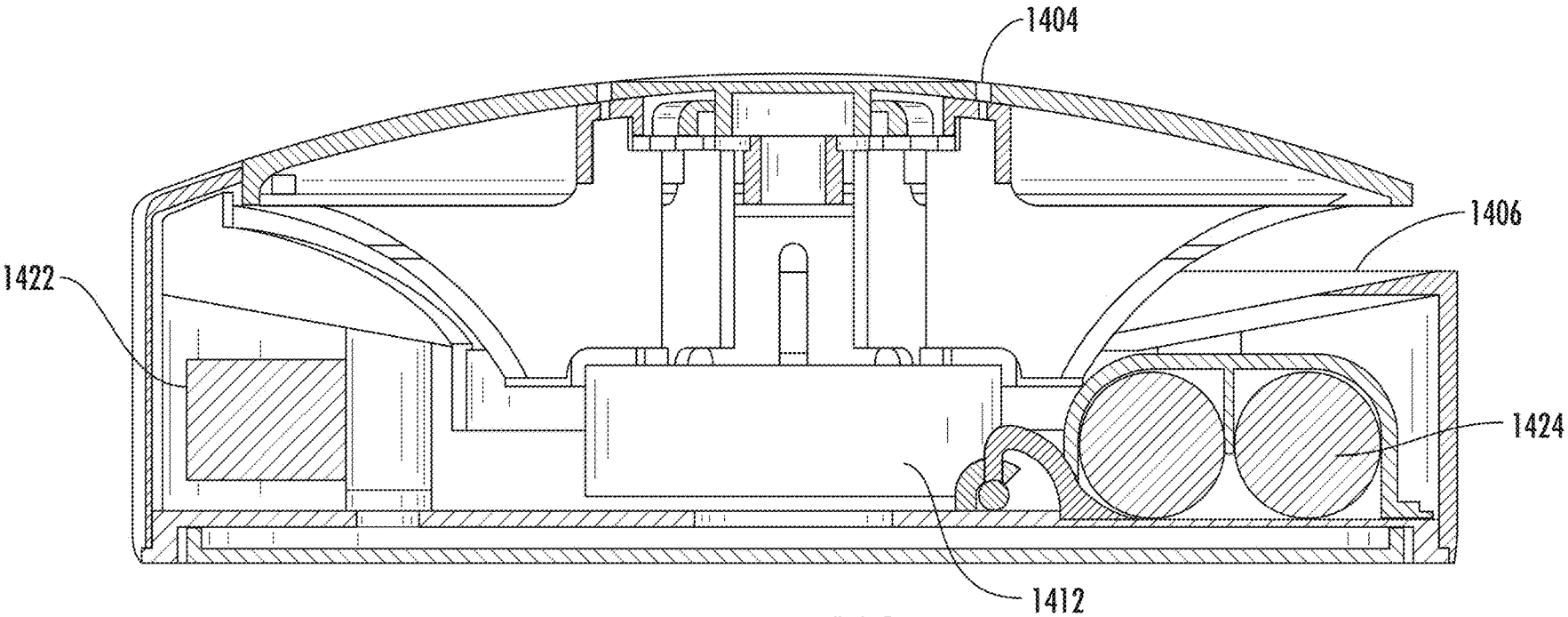
FIG. 14C is a longitudinal cross-section view of the sensor/relay device taken along line C-C of FIG. 14A.
Figure 16:
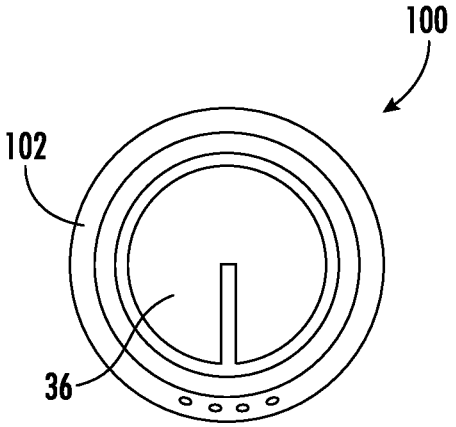
FIG. 16 is a top perspective view of the safety device as shown in FIG. 15.
Figure 17A:
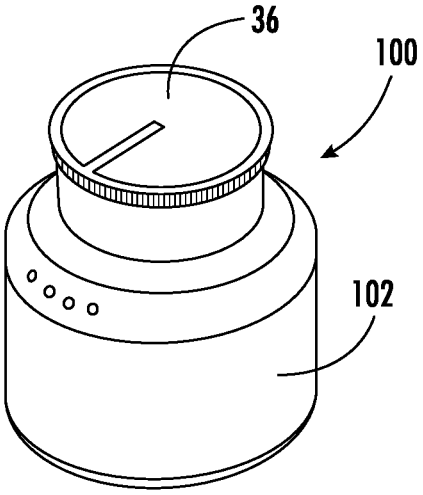
FIG. 17A is a top plan view of the safety device as shown in FIG. 16.
Figure 17B:
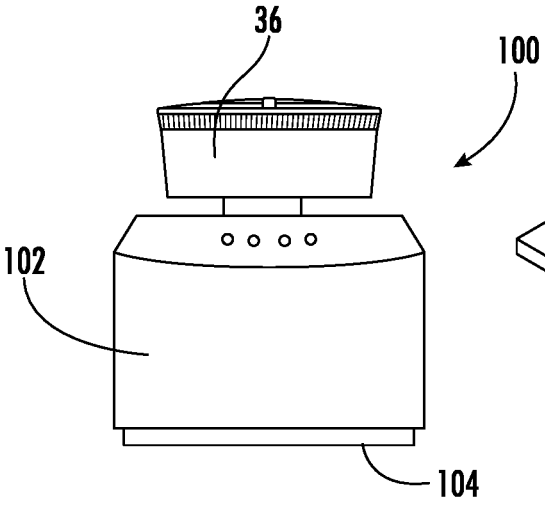
FIG. 17B is a front elevation view of the safety device as shown in FIG. 16.
Figure 15:
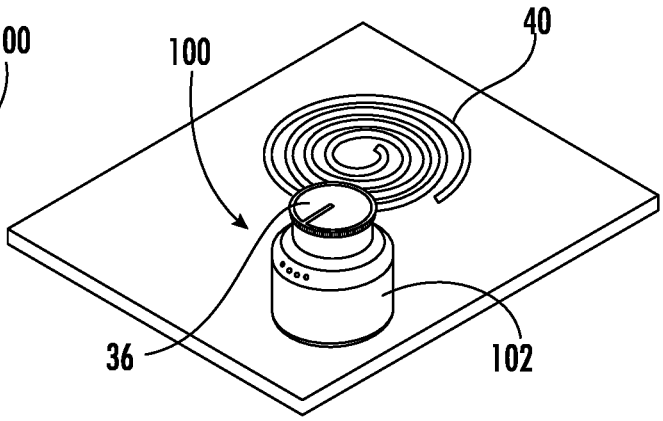
FIG. 15 is a schematic perspective view of another embodiment of an automatic safety device for operating a for operational control of a burner.

FIG. 14A is a schematic perspective view of a sensor/relay device 1400. FIG. 14B is side perspective view of elements of the sensor/relay device 1400, and FIG. 14C is a longitudinal cross-section view of the sensor/relay device 1400 taken along line C-C of FIG. 14A.

The sensor/relay device 1400 may comprise a housing member 1418, a top piece 1402, and an LED array 1404. The housing member 1418, the top piece 1402, and the LED array 1404 may be attached to base pieces 1410 and 1416 to provide an enclosed sensor/relay device as shown in FIG. 14A. The LED array 1404 may configured to provide light representing the function or status of the sensor/relay device 1400. For example, the LED array 1404 may display a red light in the event of a system or device error, such as power loss, sensor malfunction, or communication failure has occurred. The sensor/relay device 1400 may also include a window 1420 and a window covering 1408. The window 1420, and window covering 1408 if transparent or translucent, may provide a visual sight line from safety device module 1302 (or area around the safety device module 1302) to a motion sensor or a camera 1422 in the enclosure of the sensor/relay device 1400 as described herein. The sensor/relay device 1400 also includes an intake 1406. In some examples, the intake 1406 is configured to allow gas, smoke, and particles to enter the enclosure of the sensor/relay for measurement by one or more motion sensors 1422 or smoke/gas sensor 1412. The sensor/relay device 1400 may also include power supply 1424 configured to provide electricity to the sensors 1422 and 1412 as well as a processor and LED array 1404. In some examples, power supply 1424 may include batteries such as rechargeable or replaceable batteries. In other examples, power supply 1424 may comprise a connection to a home electrical network such as a plug for a wall outlet to use ordinary house voltage or a connection to a wired smoke detection system. In some examples, power supply 1424 may comprise a rechargeable battery. In some examples, power supply 1424 may be connected to a recharging mechanism. In some examples, top piece 1402 may comprise one or more solar panels configured to serve as a recharging mechanism to power supply 1424. In some examples, the solar panel may receive ambient or room level light and recharge power supply 1424. This allows for power supply 1424 and sensor relay device 1400 to function for prolonged periods of time without requiring manual recharging (e.g. a user having to manually change or connect the battery to a charger).

Another embodiment of a stove knob safety device for operational control of a stove top burner is shown in the FIGS. 15-20C and generally designated at 100. The safety device 100 comprises a housing 102 including a base member 104, an electric motor 106, and a core unit 108 for engaging with the operational shaft 38 of the burner 40, and a universal knob adaptor 110 for the control knob 36. The housing 102 further accommodates a power source 112 and two PCB controllers 114, 115. One of the controllers 114 is a selectable timer. The other controller 115 is programmed to actuate the motor 106 to rotate the control knob 36 to the Off position upon occurrence of an event. As in the embodiments of safety device 20 and 400, the safety device 100 is configured to selectively automatically shut off the flow of electricity or gas to the burner 40 under certain predetermined safety conditions. The safety device 100 may also be regulated by the example systems described herein including a motion sensor that monitors the presence of a user near the stove to determine whether or not to activate the powered shut-off mechanism. The system tracks the time duration of absences of the user via the motion sensor. If no movement is detected within a predetermined period, the safety device 100 is automatically activated to turn the control knob 36 and operational shaft 38 to the Off position. This arrangement allows full control of operation of the burner 40 if the user is present.

Figure 19:
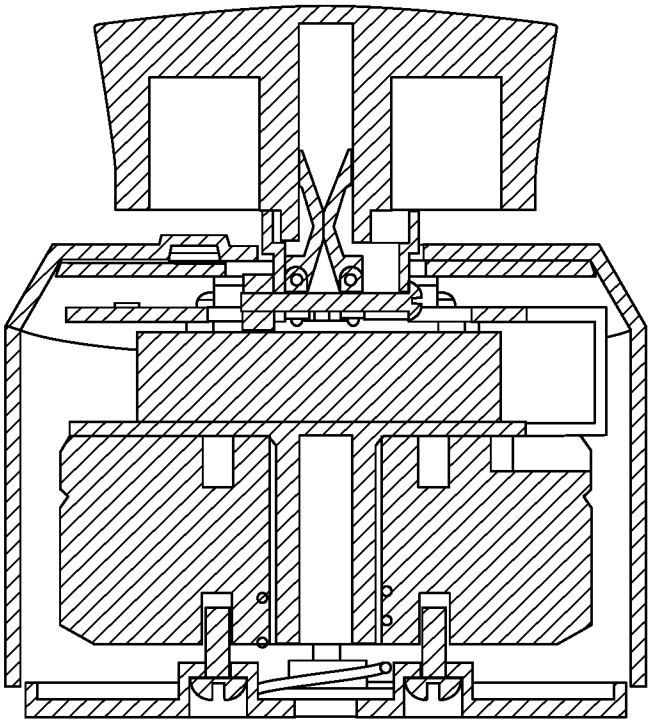
FIG. 19 is a longitudinal cross-section view of the safety device taken along line A-A of FIG. 18.
Figure 18:
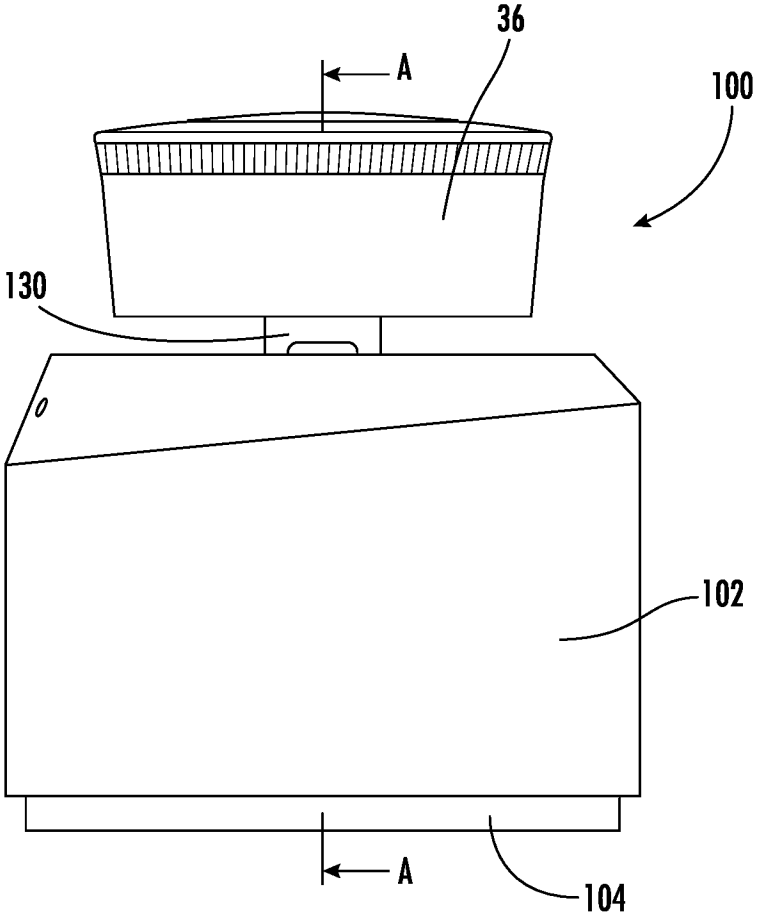
FIG. 18 is a side elevation view of the safety device as shown in FIG. 16.
Figure 20A:
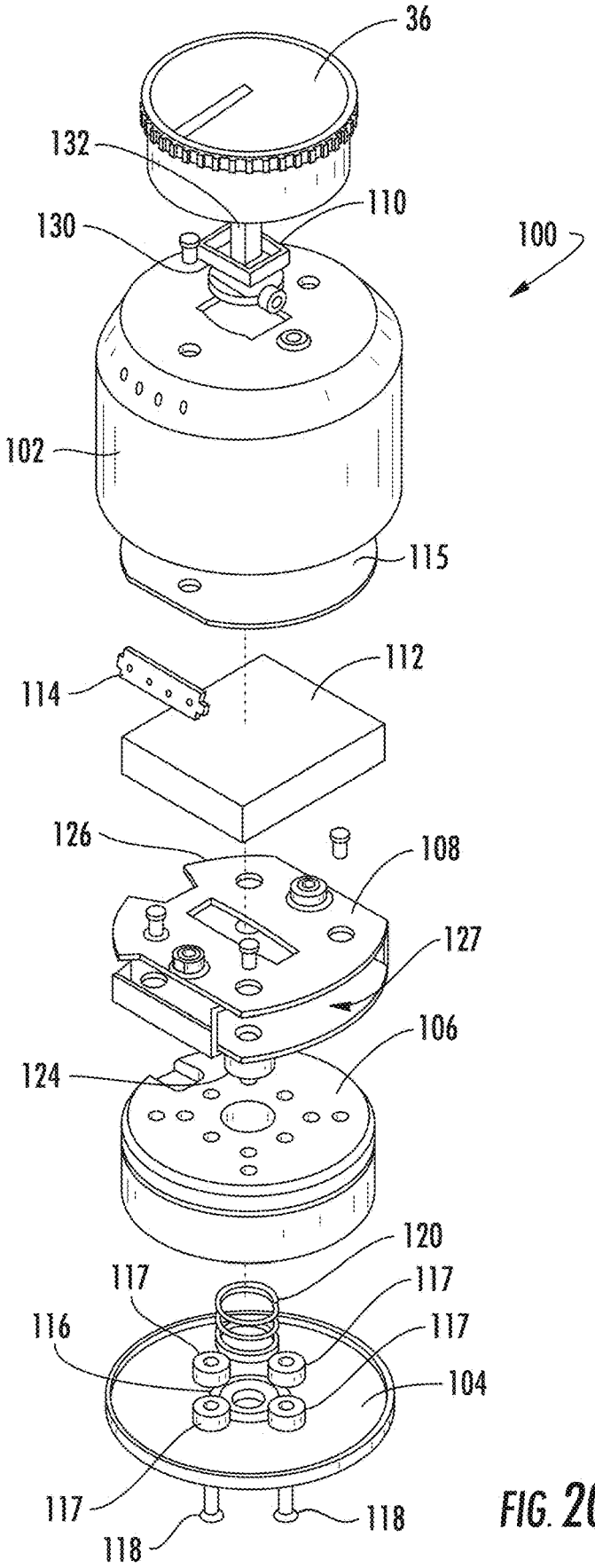
FIGS. 20A-20C are exploded top perspective views of the safety device burner as shown in FIG. 15.
Figure 20B:
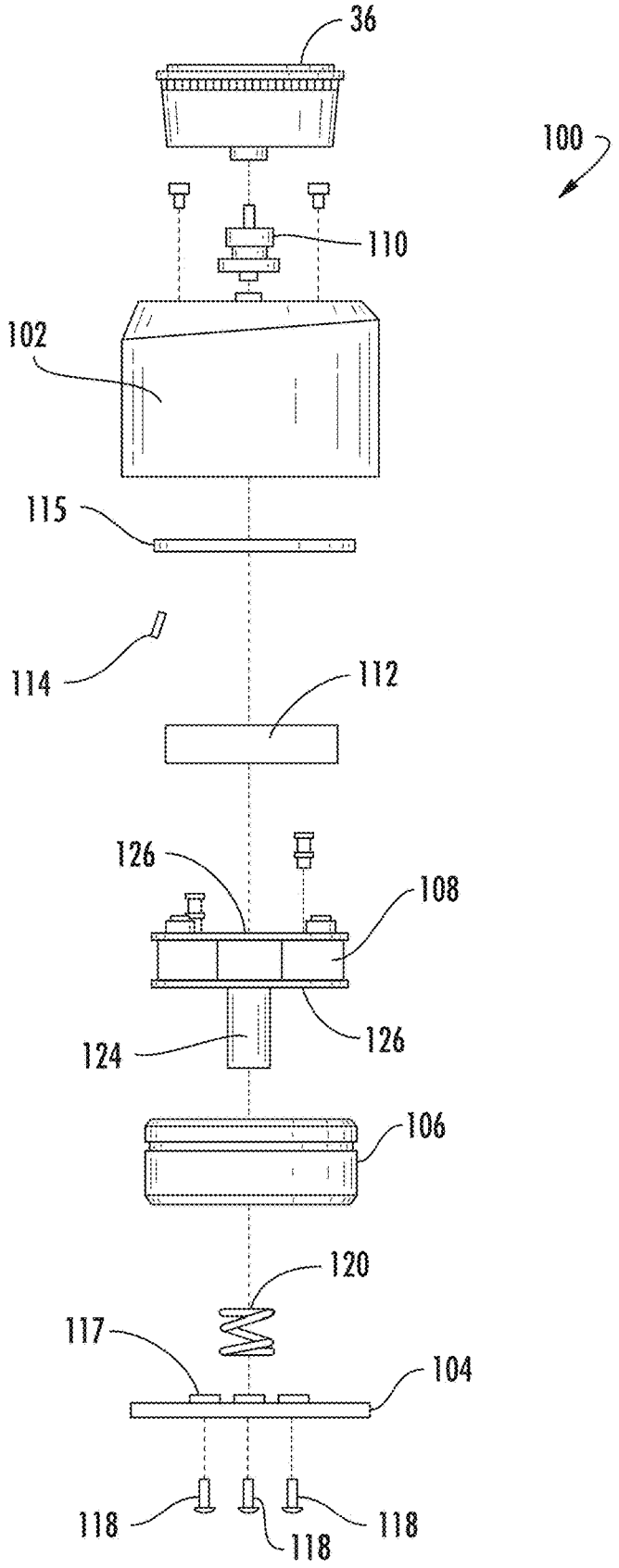
Figure 20C:
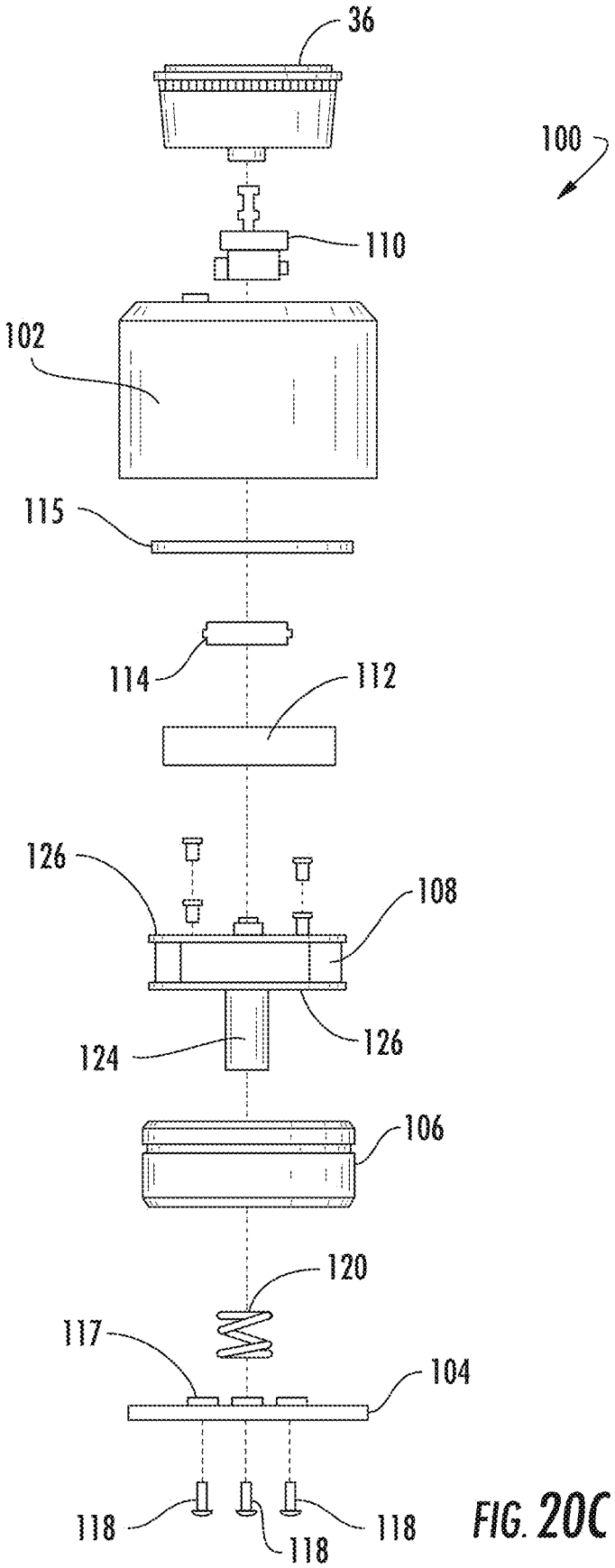
Figure 21B:
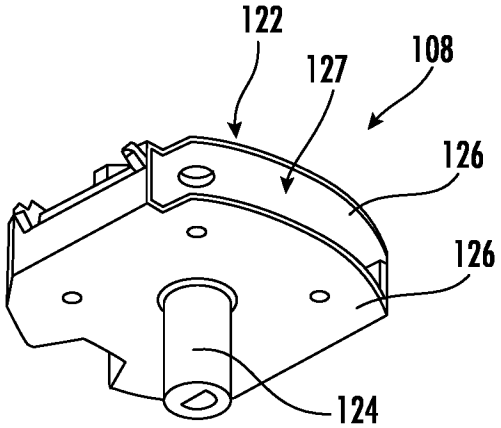
FIG. 21B is a bottom perspective view of the core unit as shown in FIG. 21A.
Figure 21C:
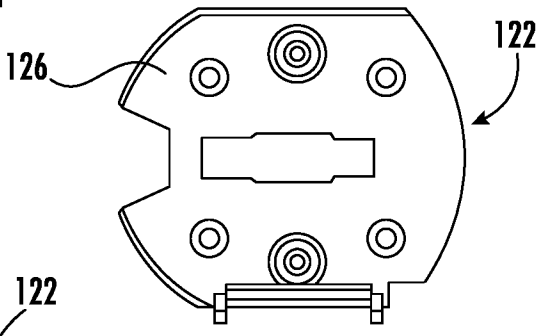
FIG. 21C is a top plan view of the core unit as shown in FIG. 21A.
Figure 21D:
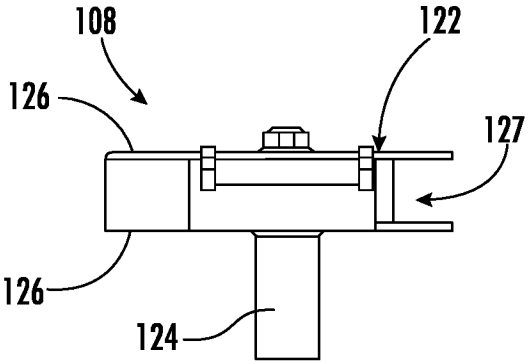
FIG. 21D is a front elevation view of the core unit as shown in FIG. 21A.
Figure 21A:
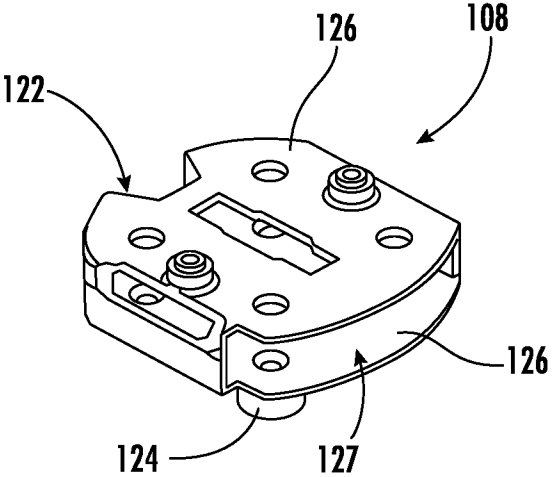
FIG. 21A is a top perspective view of a core unit for use with the safety device as shown in FIG. 15.
Figure 21E:
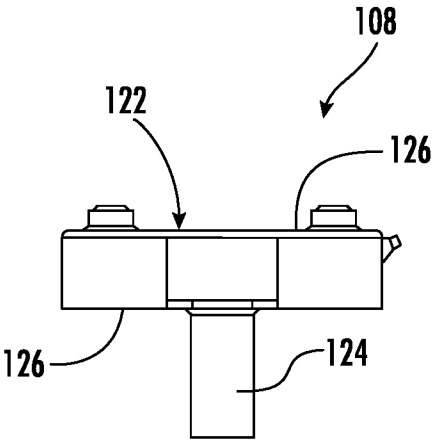
FIG. 21E is a side elevation view of the core unit as shown in FIG. 21A.
Figure 22A:
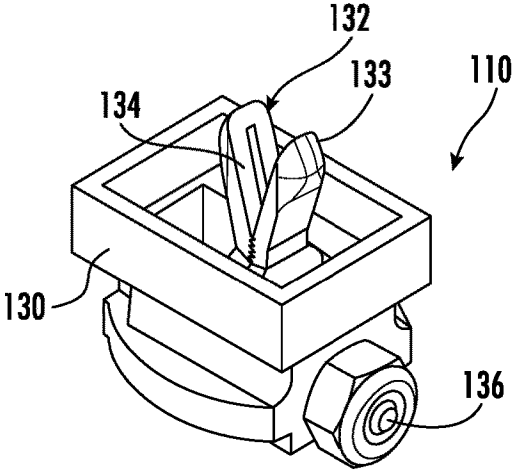
FIG. 22A is a top perspective view of a universal knob adaptor assembly for use with the safety device as shown in FIG. 16.
Figure 22D:
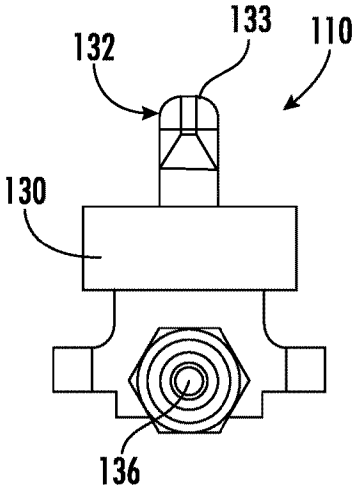
FIG. 22D is a side elevation view of the universal knob adaptor assembly as shown in FIG. 22A.
Figure 22B:
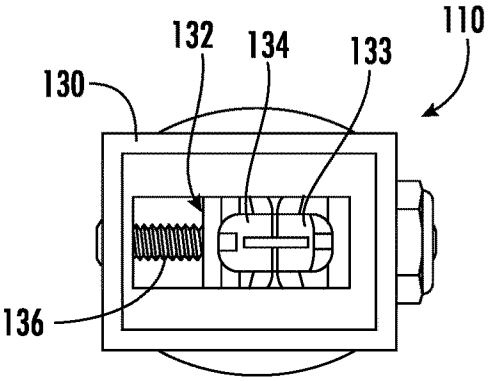
FIG. 22B is a top plan view of the universal knob adaptor assembly as shown in FIG. 22A.
Figure 22C:
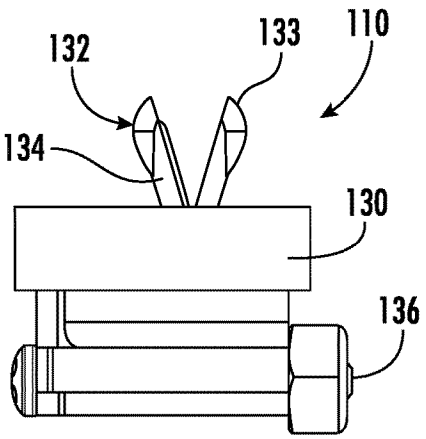
FIG. 22C is a front elevation view of the universal knob adaptor assembly as shown in FIG. 22A.
Figure 23B:
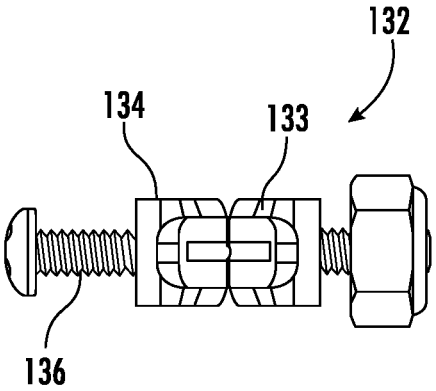
FIG. 23B is a top plan view of the universal knob adaptor as shown in FIG. 23A.
Figure 23A:
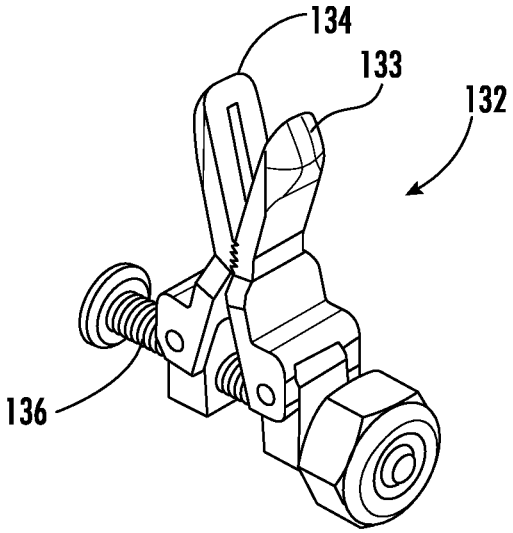
FIG. 23A is a top perspective view of a universal knob adaptor for use with the safety device as shown in FIG. 16.
Figure 23C:
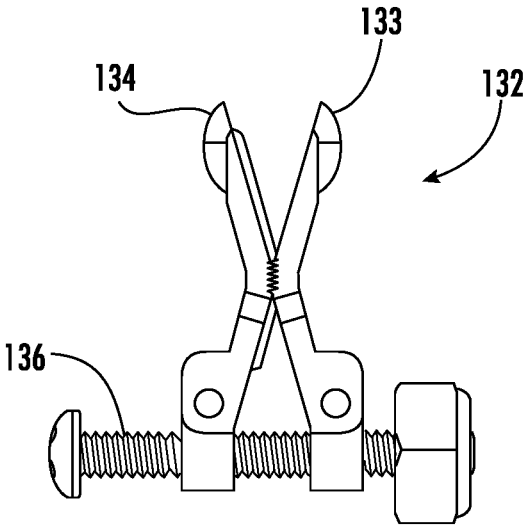
FIG. 23C is a front elevation view of the universal knob adaptor as shown in FIG. 23A.
Figure 23D:
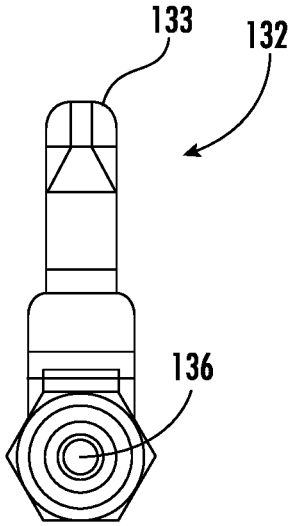
FIG. 23D is a side elevation view of the universal knob adaptor as shown in FIG. 23A.

Referring to FIGS. 19-20C, the base member 104 of the housing 102 of the stove knob safety device 100 defines a central circular opening 116. A bottom surface (not shown) of the base member 104 may include an adhesive layer such that the base member 104 may be permanently mounted against the surface of the stove surrounding the operational shaft 38 of the burner 40. In this arrangement, the operational shaft 38 extends outwardly from the stove surface and beyond the plane of the base member 104. The opening 116 through the base member 104 allows the operational shaft 38 to rotate freely.

The electric motor 106 is a hollow shaft gimbal motor disposed on the base member 104. The base member 104 has four threaded bosses 117 circumferentially spaced around the opening 116. Threaded fasteners 118 extend through the bosses 117 and into the motor 106 for securing the motor 106 to the base member 104. A coil spring 120 is positioned above the base member 104.

Referring to FIGS. 21A-21E, the core unit 108 comprises an outer portion 122 and a stem 124. The outer portion 122 includes spaced parallel plates 126 defining an inner cavity 127. The battery 112 is adapted to fit in the cavity 127. The stem 124 is an elongated hollow shaft extending inwardly from the inner surface of the upper portion of the core unit 108. The axial opening through the stem 124 is configured to non-rotatably receive the operational shaft 38 such that the core unit 108 rotates with the shaft 38. A set-screw (not shown) extends through a threaded hole in the stem 124 and into the axial opening. The set-screw engages the operational shaft 38 for securing the stem 124 of the core unit 108 to the operational shaft 38. The hollow drive shaft of the motor 106 is adapted to receive the stem 124 for rotating the core unit 108. The core unit 108 is secured to the outer surface of the motor 106 using threaded fasteners. The stem 124 is an elongated hollow shaft extending inwardly from the inner surface of the upper portion of the core unit 108. In this arrangement, operation of the motor 106 rotates the core unit 108 which in turn rotates the connected operational shaft 38 for the burner 40. In one embodiment, the electric motor is a DC motor powered by the battery 112 located within the cavity 127. It is understood that the safety device 100 could be powered by ordinary house voltage instead of batteries.

As shown in FIGS. 22A-22D, the universal adaptor 110 comprises a base member 130 mounting an adjustable arm assembly 132. The arm assembly 132 comprises a pair of arms 133, 134 pivotally connected intermediate their lengths. The proximal ends of the arms 133, 134 pass a threaded shaft 136. Rotation of the shaft 136 in one direction causes the proximal ends of the arms 133, 134 to advance toward one another such that the distal ends of the arms 133, 134 move apart. Similarly, rotation of the shaft 136 in the other direction causes the proximal ends of the arms 133, 134 to move apart along the shaft 136 such that the distal ends of the arms 133, 134 come together. The base member 130 is configured to be disposed in the core unit 108 such that the arm assembly 132 extends outwardly from the core unit.

The knob 36 defines a bore 37 for receiving the spaced distal ends of the arms 133, 134 in a friction-fit relationship. The distance between the arms 133, 134 is adjustable for accommodating different sizes of stove knobs 36. The universal adaptor 110 thus enables the safety device 100 to be used universally compatible with control knobs of many designs and configurations. The control knob 36 is secured to, or engaged with, the operational shaft 38 of the burner 40 through the core unit 108 for controlling power supply used to operate the burner. The control knob may be used to manually operate the burner 40. In other words, the control knob 36 is configured to move as a rotary dial in a manner substantially similar to a traditional stove knob for rotating the operational shaft 38 to activate the associated burner.

In use, the safety device 100 is configured to be received on an operational shaft 38 of the stove or other appliance. A user may retrofit an existing stove by removing an existing knob 36 from a respective stove burner operational shaft and inserting the safety device 100 thereon and then reinserting the knob 36 on the universal adaptor 110. As described above, the base member 104 may be adhesively adhered to the surface of the stove surrounding the operational shaft 38. When cooking is desired, the control knob 36 of the safety device 100 is manually rotated in a traditional manner for controlling an output of power from the stove to activate the burner 40. Upon the occurrence of a safety event, the safety device 100 automatically rotates the control knob 36 to an Off position. More specifically, the motor 106 is started and turns the core unit 108 through the stem 124 which, in turn, rotates the control knob 36 and the operational shaft 38.

Figure 5:
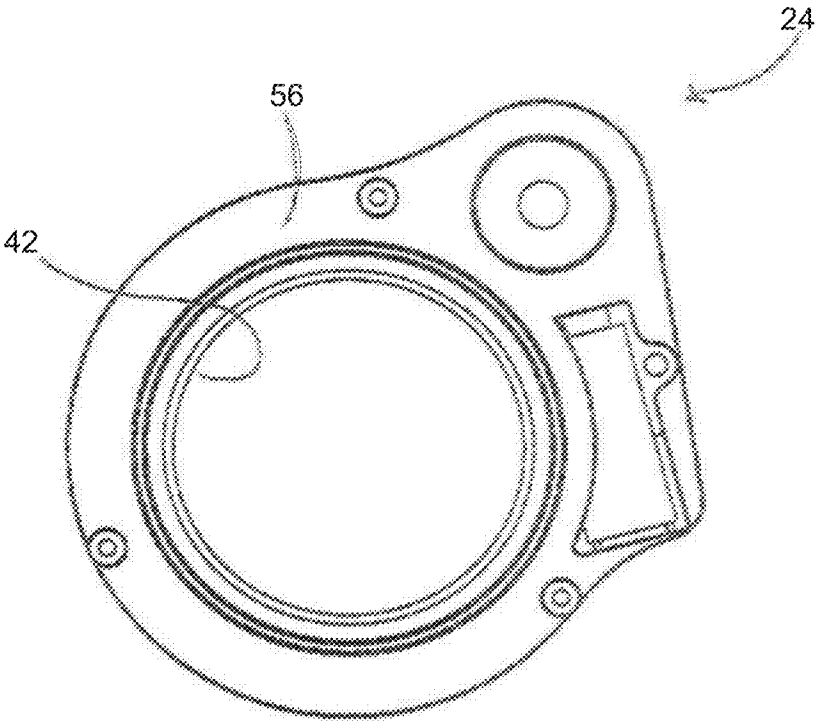
FIG. 5 is a top plan view of a base member of a housing for use with the safety device shown in FIG. 1.
Figure 24A:
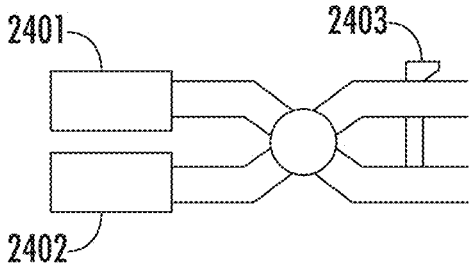
FIGS. 24A and 24B are exemplary embodiments of a clamp for the universal knob adaptor.
Figure 24B:
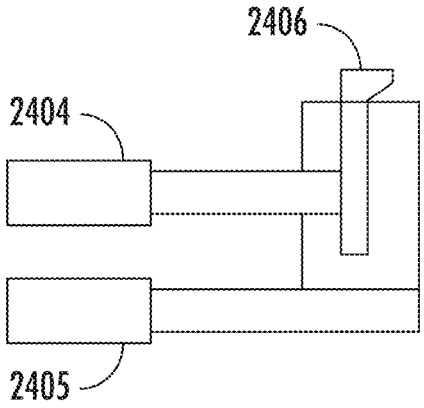

Referring to FIG. 24A, a clamp for the universal knob adaptor is shown. The clamp comprises a screw 2403 and a pair of arms 2401 and 2402. One end of each arm is connected through the screw 2403. When the arms 2401 and 2402 are inserted under the bottom surface of the base member 24 (as shown in FIG. 5), rotation of the screw 2403 in one direction may cause arms 2401 and 2402 to move apart from each other. In this instance, the base member 24 can be secured. Because the distance between arms 2401 and 2402 can be adjusted by rotating the screw 2403, the clamp can be used to accommodate different knob sizes and shapes. FIG. 24B shows one explanatory stage of the clamp, where the screw 2406 has been rotated in one direction, and the arms 2404 and 2405 have been advanced towards each other.

Figure 25:
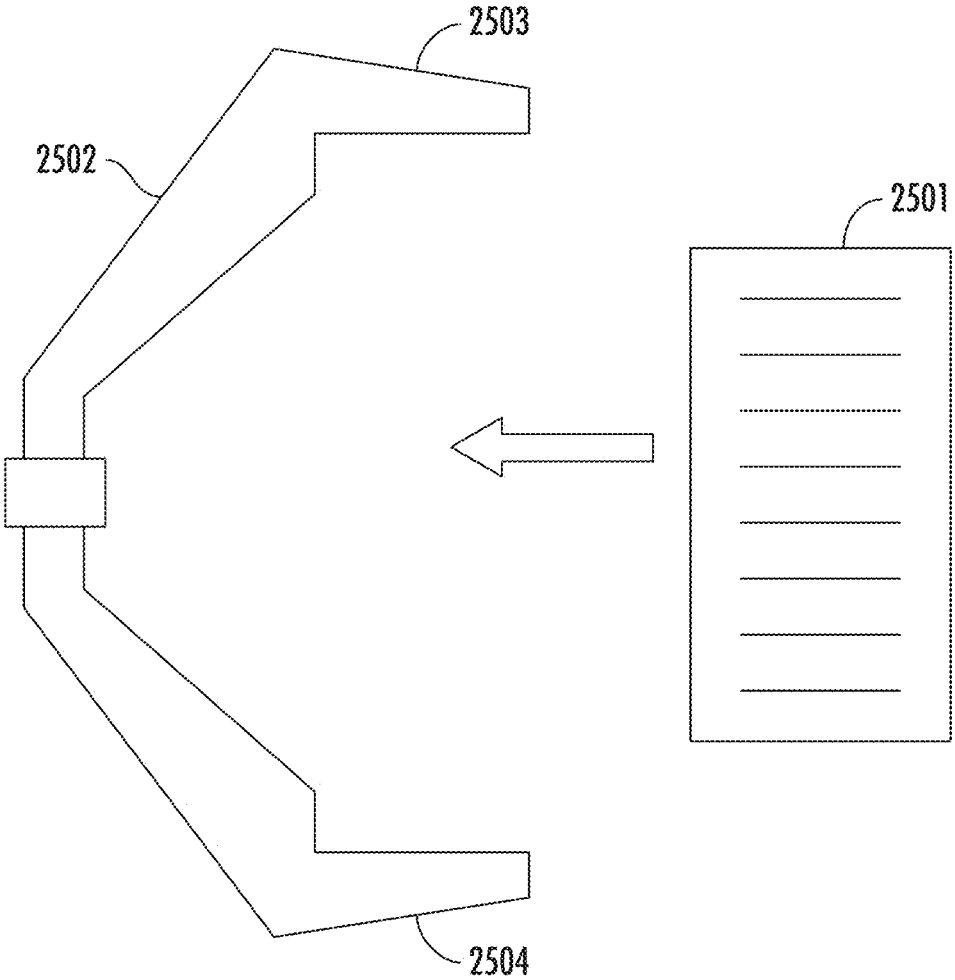
FIG. 25 is an exemplary embodiment of a clamp for an outside edge of the knob.

Referring to FIG. 25, another preferred and non-limiting embodiment of the knob adaptor is shown, where a clamp 2502 comprises a pair of arms 2503 and 2504, which can be adjusted to accommodate different sizes of the outside edge 2501 of a stove knob. When the clamp 2502 is tightened around the outside edge 2501 through arms 2503 and 2504, the position of the bottom member 24 that is attached to the clamp 2502 is secured.

In addition, a squish barrel may also be used as a knob adaptor. A squish barrel may consist of a conical metal price, a cylindrical flexible rubber, and a screw. When the screw is rotated, the conical metal piece advances into the core of the cylindrical flexible rubber. As a result, the cylindrical flexible rubber stretches and expands. When the squish barrel is attached to a stove and the cylindrical flexible rubber is inserted into stem 124 of the knob (as shown in FIGS. 21A-21E), the knob can be securely attached to stove.

Figure 26:
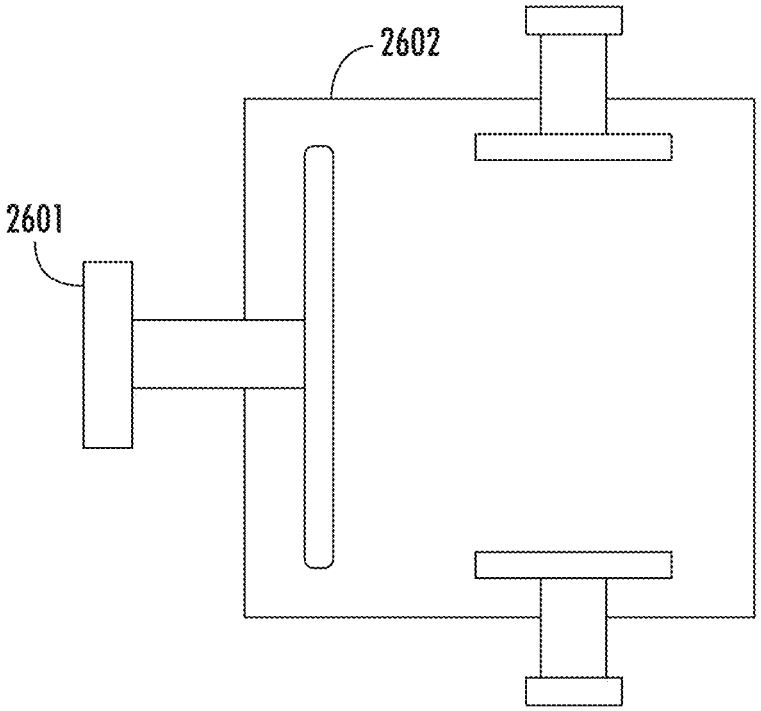
FIG. 26 is an exemplary embodiment of another embodiment of a shaft adaptor.

Referring to FIG. 26, an explanatory embodiment of the shaft adaptor is shown. The shaft adaptor comprises a filler 2602 and one or more screws 2601. In a preferred and non-limiting embodiment, the filler can be either square-shaped or rectangular-shaped. The overall size and shape of the shaft adaptor can be adjusted by rotating the one or more screws 2601. Consequently, the shaft adaptor can be used to accommodate a variety of stove shaft sizes and geometries.

In another preferred and non-limiting embodiment, one or more plastic pieces may be used as a shaft adaptor. To accommodate the shape and size of a particular shaft, a particular plastic piece may be chosen so that the plastic piece can fit into the particular shaft.

Figure 27C:
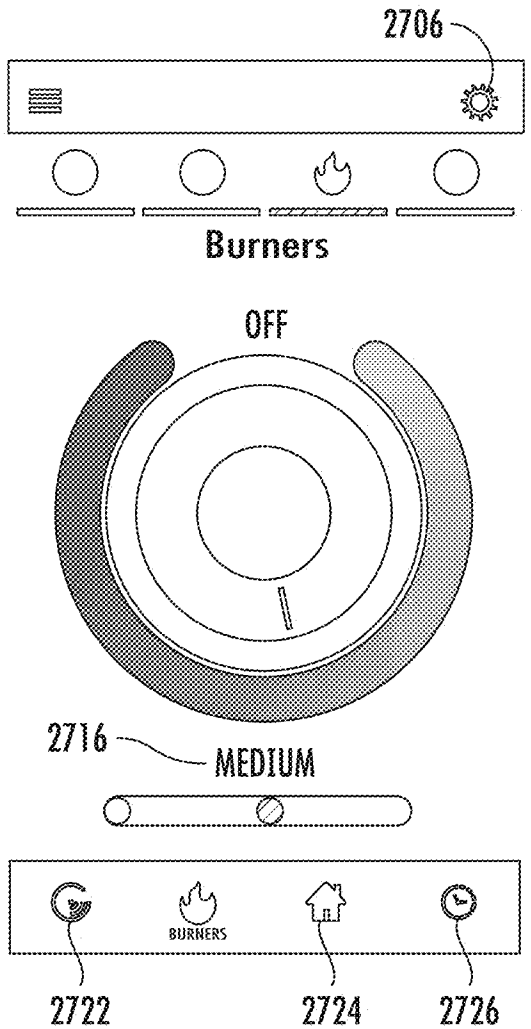
FIGS. 27A-C illustrate example user interface components of a user computing device for operating a safety device of embodiments of the present invention.
Figure 27B:
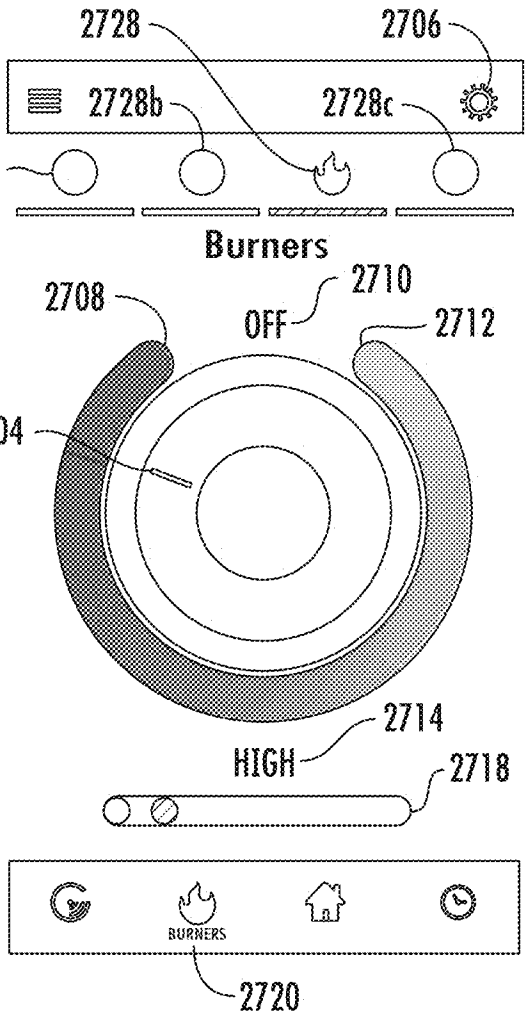
Figure 27A:
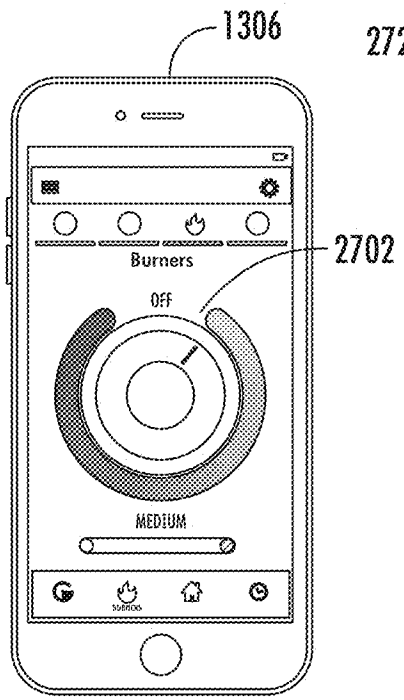

Referring to FIGS. 27A-C which illustrate example user interface components of a user computing device. As shown in FIG. 27A the user interface 2702 may be embodied on a user device 1306. The user interface 2702 may be rendered on a display of user device 1306 by user interface circuitry (UIC) 1306*c*. User interface circuitry 1306*c* may also be configured to receive a user selection, such as a select command, a change, or control, of any of the components of the user interface shown in FIG. 27B and FIG. 27C. For example, user interface circuitry 1306*c* may be configured to receive a user selection of a component of the user interface 2702 on a touch screen display of user device 1306. In some examples, user interface circuitry 1306*c* is configured to receive a user selection and generate one or more user control signals based on the received user selection. Further, a user module communication unit, such as communication circuitry 1306*d*, may transmit the one or more user control signals to the sensor/relay module 1304, wherein the communication unit of the sensor/relay module is further configured to receive the user control signals and transmit the user control signals to the controller 1302*c* of the safety device module 1302, wherein the controller 1302*c* is further configured to modulate the power supplied to the burner by causing the motor and gear train to turn the operational shaft of the burner to one of a plurality of On positions in response to the one or more user control signals.

Example embodiments of rendered user interface components are shown in FIGS. 27B and 27C. In some examples, communication circuitry 1306*d* may receive a device status indication from the safety device module 1302. The device status indication may include the operational status of the safety device module (e.g. on, off, position of the safety device module, current position, battery life status of safety device module 1302 and sensor/relay module 1304, safety event information, current position, child lock status, activity log etc.). The user device 1306, utilizing will then render the operational status of the safety device module 1302 on the display of the user device. For example, the operational status may be indicated by component 2704 which indicates that the device is on and at a far clockwise position, such as indicated by the line of the depicted control knob aligning near a darker red of the surrounding heat indicator semi-circle. As shown by component 2714, this position relates to a high position of the operational shaft of the burner, and high heat. Component 2718 is a user selectable component, which when selected and moved by a user causes the user device 1306, utilizing device control circuitry 1306*e*, to determine a control signal to send to the safety device module to modulate the temperature of the burner by moving the operational shaft of the burner to a different position. For example, as shown in the FIG. 27C the operational shaft of the burner has been moved to a medium position as shown by component 2716, and also as indicated by the line of the depicted control knob aligning closer to the middle of the surrounding heat indicator semi-circle. In some examples, a user may select to turn the device to an Off positions, thus causing device control circuitry 1306*e* to send an Off signal to the safety device module 1302.

Component 2708 represents a highest On position of the operational shaft of the burner, and component 2712 represents a lowest On position of the operational shaft of the burner. Component 2710 represents an Off position of the operation shaft of the burner. In some examples, the user device 1306 may be used to set varying positions of the safety device module during an initial set-up or a calibration of the varying positions. For example, user interface 2702 may include instructions for a user to turn the safety device module to a highest On position such that the operational shaft of the burner is in a highest On position and providing the maximum amount of power (electricity or gas) to the burner. The user may then select that the safety device module 1302 is in the highest On position. User device 1306 may then send a confirmation signal to safety device module 1302 to confirm that the device is in the highest On position. The position may then be stored at controller 1302*c* for future use by the safety device module. The same process may be used to position the lowest On position, as well as, any number of a plurality of other On positions, such as a medium low position, a medium position, a medium high position, etc., as well as the Off position. Each of the positions may be stored at controller 1302*c* such that when a control signal is received from user device 1306, the controller may then access the stored position and issue a control signal to the motor such that the operational shaft of the motor will be instructed to turn to the stored position.

Component 2728 represents a user selection of safety device modules each controlling one of a plurality of burners including safety device modules 2728 and 2728*a-c*. Each of the burners in the plurality of burners may be associated with a safety device module, such as safety device module 1302. A user may be able to independently control the position of each safety device module of the plurality of safety device modules using user device 1306. Components 2720, 2722, 2724, and 2726 may be configured to show other user interfaces corresponding to a presentation of status information of a sensor module such as sensor module 1304, the status of a home, and/or a historical view of the status of the system such as system 1300*b*. For example, component 2720 may be selected for user interface components related to one or more safety device modules. Component 2722 may be selected for user interface components related to one or more sensor/relay devices. Component 2724 may be selected for user interface components related to one or more elements of a home. Component 2726 may be selected for user interface components related to historical data of the one or more safety device modules, the one or more sensor/relay devices, the home, the user interface components, the user interface, or the user computing device itself. Element 2706 provides access to a settings menu which may allow a user to adjust settings of the user interface, such as an application running on the user computing device 1306 and may also provide support information to the user. Element 2706 may also provide access and management of user account information such as a user name and device information with external server 1320.

In some examples, user device 1306 may receive a notification from safety device module 1302 and/or sensor/relay module 1304 indicating the occurrence of a safety event. In some examples, a user may be able to override the safety device module from turning to the Off position. For example, if a timer has elapsed as described herein, safety device module and/or sensor/relay module 1304 may send a notification with a temporal option to cancel the safety device module 1302 turning to the Off position. The user may also be able to override or temporarily turn one or more of the sensors in the sensor/relay module 1304 off. For example, if a user is cooking and producing large amounts of smoke, but knows there is no fire, the user may utilize user device 1306 to temporality turn off a smoke sensor in the sensor/relay device.

Additionally, user device 1306 may also be configured to allow a user to add multiple authorized users and/or user accounts to control safety device module 1302 and receive device status indications including notifications.

Figure 28:
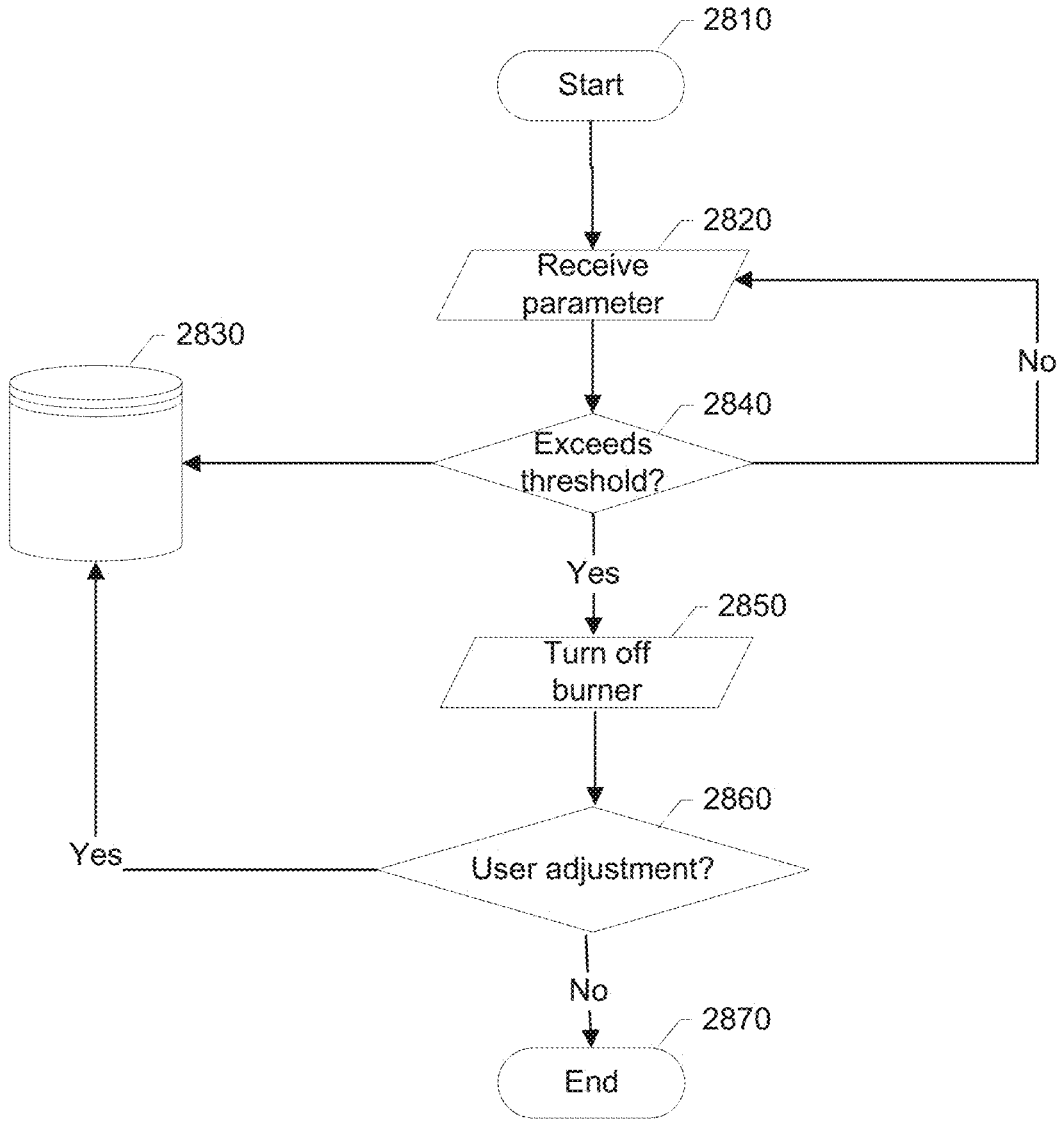
FIG. 28 shows a flow chart of an exemplary method in accordance with some embodiments.

FIG. 28 illustrates a flow diagram depicting an example of a process for adjusting the threshold for one or more parameters detected by one or more sensors. The process illustrates how, upon reception of an parameter detected by one or more sensors, an apparatus determines whether the parameter exceeds the threshold, and in the event that a user manually adjust the knob, the apparatus records and adjusts the threshold for the parameter.

As shown in block 2810 of FIG. 28, an apparatus may be configured to start the process of adjusting the threshold for a parameters detected by one or more sensors. In block 2820, the apparatus receives one or more parameters of one or more monitoring signals from one or more sensors. Such parameters may include, but not limited to, motion, temperature, humidity, CO level, $CO_2$ level, natural gas level, propane level, butane level, and/or pollution levels. Upon receiving a parameter of a monitoring signal, the apparatus compares the parameter with the predetermined threshold stored in the database 2830 which may reside on the memory of the controller of the safety device or may be stored externally from the safety device and accessed. If the detected parameter exceeds the predetermined threshold, the apparatus will send a control signal to the motor, which in turn drives the control knob and/or operational shaft to turn off the burner, as shown in the block 2850 of FIG. 28.

In the block 2860 of FIG. 28, the apparatus determines whether a user manually turns on the burner after it has been automatically turned off. This could happen when the predetermined threshold is not set correctly to accommodate the cooking scenario. For example, when the burner is used to grill meat, a large amount of smoke may be produced, which may exceed a threshold for smoke level. In other words, certain cooking scenarios may trigger a "false alarm." In this case, a user may decide to manually turn the burner back to an On position by rotating the safety, press a button or capacitive touch sensor on the user device or using a user interface on a user device. Upon receiving manual adjustment from the user, the apparatus may communicate with database 2830 to adjust the relevant threshold to reflect the cooking scenario. Therefore, by adjusting the threshold based on user feedbacks, the accuracy of the apparatus can be improved.

Figure 29:
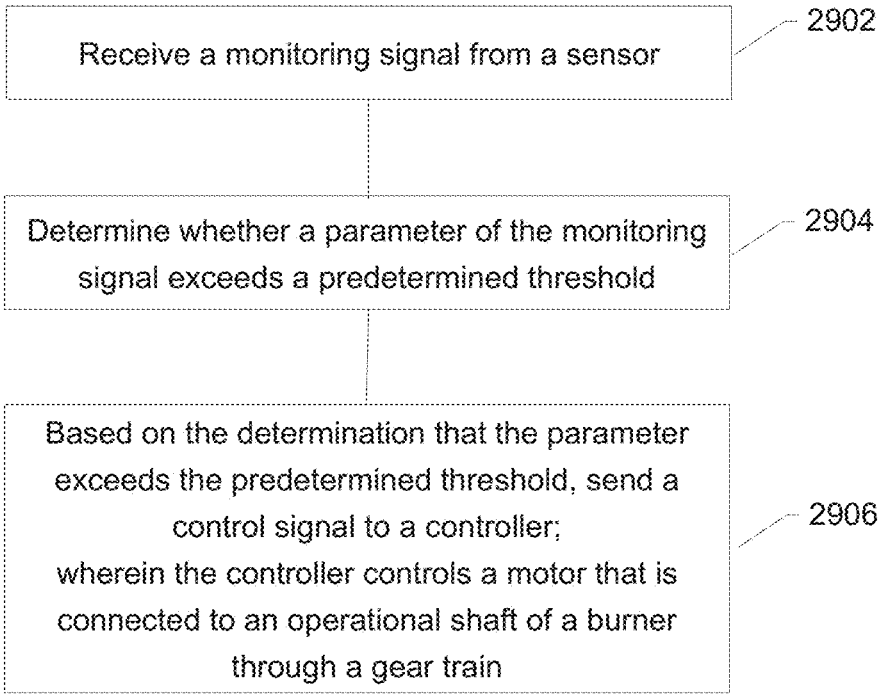
FIGS. 29-32 show example flow charts of additional exemplary methods in accordance with some embodiments of the present invention.

Referring to FIG. 29, a flowchart is provided that illustrates a detailed sequence of example operations for operation control of a burner in accordance with some example embodiments. As described above, in general the operations of operating a safety device for operation control of a burner include detecting a safety event and turning the burner off. As also noted previously, the various operations described below may be performed by a safety device module 1302, sensor/relay module 1304, and/or user device 1306.

In operation 2902, safety device module 1302 includes means, such as communication circuitry 1302*e*, device controller 1302*c*, or the like, for receiving a monitoring signal from a sensor. In some examples, the monitoring signal may be received from sensors such as a motion sensor located in the safety device module. The sensor may also comprise one or more of a motion sensor, a smoke sensor, a carbon monoxide sensor, a humidity sensor, a gas sensor, a fire detector, a flame detector, a camera, and a microphone. In another example, the monitoring signal may be received by controller 1304*d* from one or sensors in sensor/relay module 1304, such as any of the sensors 1304*a*-1304*c*. For example, smoke sensor 1304*a* may send a monitoring signal which indicates that a certain level of particulate smoke (a parameter) has been detected by the sensor.

In operation 2904, safety device module 1302 includes means, such as communication circuitry 1302*e*, device controller 1302*c*, or the like, and/or the sensor/relay module 1304 includes means, such as communication circuitry 1304*e*, controller 1304*d*, or the like, for determining whether a parameter of the monitoring signal exceeds a predetermined threshold. For example, the level of particulate smoke detected by the sensor may be compared to acceptable or predetermined threshold levels, where levels of smoke above the threshold levels may indicate that a hazardous situation or safety event is developing or occurring.

In operation 2906, safety device module 1302 includes means, such as communication circuitry 1302*e*, device controller 1302*c*, or the like, for sending a control signal to a controller based on the determination that the parameter exceeds the predetermined threshold. In some examples, the determination that the parameter exceeds the predetermined threshold level may take place at controller 1304*d* or controller 1302*c*. In the instance that the determination takes place at 1304*d*, the controller 1302*c* may receive an indication of the determination or a control signal from controller 1304*d* by communication circuitry 1304*e* and 1302*e*. The controller 1302*c* controls a motor, such as motor 1302*f*, that is connected to an operational shaft of a burner, such as through a gear train. The controller 1302*c* will then generate or relay a control signal to motor driver 1302*d* to control motor 1302*f*. In some examples, the control signal generated by controller 1304*d* is sent to a plurality of controllers, wherein each of the plurality of controllers controls a motor that is connected to an operational shaft of a burner of a plurality of burners. In some examples, the control signal causes the motor and gear train to turn the operational shaft of the burner to an Off position.

Figure 30:
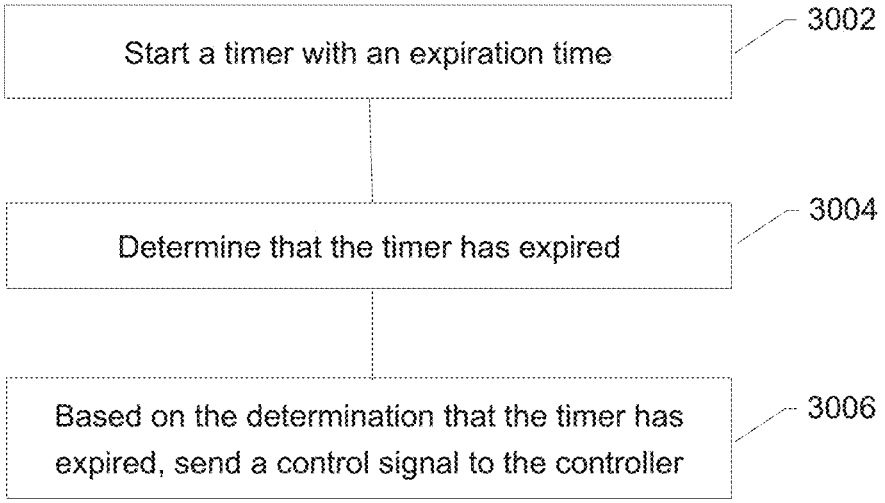

Referring to FIG. 30, a flowchart is provided that illustrates a detailed sequence of example operations for operation control of a burner, in accordance with some example embodiments. As also noted previously, the various operations described below may be performed by a safety device module 1302, sensor/relay module 1304, and/or user device 1306.

In operation 3002, safety device module 1302 includes means, such as device controller 1302*c*, or the like, for starting a timer with an expiration time. For example, once the operational shaft of the burner has been turned on, the timer may automatically start for a set period expiration time, such as five, ten, fifteen, twenty, thirty, forty-five, or sixty minutes, or any other determined, set, or pre-set length of time.

In operation 3004, safety device module 1302 includes means, such as device controller 1302*c*, for determining if the timer has expired. For example, after expiration time of five, ten, fifteen, twenty, thirty, forty-five, or sixty minutes has passed, the timer may expire.

In operation 3006, safety device module 1302 includes means, such as communication circuitry 1302*e*, device controller 1302*c*, or the like, for sending a control signal to the controller based on the determination that the timer has expired. For example, if the timer is kept by the controller 1302*c*, the controller may issue or send a signal to itself or merely determine that the timer has expired. The control signal may be an off signal such that the motor that is connected to an operational shaft of a burner through a gear train turns the operation shaft of the burner to an Off position. In some examples, the timer may be kept at sensor/relay module 1304 wherein controller 1304*d* performs the operation described above and sends the control signal to controller 1302*c*.

In some examples, the safety device module 1302 includes means, such as device controller 1302*c*, to restart or reset the timer, such as upon determination that human motion is detected. For example, if human motion is detected by the sensor/relay module 1304 or the safety module 1302 as described herein, the timer may be restarted or reset.

Figure 31:
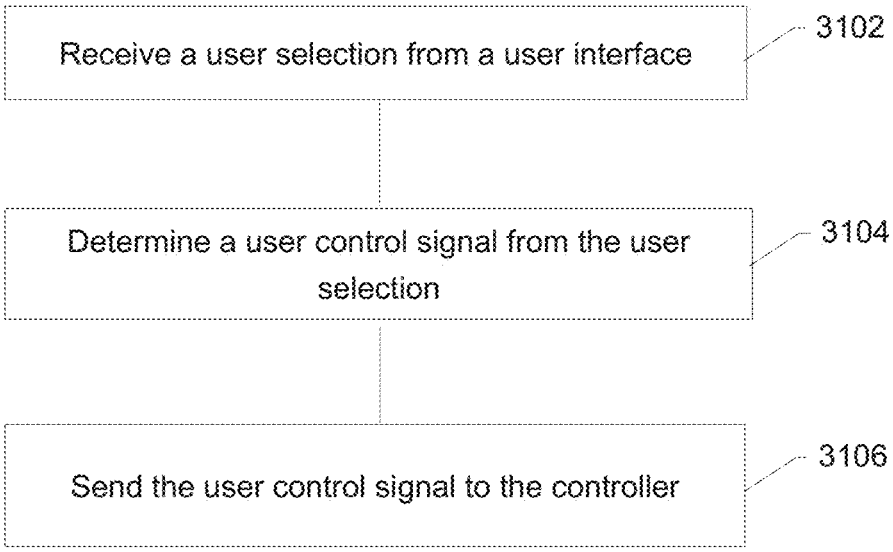

Referring to FIG. 31, a flowchart is provided that illustrates a detailed sequence of example operations for operation control of a burner, in accordance with some example embodiments. As also noted previously, the various operations described below may be performed by a safety device module 1302, sensor/relay module 1304, and/or user device 1306.

In operation 3102, user device 1306 includes means, such as user interface circuitry 1306*c*, or the like, for receiving a user selection from a user interface.

In operation 3104, user device 1306 includes means, such as device control circuitry 1306*e*, for determining a user control signal from the user selection. For example, a user control signal may comprise a user selection to modulate the power supplied to control the temperature of the burner.

In operation 3106, user device 1306 includes means, such as communication circuitry 1306*d*, to send the user control signal to the controller 1302*c* such that the controller 1302*c* may cause the motor 1302*f* to modulate the positon of the operational shaft of the burner.

Figure 32:
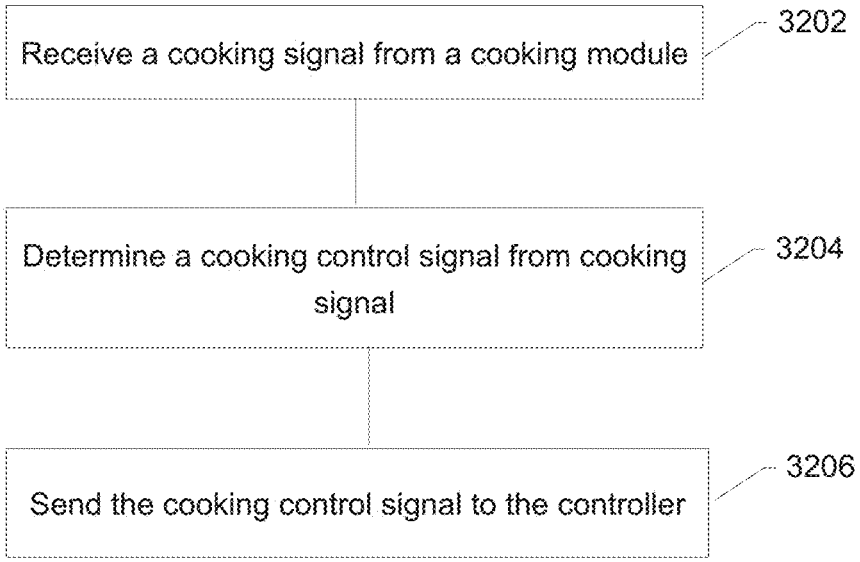

Referring to FIG. 32, a flowchart is provided that illustrates a detailed sequence of example operations for operation control of a burner, in accordance with some example embodiments. As also noted previously, the various operations described below may be performed by a safety device module 1302, sensor/relay module 1304, and/or user device 1306.

In operation 3202, sensor/relay module 1304 includes means, such as communication circuitry 1304*e*, or the like, for receiving a cooking signal from a cooking module 1312. For example, cooking module 1312 may determine that the power supplied to the burner needs to be increased and thus transmit an increase temperature cooking signal to the sensor/relay module 1304.

In operation 3304, sensor/relay module 1304 includes means, such as device controller 1304*d*, for determining a cooking control signal from cooking signal. For example, controller 1304*d* may determine from the increase temperature cooking signal to modulate the position of safety device module 1302 from a medium position to a medium high position.

In operation 3306, sensor/relay module 1304 includes means, such as communication circuitry 1304*e* or the like, for sending the cooking control signal to the controller 1302*c*, where the controller 1302*c* causes the motor 1302*f* to modulate the position of the safety device module 1302 and thus modulate the position of the operational shaft of the burner to a medium high position.

Many modifications and other embodiments will come to mind to one skilled in the art to which these embodiments pertain having the benefit of the teachings presented in the foregoing descriptions and the associated drawings. Therefore, it is to be understood that embodiments and implementations are not to be limited to the specific example embodiments disclosed and that modifications and other embodiments are intended to be included within the scope of the appended claims. Although specific terms are employed herein, they are used in a generic and descriptive sense only and not for purposes of limitation.

The invention claimed is:

1. A method for operational control of a burner, the method comprising:

receiving a monitoring signal from a sensor, wherein the monitoring signal indicates at least a smoke level;

receiving a device status indication, wherein the device status indication indicates a current position of an operational shaft of the burner;

retrieving a predetermined threshold from a database, wherein the predetermined threshold indicates at least a threshold smoke level;

determining whether a parameter of the monitoring signal exceeds the predetermined threshold;

based on the device status indication and the determination that the parameter exceeds the predetermined threshold, sending a control signal to a controller, wherein the controller controls a motor that is connected to the operational shaft of the burner, causing the motor to turn the operational shaft of the burner to an Off position in response to the control signal;

subsequent to sending the control signal to cause the operational shaft to be turned to the Off position, receiving a manual adjustment signal indicating that the operational shaft is turned to an On position by a user; and in response to receiving the manual adjustment signal indicating that the operational shaft is turned to the On position by the user subsequent to the control signal causing the operational shaft to be turned to the Off position, adjusting the threshold smoke level of the predetermined threshold based on the smoke level indicated by the monitoring signal.

2. The method of claim 1, wherein the control signal is sent to a plurality of controllers, wherein each of the plurality of controllers controls a motor that is connected to an operational shaft of a burner of a plurality of burners.

3. The method of claim 1, wherein the device status indication indicates that the operational shaft of the burner is at an On position.

4. The method of claim 1, wherein the sensor comprises a smoke detector.

5. The method of claim 1, further comprising:

starting a timer with an expiration time;

determining that the timer has expired; and based on the determination that the timer has expired, sending a control signal to the controller.

6. The method of claim 5, further comprising restarting the timer upon determination that human motion is detected.

7. The method of claim 1, further comprising:

causing displaying a user interface on a user computing device;

receiving a user selection of a user interface component from the user interface;

determining a user control signal associated with the motor based on the user selection of the user interface component; and sending the user control signal to the controller.

8. The method of claim 1, further comprising:

receiving a cooking signal from a cooking module;

determining a cooking control signal from the cooking signal; and sending the cooking control signal to the controller.

9. The method of claim 1, wherein the controller is further configured to cause the motor to turn the operational shaft of the burner by causing turning of a gear train of the motor, the gear train comprising a gear with at least one gear tooth removed to create a rotation zone.

10. A non-transitory computer-readable storage medium for operational control of a burner, the non-transitory computer-readable storage medium storing program code instructions that, when executed, cause a computing device to:

receive a monitoring signal from a sensor, wherein the monitoring signal indicates at least a smoke level;

receive a device status indication, wherein the device status indication indicates a current position of an operational shaft of the burner;

retrieve a predetermined threshold from a database, wherein the predetermined threshold indicates at least a threshold smoke level;

determine whether a parameter of the monitoring signal exceeds the predetermined threshold;

based on the device status indication and the determination that the parameter exceeds the predetermined threshold, send a control signal to a controller, wherein the controller controls a motor that is connected to the operational shaft of the burner, causing the motor to turn the operational shaft of the burner to an Off position in response to the control signal;

subsequent to sending the control signal to cause the operational shaft to be turned to the Off position, receive a manual adjustment signal indicating that the operational shaft is turned to an On position by a user; and in response to receiving the manual adjustment signal indicating that the operational shaft is turned to the On position by the user subsequent to the control signal causing the operational shaft to be turned to the Off position, adjust the threshold smoke level of the predetermined threshold based on the smoke level indicated by the monitoring signal.

11. The non-transitory computer-readable storage medium of claim 10, wherein the control signal is sent to a plurality of controllers, wherein each of the plurality of controllers controls a motor that is connected to an operational shaft of a burner of a plurality of burners.

12. The non-transitory computer-readable storage medium of claim 10, wherein the device status indication indicates that the operational shaft of the burner is at an On position.

13. The non-transitory computer-readable storage medium of claim 10, wherein the sensor comprises a smoke detector.

14. The non-transitory computer-readable storage medium of claim 10, storing further program code instructions that, when executed, cause the computing device to further:

start a timer with an expiration time;

determine that the timer has expired; and based on the determination that the timer has expired, send a control signal to the controller.

15. The non-transitory computer-readable storage medium of claim 14, storing further program code instructions that, when executed, cause the computing device to further restart the timer upon determination that human motion is detected.

16. The non-transitory computer-readable storage medium of claim 10, storing further program code instructions that, when executed, cause the computing device to further:

cause displaying a user interface on the computing device;

receive a user selection of a user interface component from the user interface;

determine a user control signal associated with the motor based on the user selection of the user interface component; and send the user control signal to the controller.

17. The non-transitory computer-readable storage medium of claim 10, storing further program code instructions that, when executed, cause the computing device to further:

receive a cooking signal from a cooking module;

determine a cooking control signal from the cooking signal; and send the cooking control signal to the controller.

18. The non-transitory computer-readable storage medium of claim 10, wherein the controller is further configured to cause the motor to turn the operational shaft of the burner by causing turning of a gear train of the motor, the gear train comprising a gear with at least one gear tooth removed to create a rotation zone.

19. The method of claim 1, wherein the monitoring signal further indicates a gas level in a cooking environment, wherein the predetermined threshold indicates a threshold gas level, wherein the method further comprises:

in response to receiving the manual adjustment signal indicating that the operational shaft is turned to an On position by the user subsequent to the control signal causing the operational shaft to be turned to the Off position, adjusting the threshold gas level of the predetermined threshold based on the gas level in the cooking environment.

20. The non-transitory computer-readable storage medium of claim 10, wherein the monitoring signal further indicates a gas level in a cooking environment, wherein the predetermined threshold indicates a threshold gas level, wherein the non-transitory computer-readable storage medium stores the program code instructions that, when executed, cause the computing device to:

in response to receiving the manual adjustment signal indicating that the operational shaft is turned to an On position by the user subsequent to the control signal causing the operational shaft to be turned to the Off position, adjust the threshold gas level of the predetermined threshold based on the gas level in the cooking environment.

* * * * *